US006447103B1

(12) United States Patent
Sugama et al.

(10) Patent No.: US 6,447,103 B1
(45) **Date of Patent: *Sep. 10, 2002**

(54) LIQUID EJECTING METHOD, LIQUID EJECTING HEAD, HEAD CARTRIDGE AND LIQUID EJECTING APPARATUS USING SAME

(75) Inventors: Sadayuki Sugama, Tsukuba; Akira Asai, Atsugi; Hiroyuki Ishinaga, Tokyo; Toshio Kashino, Chigasaki; Kiyomitsu Kudo, Kawasaki; Hiroyuki Sugiyama, Sagamihara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/617,849

(22) Filed: Jul. 17, 2000

Related U.S. Application Data

(62) Division of application No. 08/891,324, filed on Jul. 10, 1997, now Pat. No. 6,113,224.

(30) Foreign Application Priority Data

Jul. 12, 1996 (JP) ..... 8-183851
Jul. 12, 1996 (JP) ..... 8-183853
Jul. 4, 1997 (JP) ..... 9-179997

(51) Int. Cl.[7] ..... B41J 2/05
(52) U.S. Cl. ..... 347/65
(58) Field of Search ..... 347/63, 65, 67, 347/62, 54, 56, 20

(56) References Cited

U.S. PATENT DOCUMENTS 4,480,259 A 10/1984 Kruger et al. ..... 347/63
4,723,129 A 2/1988 Endo et al. ..... 347/56
4,994,825 A 2/1991 Saito et al. ..... 347/63
5,208,604 A 5/1993 Watanabe et al. ..... 347/47
5,278,585 A 1/1994 Karz et al. ..... 347/65
5,389,957 A 2/1995 Kimura et al. ..... 347/20
5,589,858 A 12/1996 Kadowaki et al. ..... 347/14
5,602,576 A 2/1997 Murooka et al. ..... 347/59
5,821,962 A 10/1998 Kudo ..... 347/65
6,113,224 A * 9/2000 Sugama et al. ..... 347/65

FOREIGN PATENT DOCUMENTS

EP 0 436 047 7/1991
EP 0 721 842 7/1996
JP 55-81172 6/1980
JP 61-69467 4/1986
JP 62-196154 8/1987
JP 63-199972 8/1988

* cited by examiner

*Primary Examiner*—John Barlow
*Assistant Examiner*—Juanita Stephen
(74) *Attorney, Agent, or Firm*—Fitzpatrick, Cella, Harper & Scinto

(57) ABSTRACT

A liquid ejecting method includes displacing a movable member having a free end by bubble generation in a bubble generating region; the improvement residing in: that a fulcrum of said movable member is disposed adjacent to one side of a displacement region where the free end of said movable member displaces, and an ejection outlet through which the liquid is ejected is disposed adjacent to the opposite side of the displacement region; that there is provided a first period in which a displacing speed of the free end of the movable member is higher than a growing speed of the bubble generated in the bubble generating region toward the movable member, before the bubble reaches its maximum size.

27 Claims, 27 Drawing Sheets

LIQUID EJECTING METHOD, LIQUID EJECTING HEAD, HEAD CARTRIDGE AND LIQUID EJECTING APPARATUS USING SAME

CROSS-REFERENCE TO RELATED APPLICATION

This application is a division of application Ser. No. 08/891,324, filed on Jul. 10, 1997 now U.S. Pat. No. 6,113,224.

FIELD OF THE INVENTION AND RELATED ART

The present invention relates to a liquid ejection method, liquid ejecting head, a head cartridge and liquid ejecting apparatus.

More particularly, the present invention relates to a liquid ejecting method using growth of bubble and displacement of a movable member.

The present invention is applicable to a printer for printing on a recording material such as paper, thread, fiber, textile, leather, metal, plastic resin material, glass, wood, ceramic or the like; a copying machine; a facsimile machine including a communication system; a word processor or the like including a printer portion; or another industrial recording device comprising various processing devices.

In this specification, "recording" means not only forming an image of letter, figure or the like having specific meanings, but also includes forming an image of a pattern not having a specific meaning.

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129 and so on, a recording device using the bubble jet recording method comprises an ejection outlet for ejecting the ink, an ink flow path in fluid communication with the ejection outlet, and an electrothermal transducer as energy generating means disposed in the ink flow path. With such a recording method is advantageous in that, a high quality image, can be recorded at high speed and with low noise, and a plurality of such ejection outlets can be posited at high density, and therefore, small size recording apparatus capable of providing a high resolution can be provided, and color images can be easily formed. Therefore, the bubble jet recording method is now widely used in printers, copying machines, facsimile machines or another office equipment, and for industrial systems such as textile printing device or the like.

With the increase of the wide needs for the bubble jet technique, various demands are imposed thereon, recently.

For example, an improvement in energy use efficiency is demanded. To meed the demand, the optimization of the heat generating element such as adjustment of the thickness of the protecting film is investigated. This method is effective in that propagation efficiency of the generated heat to the liquid is improved.

In order to provide high quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Japanese Laid Open Patent Application No. SHO-63-199972 and so on discloses a flow passage structure. The backward wave is known as an energy loss since it is not directed toward the ejecting direction.

Japanese Laid Open Patent Application No. SHO-63-199972 disclose a valve 10 spaced from a generating region of the bubble generated by the heat generating element 2 in a direction away from the ejection outlet 11. The valve 4 has an initial position where it is stuck on the ceiling of the flow path 5, and suspends into the flow path 5 upon the generation of the bubble. The loss is said to be suppressed by controlling a part of the backward wave by the valve 4.

On the other hand, in the bubble jet recording method, the heating is repeated with the heat generating element contacted with the ink, and therefore, a burnt material is deposited on the surface of the heat generating element due to burnt deposit of the ink. However, the amount of the deposition may be large depending on the materials of the ink. If this occurs, the ink ejection becomes unstable. Additionally, even when the liquid to be ejected is the one easily deteriorated by heat or even when the liquid is the one with which the bubble generated is not sufficient, the liquid is desired to be ejected in good order without property change.

From this standpoint, Japanese Laid Open Patent Application No. SHO-61-69467, Japanese Laid Open Patent Application No. SHO-55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicone rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, in the head wherein the ejection liquid and the bubble generation liquid are completely separated, the pressure upon the bubble generation is propagated to the ejection liquid through the deformation of the flexible film, and therefore, the pressure is absorbed by the flexible film to a quite high extend. In addition, the deformation of the flexible film is not so large, and therefore, the energy use efficiency and the ejection force are deteriorated although the some effect is provided by the provision between the ejection liquid and the bubble generation liquid.

SUMMARY OF THE INVENTION

Accordingly, it is a principal object of the present invention to provide liquid ejecting method, head, cartridge and apparatus, wherein the ejection efficiency is stabilized and/or improved.

It is another object of the present invention to provide liquid ejecting method, head, cartridge and apparatus, wherein behavior of a bubble generated in a bubble generating region is controlled.

It is a further object of the present invention to provide liquid ejecting method, head, cartridge and apparatus, wherein factors relating to a liquid flow path, heat generating element, movable member and/or liquid, are properly determined.

According to an aspect of the present invention, the pressure distribution in the flow path or regions, provided by acoustic wave resulting from the generation of the bubble generating region, is effectively used for moving the free end of the movable member. More particularly, the displacing speed of the free end of the movable member higher than the growing speed of the bubble is effective to provide an induction path for the growing bubble. The induction path provides a secondary pressure distribution to properly direct the bubble growth.

According to another aspect of the present invention, a larger volume of the bubble can be used for the ejection.

According to a further aspect of the present invention, a larger component of the bubble is directed toward the ejection outlet. Therefore, the ejection speed and the ejection amount are stabilized in the second period.

According to a further aspect of the present invention, by the area of the heat generating element being 64 to 20000 $\mu m^2$, the bubble generation is stabilized, and by the area of the movable member and the longitudinal elasticity thereof being 64 to 40000 $\mu m^2$ and $1\times10^3$ to $1\times10^6$ $N/mm^2$, a height ejection efficiency and durability are provided. By the height of the first liquid flow path being 10–150 $\mu m$, the ejection power is stabilized, and by the height of the second liquid flow path being 0.1–40 $\mu m$, the ejection efficiency is further enhanced, and the bubble generation is further stabilized. As regards the viscosity of the liquid, when the liquid in the first liquid path is not different from the liquid in the second liquid flow path, is 1 to 100 cp so that ejection is stabilized. When they are separated, the liquid in the first liquid flow path is in the range of 1–1000 cp. By using a liquid ejecting head having the thus limited area of the movable member or the like, the flow of the liquid can be divided by the trace of the free end of the movable member.

In another aspect of the present invention, even if the printing operation is started after the recording head is left in a low temperature or low humidity condition for a long term, the ejection failure can be avoided. Even if the ejection failure occurs, the normal operation is recovered by a small scale recovery process including a preliminary ejection and sucking recovery. According to the present invention, the time required for the recovery can be reduced, and the loss of the liquid by the recovery operation is reduced, so that running cost can be reduced.

In an aspect of improving the refilling property, the responsivity, the stabilized growth of the bubble and stabilization of the liquid droplet during the continuous ejections are accomplished, thus permitting high speed recording.

In this specification, "upstream" and "downstream" are defined with respect to a general liquid flow from a liquid supply source to the ejection outlet through the bubble generation region (movable member).

As regards the bubble per se, the "downstream" is defined as toward the ejection outlet side of the bubble which directly function to eject the liquid droplet. More particularly, it generally means a downstream from the center of the bubble with respect to the direction of the general liquid flow, or a downstream from the center of the area of the heat generating element with respect to the same.

In this specification, "substantially sealed" generally means a sealed state in such a degree that when the bubble grows, the bubble does not escape through a gap (slit) around the movable member before motion of the movable member.

In this specification, "separation wall" may mean a wall (which may include the movable member) interposed to separate the region in direct fluid communication with the ejection outlet from the bubble generation region, and more specifically means a wall separating the flow path including the bubble generation region from the liquid flow path in direct fluid communication with the ejection outlet, thus preventing mixture of the liquids in the liquid flow paths.

In this specification, "growing speed of the bubble" means a maximum speed (m/s) of an interface between the bubble and the liquid which has a component directed toward the movable member.

Additionally, in this specification "substantial contact between the bubble and the movable member" means a situation under which the bubble and the movable member are physically contacted with each other at least at a part or a situation under which a thin liquid film exists therebetween, and the growth of the bubble and the movement of the movable member are influenced with each other.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

A first embodiment of the present invention will be described in conjunction of the accompanying drawings. In this embodiment, the ejection power and/or the ejection efficiency is improved by controlling a propagation direction of a pressure and/or the growth direction of the bubble provided by the bubble produced to eject the liquid.

Figure 1:
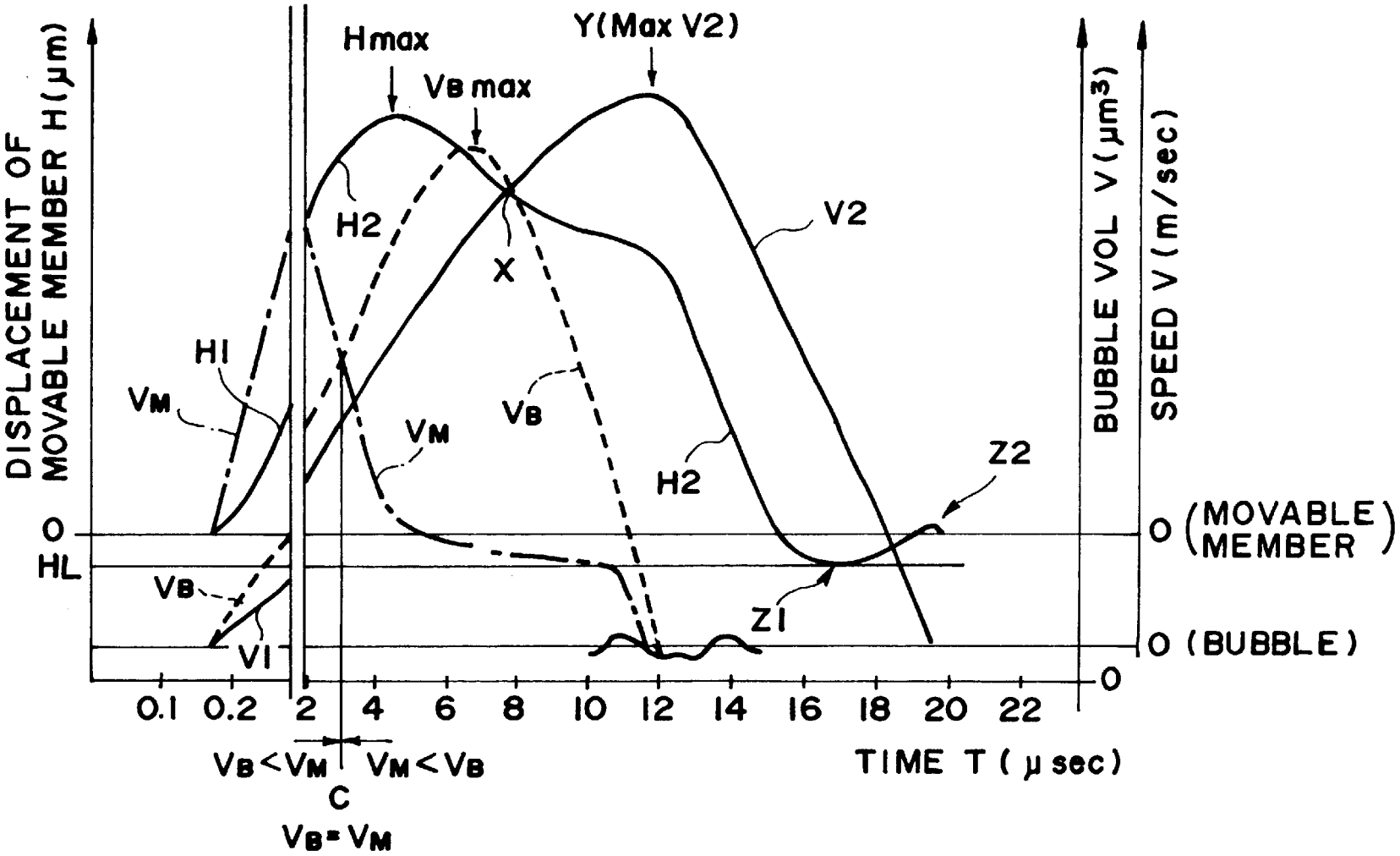
FIG. 1 is a graph showing a relation of the displacement of the movable member and the bubble growth vs. time and period.
Figure 2:
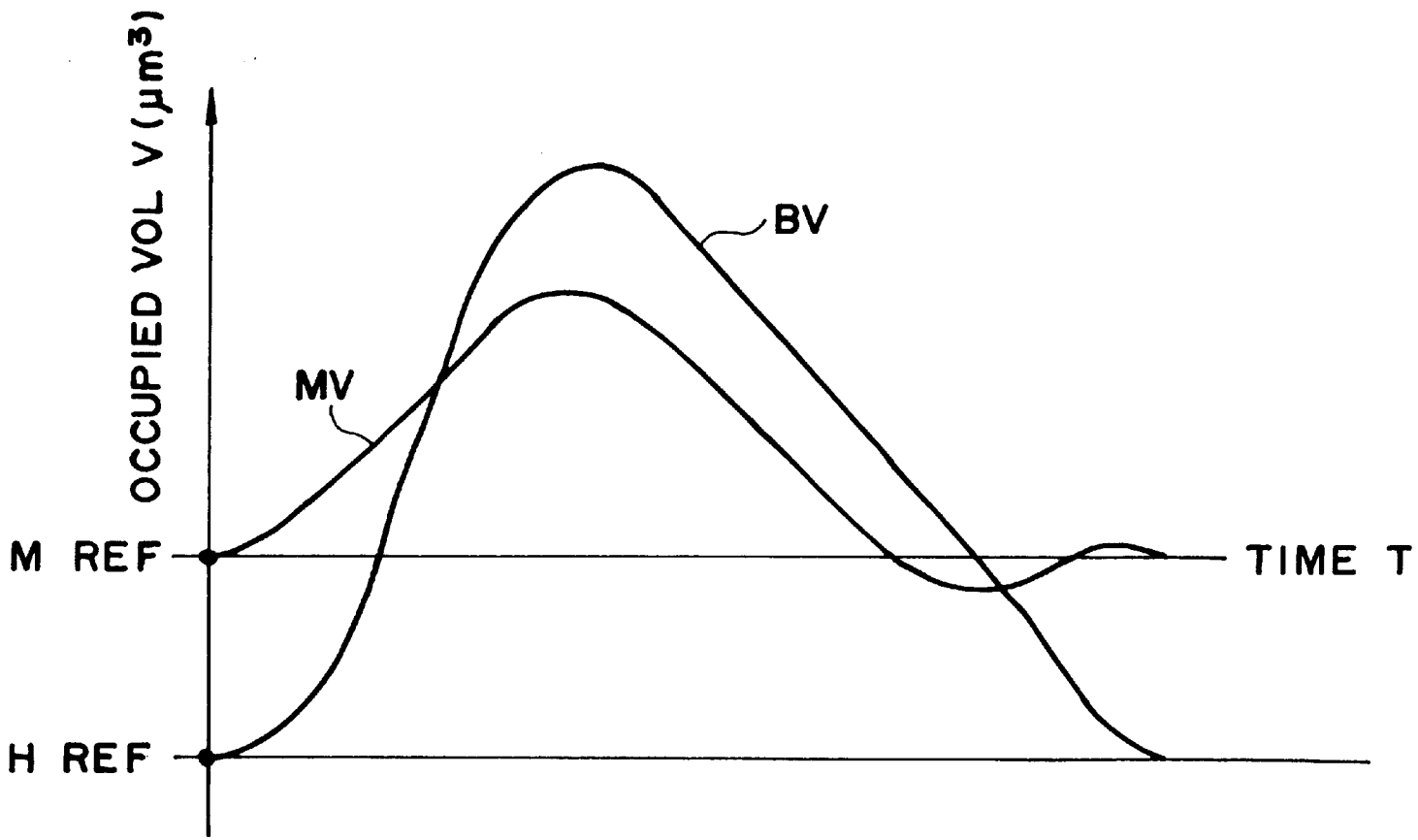
FIG. 2 is a graph showing a displacement of the movable member and the volume change of the bubble vs. time.
Figure 3:
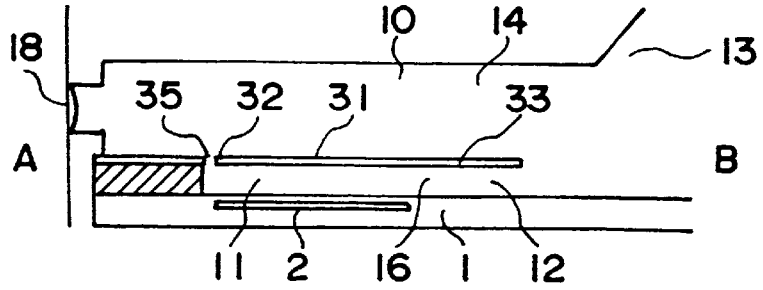
FIGS. 3, (a) to (e) are schematic sectional views showing liquid ejection process in a liquid ejecting head according to a first embodiment of the present invention.
Figure 3:
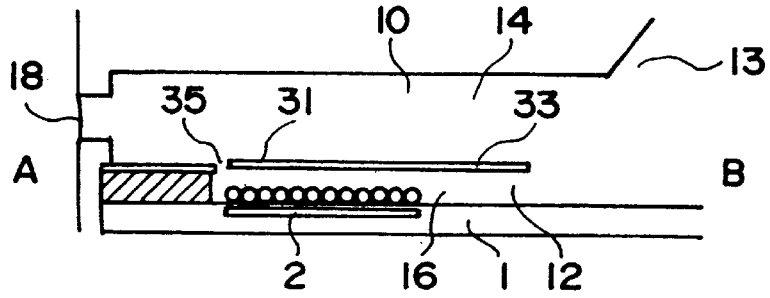
Figure 3:
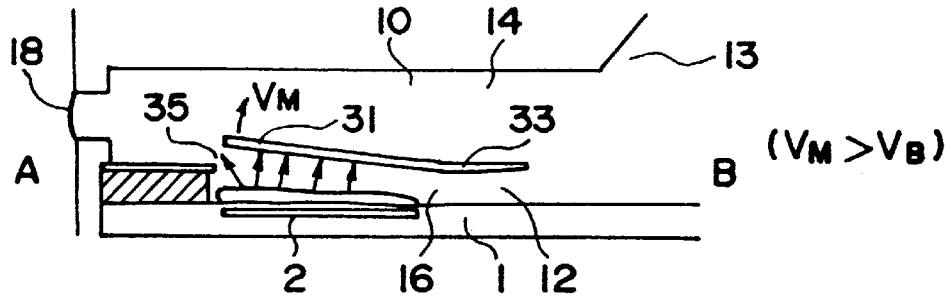
Figure 3:
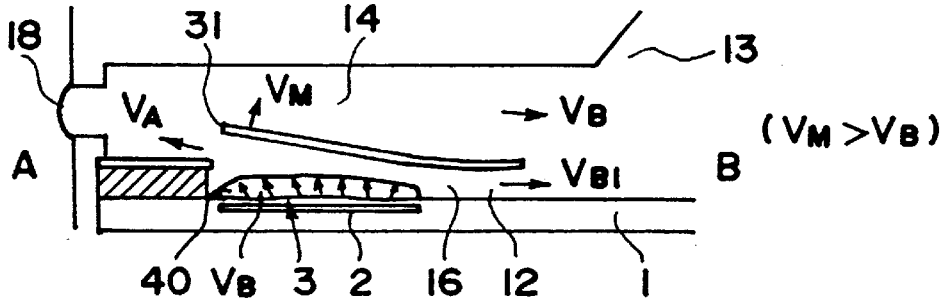
Figure 3:
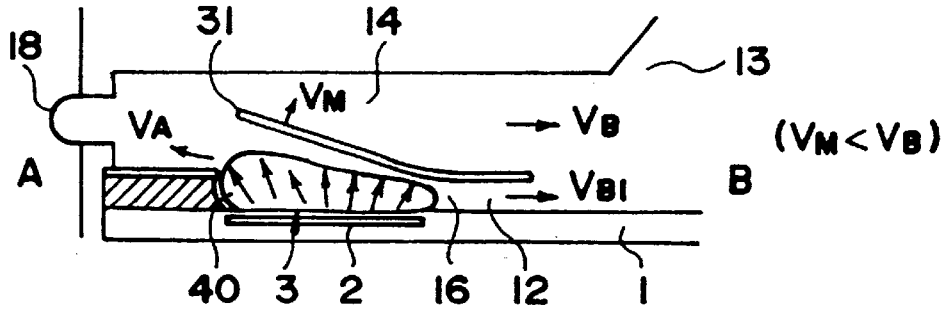
Figure 4:
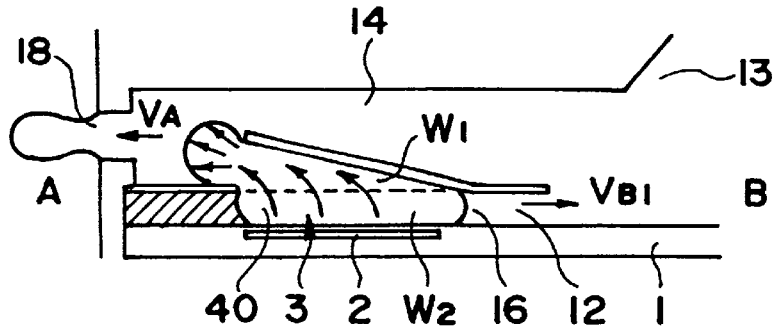
FIGS. 4, (a) to (d) are schematic sectional views showing liquid ejection process in a liquid ejecting head according to a first embodiment of the present invention.
Figure 4:
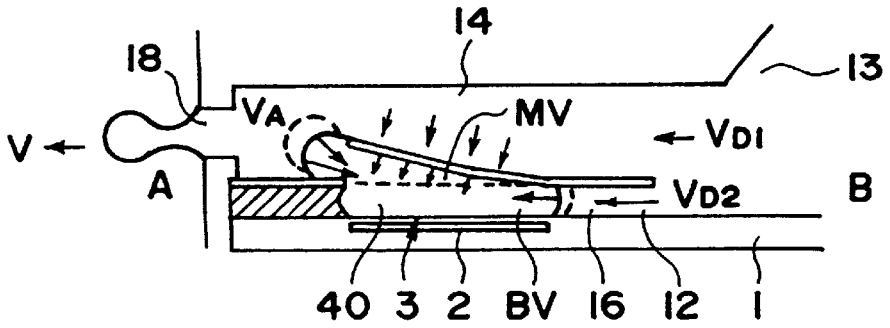
Figure 4:
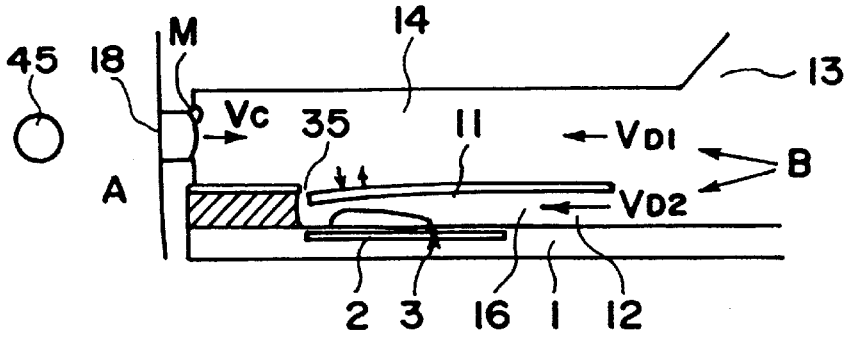
Figure 4:
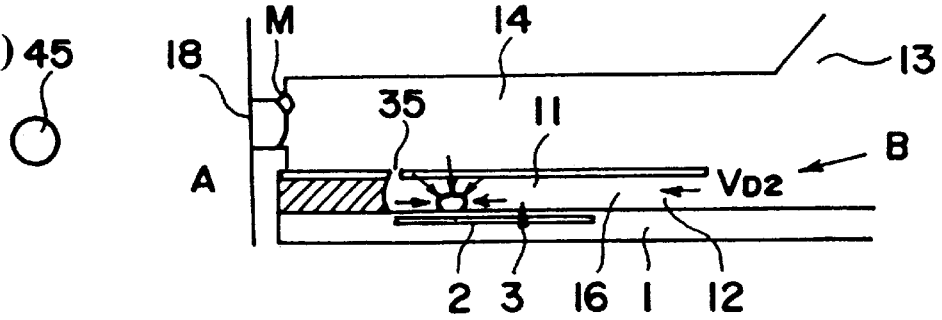
Figure 5:
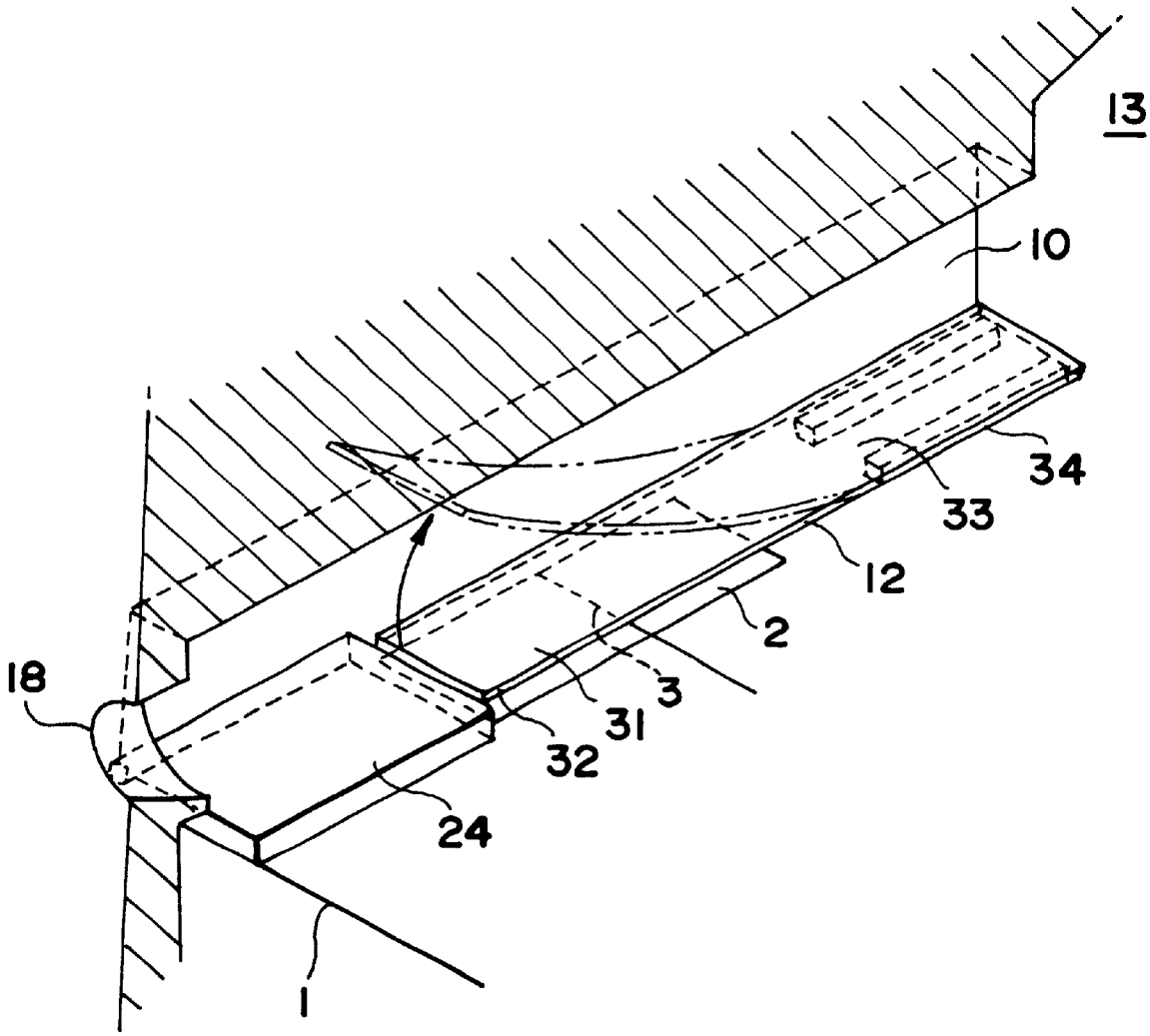
FIG. 5 is a partly broken perspective view of a liquid ejecting head according to the first embodiment.

FIG. 1 shows a relation between the displacing speed VM of a movable member and the growing speed VB of the bubble, and FIG. 2 show the same as volumes. FIGS. 3 and 4 are schematic sectional views of a liquid ejecting head taken along a direction of liquid flow path, and show the process of the liquid ejection. FIG. 5 is a partly broken perspective view of a liquid ejecting head.

The liquid ejecting head of this embodiment comprises a heat generating element 2 (comprising a first heat generating element 2A and a second heat generating element 2B and having a dimension of 50 $\mu$m×120 $\mu$m as a whole in this embodiment) as the ejection energy generating element for supplying thermal energy to the liquid to eject the liquid, an element substrate 1 on which said heat generating element 2 is provided, and a liquid flow path 10 formed above the element substrate correspondingly to the heat generating element 2. The liquid flow path 10 is in fluid communication with a common liquid chamber 13 for supplying the liquid to a plurality of such liquid flow paths 10 which is in fluid communication with a plurality of the ejection outlets 18, respectively.

Above the element substrate in the liquid flow path 10, a movable member or plate 31 in the form of a cantilever of an elastic material such as metal, having a thickness of 3 $\mu$m is provided faced to the heat generating element 2. One end of the movable member 31 is fixed to a foundation (supporting member) or the like provided by patterning of photosensitivity resin material on the wall of the liquid flow path 10 or the element substrate. By this structure, the movable member is supported, and a fulcrum (fulcrum portion) 33 is constituted.

The movable member 31 is so positioned that it has a fulcrum (fulcrum portion which is a fixed end) 33 in an upstream side with respect to a general flow of the liquid from the common liquid chamber 13 toward the ejection outlet 18 through the movable member 31 caused by the ejecting operation and so that it has a free end (free end portion) 32 in a downstream side of the fulcrum 33. The movable member 31 is faced to the heat generating element 2 with a predetermined gap as if it covers the heat generating element 2. A bubble generation region 11 is constituted between the heat generating element 21 and movable member 31.

The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 10 is divided by the movable member 31, in the state shown in FIG. 3, (a) or FIG. 4 (d), into a first liquid flow path 14 which is directly in communication with the ejection outlet 18 and a second liquid flow path 16 having the bubble generation region 11 and the liquid supply port 12.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No. 4,723,129. The bubble and the pressure caused by the generation of the bubble act mainly on the movable member, so that movable member 31 moves or displaces to widely open toward the ejection outlet side about the fulcrum 33, as shown in FIG. 1, (b) and (c) or in FIG. 2. By the displacement of the movable member 31 or the state after the displacement, the propagation of the pressure caused by the generation of the bubble and the growth of the bubble 40 per se are directed toward the ejection outlet 18.

Here, one of the fundamental ejection principles according to the present invention will be described. One of important principles of this example is that movable member disposed faced to the bubble is displaced from the normal first position to the displaced second position on the basis of the pressure of the bubble generation or the bubble per se, and the displacing or displaced movable member 31 is effective to direct the pressure produced by the generation of the bubble 40 and/or the growth of the bubble 40 per se toward the ejection outlet 18 (downstream).

Figure 6:
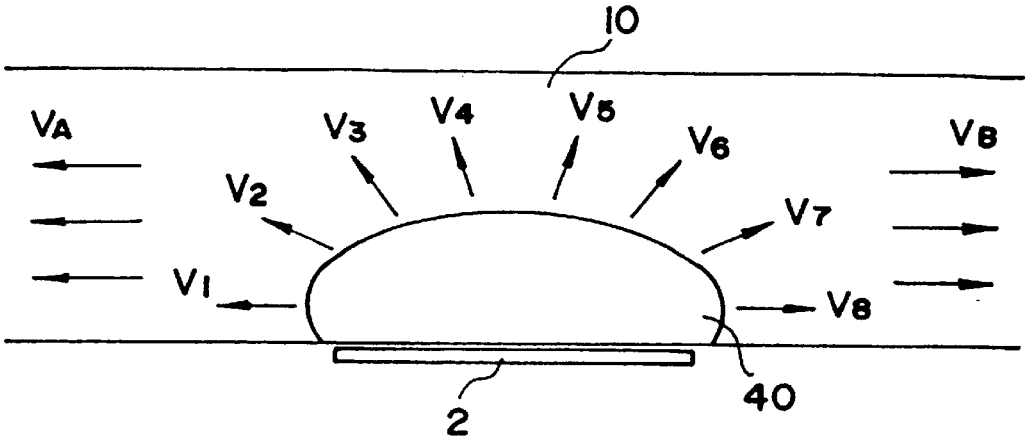
PRIOR ART FIG. 6
FIG. 6 a schematic view showing pressure propagation from a bubble in a conventional liquid ejecting head.
Figure 7:
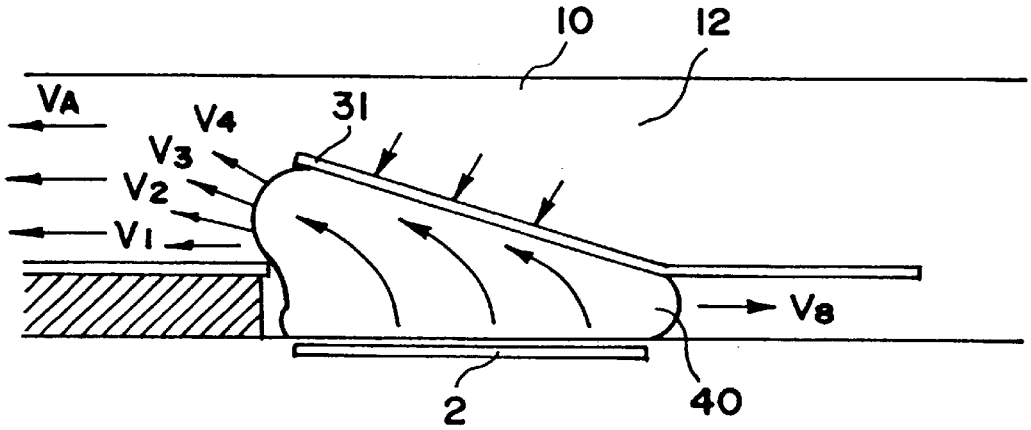
FIG. 7 is a schematic view showing pressure propagation from a bubble in a liquid ejecting head according to the present invention.

More detailed description will be made with comparison between the conventional liquid flow passage structure not using the movable member (FIG. 6) and the present invention (FIG. 7). Here, the direction of propagation of the pressure toward the ejection outlet is indicated by $V_A$, and the direction of propagation of the pressure toward the upstream is indicated by $V_B$. In a conventional head as shown in FIG. 3, there is not any structural element effective to regulate the direction of the propagation of the pressure produced by the bubble 40 generation. Therefore, the direction of the pressure propagation of the is normal to the surface of the bubble 40 as indicated by V1–V8, and therefore, is widely directed in the passage. Among these directions, those of the pressure propagation from substantially the half portion of the bubble closer to the ejection outlet (V1–V4), have the pressure components in the $V_A$ direction which is most effective for the liquid ejection. This portion is important since it is directly contributable to the liquid ejection efficiency, the liquid ejection pressure and the ejection speed. Furthermore, the component V1 is closest to the direction of $V_A$ which is the ejection direction, and therefore, the component is most effective, and the V4 has a relatively small component in the direction $V_A$.

On the other hand, in the case of the present invention, shown in FIG. 7, the movable member 31 is effective to direct, to the downstream (ejection outlet side), the pressure propagation directions V1–V4 of the bubble which otherwise are toward various directions. Thus, the pressure propagations of bubble 40 are concentrated so that pressure of the bubble 40 is directly and efficiently contributable to the ejection. The growth direction per se of the bubble is directed downstream similarly to the pressure propagation directions V1–V4, and the bubble grows more in the downstream side than in the upstream side. Thus, the growth direction per se of the bubble is controlled by the movable member, and the pressure propagation direction from the bubble is controlled thereby, so that ejection efficiency, ejection force and ejection speed or the like are fundamentally improved.

Referring back to FIGS. 3 and 4, the description will be made as to the ejecting operation of the liquid ejecting head according to this example.

FIG. 3, (a) shows a state before the energy such as electric energy is applied to the heat generating element 2, and therefore, no heat has yet been generated. It should be noted that movable member 31 is so positioned as to be faced at least to the downstream portion of the bubble 40 generated by the heat generation of the heat generating element 2. In other words, in order that downstream portion of the bubble 40 acts on the movable member, the liquid flow passage structure is such that movable member 31 extends at least to the position downstream (downstream of a line passing through the center 3 of the area of the heat generating element and perpendicular to the length of the flow path FIG. 3, (d)) of the center 3 of the area of the heat generating element. FIG. 3, (b) shows a state wherein the heat generation of heat generating element 2 occurs by the application of the electric energy to the heat generating element 2, and a part of the liquid filled in the bubble generation region 11 is heated by the thus generated heat so that bubble 40 is generated as a result of film boiling. At this time, a great number of fine bubbles are formed on the effective surface of the heat generating element 2. By this, a pressure distribution is produced in the liquid passage in the period of the order of 0.1 $\mu$sec.

The free end 32 of the movable member 31 starts to displace by the generation of the fine bubbles. It should be noted that, as described hereinbefore, the free end 32 of the movable member 31 is disposed in the downstream side (ejection outlet side), and the fulcrum 33 is disposed in the upstream side (common liquid chamber side), so that at least a part of the movable member is faced to the downstream portion of the bubble, that is, the downstream portion of the heat generating element.

In FIG. 3, (c), the fine bubbles become a large bubble in the form of a film covering the surface of the heat generating element 2, and it uniformly grows toward the movable member 31, and the free end 32 of the movable member 31 is moving in the displacement region at a displacing speed VM while the bubble is growing speed VB. The displacing speed VM is higher than the growing speed VB, and it is not so high as a speed (10 to 20 m/sec, for example) provided by the high acceleration at the initial stage; and VM is 8 m/sec, and VB is 6 m/sec, and the former is approx. twice the latter. By satisfying the condition of VB>VM, the free end 32 of the movable member having opened the slit 35, provides the condition under which the region which is in the minimum distance path to the ejection outlet 18 functions as an induction path for the subsequent growth of the bubble. When VM>VB is not satisfied, that is, when VM≦VB, the induction path effect is not nothing, but the displacement of the free end 32 is less than the displacement of the bubble, and therefore, the bubble growth direction is more uniform to the whole surface of the movable member 31.

According to this embodiment of the present invention, VM>VB is satisfied so that growth directivity of the bubble 40 is assured, as shown in FIG. 3, (e), to improve the ejection property. In FIG. 3, (d), the bubble 40 has further grown so that movable member 31 has displaced while the liquid is between the bubble 40 and the movable member 31. In response to the pressure resulting from the generation of the bubble 40, the movable member 31 is further displaced to the maximum displaced position as shown in FIG. 3, (e) (second position). At this stage, VM>VB is satisfied, or the speed of the free end of the movable member is reduced more with VM approaching to VB. In FIG. 3, (e), the moving speed of the entirety of the movable member 31 including the free end of the movable member 31, and the movable member 31 starts to move downward (negative speed). At this time, however, the bubble 40 per se still has a growing speed and continues to increase in its volume. Therefore, the rebounding of the movable member 31 to the initial state (FIG. 3, (a)) by its resiliency, is impeded by the growth of the bubble, so that restoration of the free end 32 of the movable member is obstructed. At this time, the growth of the bubble 40 toward the ejection outlet 18 extends out of the bubble formation region 11 into the induction path region, so that bubble expands to toward the ejection outlet, since the resistance is small in that direction. Therefore, the relation between the displacing speed VM and the growing speed VB is VB≧VM at this time, so that component directed toward the ejection outlet 18 is larger than the portion relation to the increase of the region of the induction path in the volume portion of the growing bubble 40, so that stabilized ejection speed and ejection amount can be accomplished.

In FIG. 4, (a), the bubble 40 is growing to its maximum, and the movable member 31 is substantially contacted to the bubble 40 in the process of returning from the second position (maximum displaced position). The bubble 40 grows more toward the downstream than toward the upstream, and it grows beyond the first position (broken line) of the movable member 31. With the growth of the bubble 40, the movable member 31 makes returning displacement by which the pressure propagation and the volume displacement of the bubble 40 are uniformly directed toward the ejection outlet, and therefore, the ejection efficiency can be increased. Thus, the movable member is positively contributable to direct the bubble and the resultant pressure toward the ejection outlet so that propagation direction of the pressure and the growth direction of the bubble can be controlled efficiently. In FIG. 4, (b), the bubble 40 is in the bubble collapse process, and the bubble collapse occurs quickly by the synergistic effect with the elastic force of the movable member 31, wherein the movable member 31 is accelerated toward the initial state. The liquid is refilled stably and efficiently as indicated by arrow VD1 and VD2 by the restoring function of the movable member 31.

In FIG. 4, (c), the movable member 31 overshoots due to the bubble 40 which quickly reduces and the inertia of the movable member 31, beyond the initial position into the bubble generating region 11. The overshooting is effective to suppress the refilling in the displacement region or the meniscus vibration or to promote the refilling of the liquid into the bubble generation region. The overshooting reduces as if the amplitude reduces. FIG. 4, (d) shows the end of bubble collapse, and the movable member 31 returns to the initial position and is stabilized there. Thus, the movable member 31 returns to the first position of FIG. 3, (a) by the negative pressure due to the contraction of the bubble and the resiliency of the movable member 31. Upon the collapse of bubble, the liquid flows back from the common liquid chamber side as indicated by $V_{D1}$ and $V_{D2}$ and from the ejection outlet side as indicated by $V_c$ so as to compensate for the volume reduction of the bubble in the bubble generation region 11 and to compensate for the volume of the ejected liquid.

For the purpose of stabilized bubble generation, the area is desirably 64–20000 $\mu m^2$, and further preferably 500–5000 $\mu m^2$. From the standpoint of the durability of the movable member 31 and the ejection efficiency, the projection area of the movable member 31 to the second liquid flow path 16 is preferably 64–40000 $\mu m^2$, and the longitudinal elasticity is $1\times10^3$–$1\times10^6$ N/mm$^2$. The ejection efficiency can be further improved, and the durability can be enhanced by the 1000–15000 $\mu m^2$ of the projected area of the movable member 31 to the second liquid flow path 16 and $1\times10^4$–$5\times10^6$ N/mm$^2$ For the stable ejection power, the height of the first liquid flow path 14 is preferably 10–150 $\mu$m, and further preferably, 30–60 $\mu$m. The height of the second liquid flow path 16 is preferably 0.1–40 $\mu$m from the standpoint of ejection efficiency and the stability of the bubble generation, and further preferably 3–25 $\mu$m for further stability of the bubble generation.

On the other hand, the viscosity of the liquid to be ejected is preferably 1–100 cP for stable ejection. Further preferably, it is 1–10 cP to further stabilize the ejection.

By the above numerical limitations for the heat generating element 2, movable member 31, each liquid flow paths 14, 16 and the viscosity of the liquid, the flow of the liquid can be divided into the upstream one and the downstream one by the trace of the free end 32 of the movable member 31.

In the foregoing, the description has been made as to the operation of the movable member 31 with the generation of the bubble and the ejecting operation of the liquid. Now, the description will be made as to the refilling of the liquid in the liquid ejecting head of the present invention.

Using FIGS. 3 and 4, the liquid supply mechanism is will be described.

After the state of FIG. 4, (a), the bubble 40 enters the bubble collapsing process after the maximum volume thereof (FIG. 1, (c)), and a volume of the liquid enough to compensate for the collapsing bubbling volume flows into the bubble generation region from the rejection outlet 18 side of the first liquid flow path 14 and from the bubble generation region of the second liquid flow path 16. In the case of conventional liquid flow passage structure not having the movable member 31, the amount of the liquid from the ejection outlet side to the bubble collapse position and the amount of the liquid from the common liquid chamber thereinto, correspond to the flow resistances of the portion closer to the ejection outlet than the bubble generation region and the portion closer to the common liquid chamber (flow path resistances and the inertia of the liquid). Therefore, when the flow resistance at the ejection outlet side is small, a large amount of the liquid flows into the bubble collapse position from the ejection outlet side, with the result that meniscus retraction is large. With the reduction of the flow resistance in the ejection outlet for the purpose of increasing the ejection efficiency, the meniscus retraction increases upon the collapse of bubble with the result of longer refilling time period, thus making high speed printing difficult.

According to this example, because of the provision of the movable member 31, the meniscus retraction stops at the time when the movable member returns to the initial position upon the collapse of bubble, and thereafter, the supply of the liquid to fill a volume W2 is accomplished by the flow VD2 through the second flow path 16 (W1 is a volume of an upper side of the bubble volume W beyond the first position of the movable member 31, and W2 is a volume of a bubble generation region 11 side thereof). In the prior art, a half of the volume of the bubble volume W is the volume of the meniscus retraction, but according to this embodiment, only about one half (W1) is the volume of the meniscus retraction.

Additionally, the liquid supply for the volume W2 is forced to be effected mainly from the upstream (VD2) of the second liquid flow path along the surface of the heat generating element side of the movable member 31 using the pressure upon the collapse of bubble, and therefore, more speedy refilling action is accomplished.

When the high speed refilling using the pressure upon the collapse of bubble is carried out in a conventional head, the vibration of the meniscus is expanded with the result of the deterioration of the image quality. However, according to this embodiment, the flows of the liquid in the first liquid flow path 14 at the ejection outlet side and the ejection outlet side of the bubble generation region 11 are suppressed, so that vibration of the meniscus is reduced. Thus, according to this example, the high speed refilling is accomplished by the forced refilling to the bubble generation region through the liquid supply passage 12 of the second flow path 16 and by the suppression of the meniscus retraction and vibration. Therefore, the stabilization of ejection and high speed repeated ejections are accomplished, and when the embodiment is used in the field of recording, the improvement in the image quality and in the recording speed can be accomplished.

The embodiment provides the following effective function, too. It is a suppression of the propagation of the pressure to the upstream side (back wave) produced by the generation of the bubble. The pressure due to the common liquid chamber 13 side (upstream) of the bubble generated on the heat generating element 2 mostly has resulted in force which pushes the liquid back to the upstream side (back wave). The back wave deteriorates the refilling of the liquid into the liquid flow path by the pressure at the upstream side, the resulting motion of the liquid and the inertia force. In this embodiment, these actions to the upstream side are suppressed by the movable member 31, so that refilling performance is further improved.

Additional description will be made as to the structure and effect in this example. With this structure, the supply of the liquid to the surface of the heat generating element 2 and the bubble generation region 11 occurs along the surface of the movable member 31 at the position closer to the bubble generation region 11. With this structure, the supply of the liquid to the surface of the heat generating element 2 and the bubble generation region 11 occurs along the surface of the movable member 31 at the position closer to the bubble generation region 11 as indicated by $V_{D2}$. Accordingly, stagnation of the liquid on the surface of the heat generating element 2 is suppressed, so that precipitation of the gas dissolved in the liquid is suppressed, and the residual bubbles not extinguished are removed without difficulty, and in addition, the heat accumulation in the liquid is not too much. Therefore, more stabilized generation of the bubble can be repeated at high speed. In this embodiment, the liquid supply passage 12 has a substantially flat internal wall, but this is not limiting, and the liquid supply passage is satisfactory if it has an internal wall with such a configuration smoothly extended from the surface of the heat generating element that stagnation of the liquid occurs on the heat generating element, and eddy flow is not significantly caused in the supply of the liquid.

The supply of the liquid into the bubble generation region may occur through a gap at a side portion of the movable member (slit 35) as indicated by $V_{D1}$. In order to direct the pressure upon the bubble generation further effectively to the ejection outlet, a large movable member covering the entirety of the bubble generation region (covering the surface of the heat generating element) may be used, as shown in FIG. 2. Then, the flow resistance for the liquid between the bubble generation region 11 and the region of the first liquid flow path 14 close to the ejection outlet is increased by the restoration of the movable member to the first position, so that flow of the liquid to the bubble generation region 11 can be suppressed. However, according to the head structure of this example, there is a flow effective to supply the liquid to the bubble generation region, the supply performance of the liquid is greatly increased, and therefore, even if the movable member 31 covers the bubble generation region 11 to improve the ejection efficiency, the supply performance of the liquid is not deteriorated.

Figure 8:
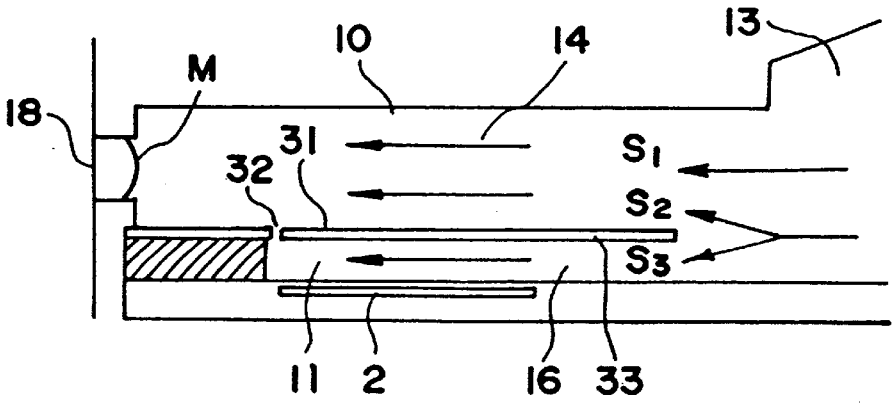
FIG. 8 is a schematic view illustrating flow of liquid in a liquid ejecting head according to the present invention.

The positional relation between the free end 32 and the fulcrum 33 of the movable member 31 is such that free end is at a downstream position of the fulcrum as shown in FIG. 8, for example. With this structure, the function and effect of guiding the pressure propagation direction and the direction of the growth of the bubble to the ejection outlet 18 side or the like can be efficiently assured upon the bubble generation. Additionally, the positional relation is effective to accomplish not only the function or effect relating to the ejection but also the reduction of the flow resistance through the liquid flow path 10 upon the supply of the liquid thus permitting the high speed refilling. When the meniscus M retracted b the ejection as shown in FIG. 8, returns to the ejection outlet 18 by capillary force or when the liquid supply is effected to compensate for the collapse of bubble, the positions of the free end and the fulcrum 33 are such that flows $S_1$, $S_2$ and $S_3$ through the liquid flow path 10 including the first liquid flow path 14 and the second liquid flow path 16, are not impeded.

More particularly, in this embodiment, as described hereinbefore, the free end 32 of the movable member 3 is faced to a downstream position of the center 3 of the area which divides the heat generating element 2 into an upstream region and a downstream region (the line passing through the center (central portion) of the area of the heat generating element and perpendicular to a direction of the length of the liquid flow path). The movable member 31 receives the pressure and the bubble 40 which are greatly contributable to the ejection of the liquid at the downstream side of the area center position 3 of the heat generating element 2, and it guides the force to the ejection outlet side, thus fundamentally improving the ejection efficiency or the ejection force.

Further advantageous effects are provided using the upstream side of the bubble 40, as described hereinbefore.

In the structure of this example, the instantaneous mechanical displacement of the free end of the movable member 31 is considered as contributing to the ejection of the liquid.

Referring to FIGS. 1 and 2, the ejecting method having been described in conjunction with FIGS. 3 and 4, wherein be further described.

In FIG. 1, the abscissa represents time T ($\mu$sec), and the ordinate represents a displacement H ($\mu$m) of the movable member, the bubble volume V ($\mu m^3$), the displacing speed VM of the free end (m/sec) and a growing speed VB (m/sec) of the bubble. On the abscissa, the time is in the unit of 0.1 $\mu$m, and after the generation of the bubble, it is in the unit of 1 $\mu$sec. A part between them is omitted.

In the figure, H1 and H2 indicate the displacement height of the free end into the displacement region, wherein it is zero in the initial state. Hmax indicates the maximum displacement of the free end. V1, V2 indicate a volume of the bubble, and VBmax is the maximum speed, and Y (Ma×V2) is the maximum volume of the bubble. Indicated by C is the boundary between the period in which VB<VM is satisfied and the period in which VB≧VM. Designated by X indicates the point wherein the elastic restoration of the movable member is retarded by the bubble while the bubble volume is increasing (the volume is increasing by the inertia although the growing speed is decreasing). Designated by Z1 is the lowest position of the free end beyond the initial state by HL. Z2 indicates the vibration decreasing period.

The feature of the present invention is represented in this Figure. The factors influential to the displacement of the movable member 31, includes a property of the liquid in the displacement region (viscosity, surface tension), the liquid passage configuration in the region containing the displacement region, the area of the heat generating element (heat generating element), the condition of energy application, the liquid passage configuration including the bubble generating region, the property of the liquid in the bubble generating region, the acoustic wave transmission or reflection properties of the movable member, the mechanical property or the like. Therefore, the designing is complicated. According to the present invention, however, the desirable effects result by providing a period in which VB<VM is satisfied. The following is what occurs in each periods:

(1) after driving of the heat generating element: VB<VM period;

(2) after the driving of the heat generating element: VB=VM timing;

(3) after driving of the heat generating element: VB>VM period;

(4) maximum displacement of the free end of the movable member (Hmax);

(5) maximum speed of the bubble growth VBmax);

(6) maximum volume of the bubble (Y (Ma×V2));

(7) bubble volume decrease period and lowering timing of the free end of the movable member;

(8) movable member vibration conversion period;

(9) bubble collapse completion.

The maximum lowering amount HL (μm) of the free end of the movable member is taken into consideration in the case of the two-liquid separable type head (which will be described hereinafter); and more particularly, the thickness of the free end of the movable member is equivalent to HL (μm), by which the mixing of the two liquids can be avoided.

Thus, by satisfying VM>VB, the displacement of the movable member, the directivity of the growth of the bubble and the ratio of volume increase, can be stabilized, so that ejection efficiency is improved.

FIG. 2 is a graph showing the above-described tendency and the relation in terms of volumes in a M reference where the movable member is at the reference position, and H reference where the heat generating element is at the reference position. As will be understood, the occupied volume BV of the bubble exceeds the occupied volume MV including the bubble generating region by the displacement of the movable member, so that bubble grows toward the ejection outlet beyond the free end of movable member.

Example 2 of Head

Figure 9:
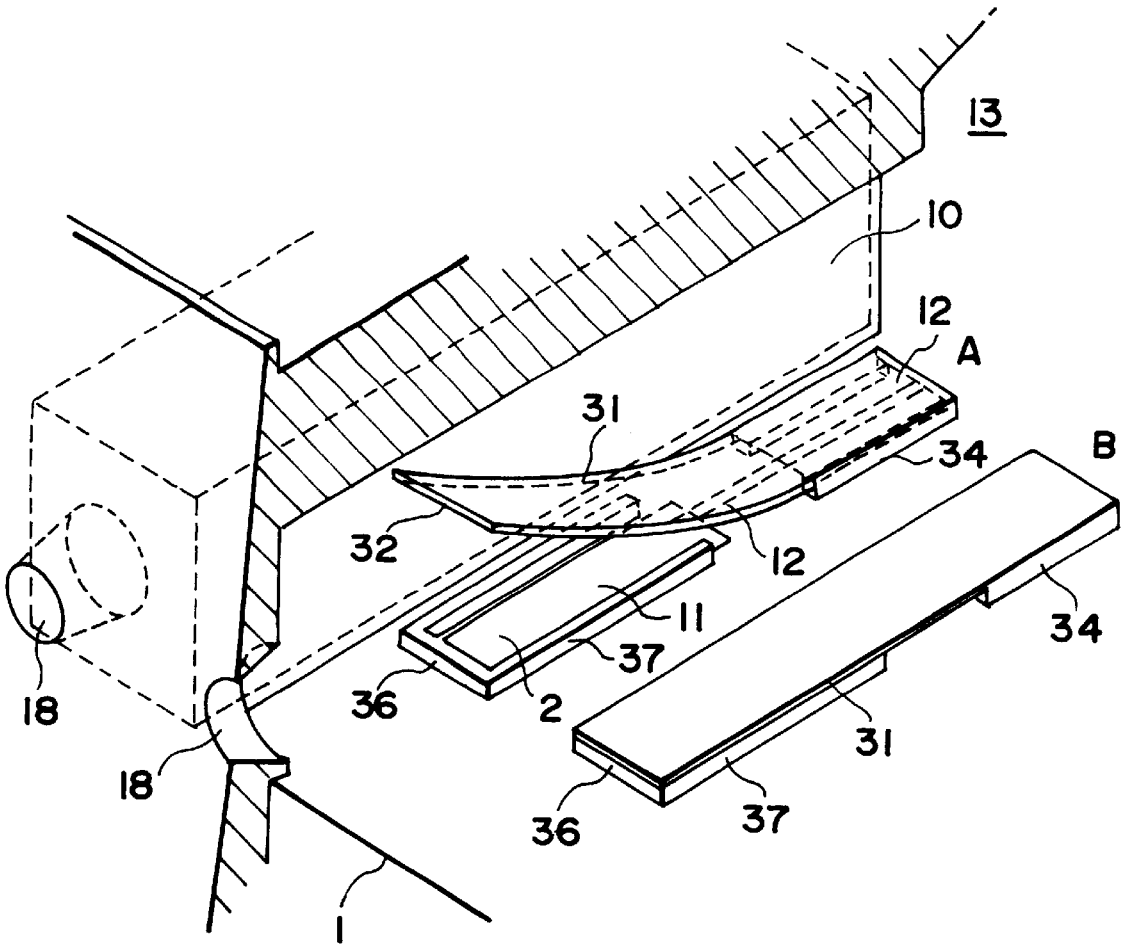
FIG. 9 is a partly broken perspective view of a liquid ejecting head according to the second embodiment.

FIG. 9 shows example 2 of the head according to the present invention. In FIG. 9, shows a state in which the movable member is displaced (bubble is not shown), and B shows a state in which the movable member is in its initial position (first position). In the latter state, the bubble generation region 11 is substantially sealed from the ejection outlet 18 (between A and B, there is a flow passage wall to isolate the paths). A foundation 34 is provided at each side, and between them, a liquid supply passage 12 is constituted. With this structure, the liquid can be supplied along a surface of the movable member faced to the heat generating element side and from the liquid supply passage having a surface substantially flush with the surface of the heat generating element or smoothly continuous therewith.

When the movable member 31 is at the initial position (first position), the movable member 31 is close to or closely contacted to a downstream wall 36 disposed downstream of the heat generating element 2 and heat generating element side walls 37 disposed at the sides of the heat generating element, so that ejection outlet 18 side of the bubble generation region 11 is substantially sealed. Thus, the pressure produced by the bubble at the time of the bubble generation and particularly the pressure downstream of the bubble, can be concentrated on the free end side of the movable member, without releasing the pressure.

At the time of the collapse of bubble, the movable member 31 returns to the first position, the ejection outlet side of the bubble generation region 31 is substantially sealed, and therefore, the meniscus retraction is suppressed, and the liquid supply to the heat generating element is carried out with the advantages described herein before. As regards the refilling, the same advantageous effects can be provided as in the foregoing embodiment.

In this example, the foundation 34 for supporting and fixing the movable member 31 is provided at an upstream position away from the heat generating element 2, as shown in FIG. 5 and FIG. 9, and the foundation 34 has a width smaller than the liquid flow path 10 to supply the liquid to the liquid supply passage 12. The configuration of the foundation 34 is not limited to this structure, but may be anyone if smooth refilling is accomplished.

By selecting the areas of the heat generating element 2 and the movable member 31, heights of the first and second liquid flow paths, the longitudinal elasticity of the movable member 31, and/or the viscosity of the liquid, as described in the foregoing, the bubble generation and the ejection can be-stabilized, and the durability of the height and the ejection efficiency are improved.

Example 3 of Head

Figure 10:
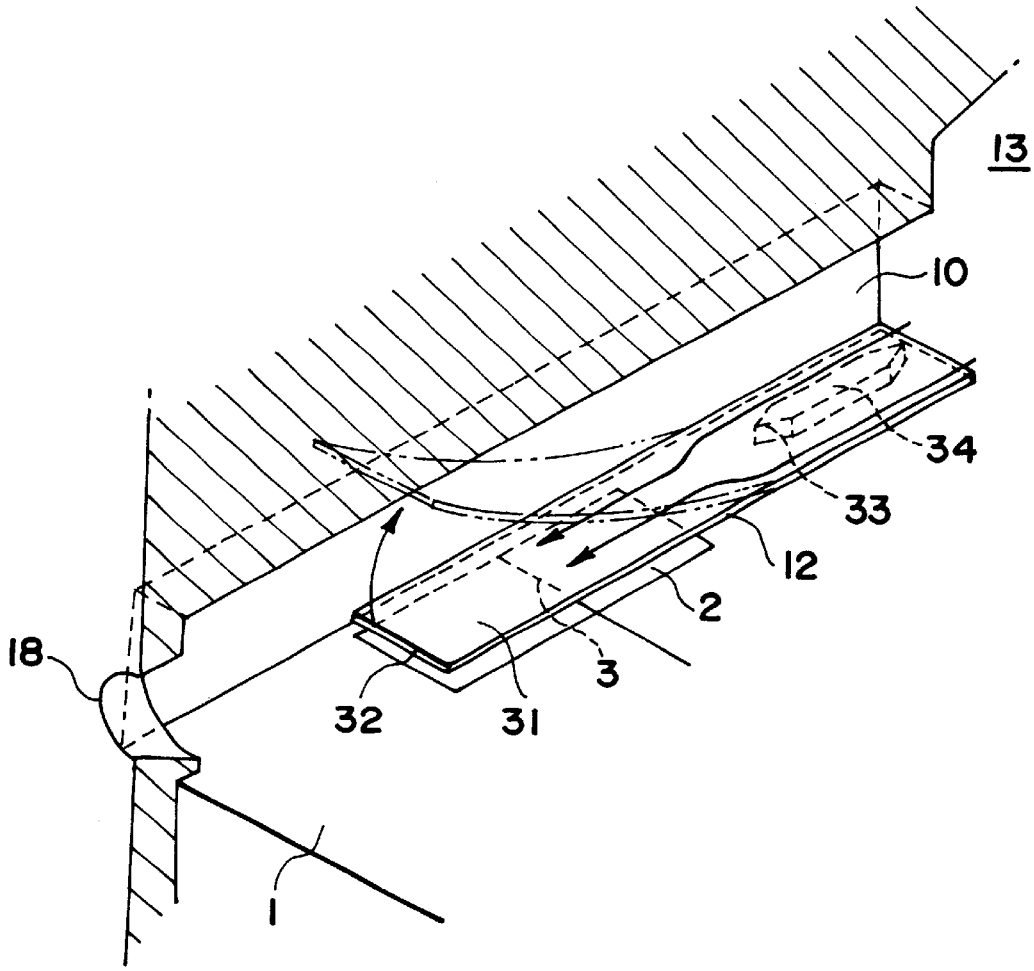
FIG. 10 is a partly broken perspective view of a liquid ejecting head according to a third embodiment of the present invention.

FIG. 10 shows example 3, wherein the positional relation is shown among the bubble generating region in the liquid flow path, the bubble and the movable member 31.

In most of the foregoing examples, the pressure of the bubble generated is concentrated toward the free end of the movable member 31, by which the movement of the bubble is concentrated to the ejection side 18, simultaneously with the quick motion of the movable member 31. In this embodiment, a latitude is given to the generated bubble, and the downstream portion of the bubble (at the ejection outlet 18 side of the bubble) which is directly influential to the droplet ejection, is regulated by the free end side of the movable member 31.

As compared with FIG. 2 (first embodiment), the head of FIG. 10 does not include a projection (hatched portion) as a barrier at a downstream end of the bubble generating region on the element substrate 1 of FIG. 5. In other words, the free end region and the opposite lateral end regions of the movable member 31, is open to the ejection outlet region without substantial sealing of the bubble generating region in this embodiment. Of the downstream portion of the bubble directly contributable to the liquid droplet ejection, the downstream leading end permits the growth of the bubble, and therefore, the pressure component thereof is effectively used for the ejection. In addition, the pressure directed upwardly at least in the downstream portion (component force of VB in FIG. 6) functions such that free end portion of the movable member is added to the bubble growth at the downstream end portion. Therefore, the ejection efficiency is improved, similarly to the foregoing embodiment. As compared with the foregoing examples, the structure of this embodiment is better in the responsivity of the driving of the heat generating element.

In addition, the structure is simple so that manufacturing is easy. The fulcrum portion of the movable member 31 in this example, is fixed to one foundation 34 having a width smaller than the surface portion of the movable member 31. Therefore, the liquid supply to the bubble generation region 11 upon the collapse of bubble occurs along both of the lateral sides of the foundation (indicated by an arrow). The foundation may be in another form if the liquid supply performance is assured.

In the case of this example, the existence of the movable member 31 is effective to control the flow into the bubble generation region from the upper part upon the collapse of bubble, the refilling for the supply of the liquid is better than the conventional bubble generating structure having only the heat generating element. The retraction of the meniscus is also decreased thereby. In a preferable modified embodiment of the example, both of the lateral sides (or only one lateral side) of the movable member 31 are substantially sealed for the bubble generation region 11. With such a structure, the pressure toward the lateral side of the movable member is also directed to the ejection outlet side end portion, so that ejection efficiency is further improved.

In this example, too, the bubble generation and ejection are stabilized, and the ejection efficiency and the durability of the movable member 31 are stabilized, by selecting, in accordance with the foregoing embodiment, the areas of the heat generating element 2 and the movable member 31, the height of the first liquid flow path (the height between the element substrate 1 and the lower surface of the movable member 31), the height of the second liquid flow path (the height between the upper surface of the movable member 31 and the upper wall of the liquid flow path 10) the longitudinal elasticity of the movable member 31, and/or the viscosity of the liquid.

Example 4 of Head

Figure 11:
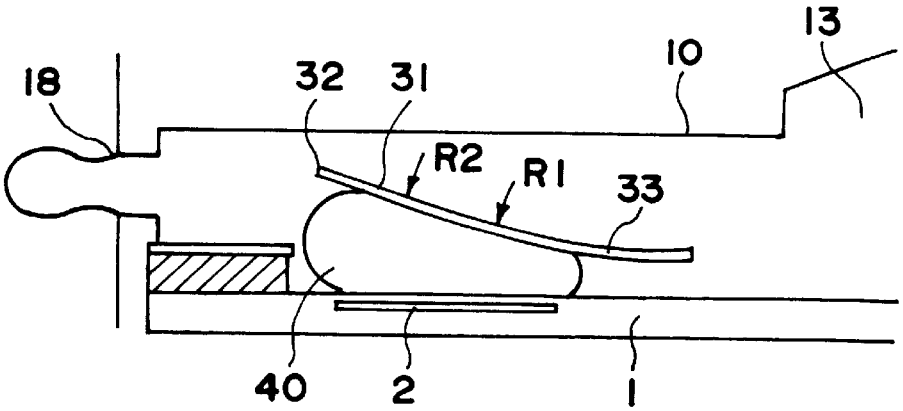
FIG. 11 is a schematic sectional view of a liquid ejecting head according to a fourth embodiment of the present invention.

In this embodiment, the ejection power for the liquid by the mechanical displacement is further enhanced. FIG. 11 is a cross-sectional view of such a head structure. In FIG. 11, the movable member is extended such that position of the free end of the movable member 31 is positioned further downstream of the ejection outlet side end of the heat generating element. By this, the displacing speed of the movable member at the free end position can be increased, and therefore, the production of the ejection power by the displacement of the movable member is further improved.

In addition, the free end 32 is closer to the ejection outlet side than in the foregoing example, and therefore, the growth of the bubble can be concentrated toward the stabilized direction, thus assuring the better ejection.

The movable member 31 returns from the second position (max displacement) by its resiliency at a returning speed R1, wherein the free end 32 which is remote from the fulcrum 33 returns at a higher speed R2. By this, the high speed free end 32 mechanically acts on the bubble 40 during or after the growth of the bubble 40 to cause downstream motion (toward the ejection outlet) in the liquid downstream of the bubble 40, thus improving the direction of ejection and the ejection efficiency.

Figure 16:
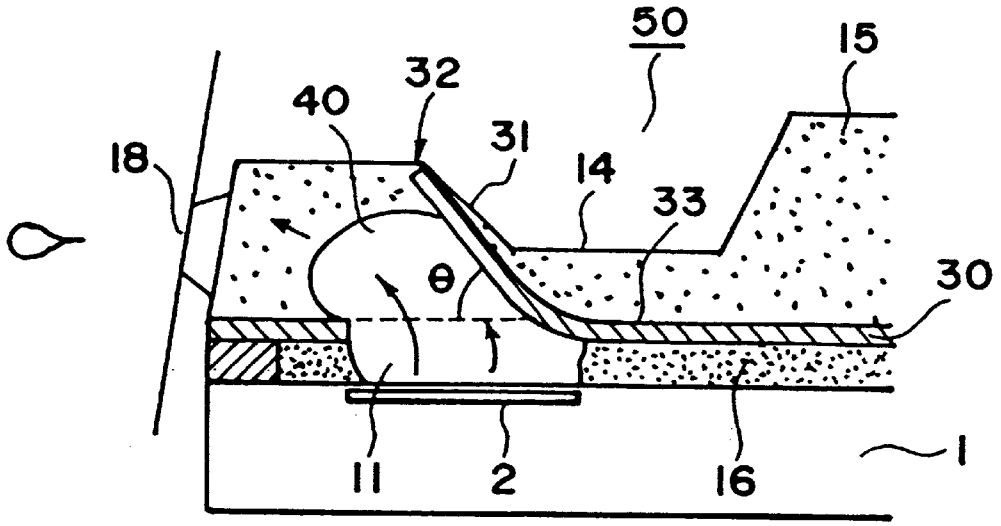
FIG. 16 is a sectional view illustrating a first liquid flow path and a ceiling configuration according to a further embodiment of the present invention.

The free end configuration is such that, as is the same as in FIG. 16, the edge is vertical to the liquid flow, by which the pressure of the bubble and the mechanical function of the movable member are more efficiently contributable to the ejection.

In this example, too, the bubble generation and ejection are stabilized, and the ejection efficiency and the durability of the movable member 31 are stabilized, by selecting, in accordance with the foregoing embodiment, the areas of the heat generating element 2 and the movable member 31, the height of the first liquid flow path, the height of the second liquid flow path, the longitudinal elasticity of the movable member 31, and/or the viscosity of the liquid.

Example 5 of Head

Figure 12A:
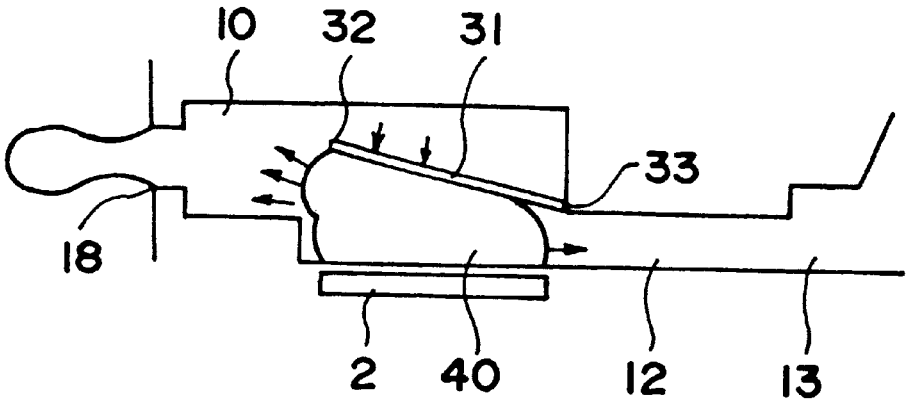
FIGS. 12, (a) to (c) are schematic sectional views of a liquid ejecting head according to a fifth embodiment of the present invention.
Figure 12B:
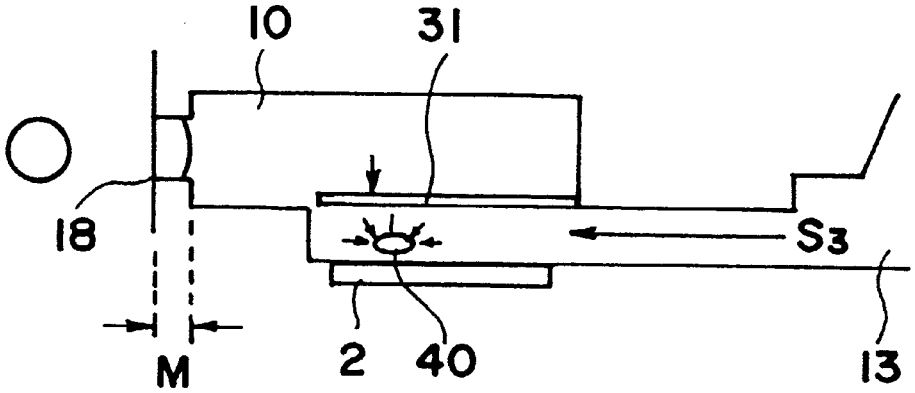
Figure 12C:
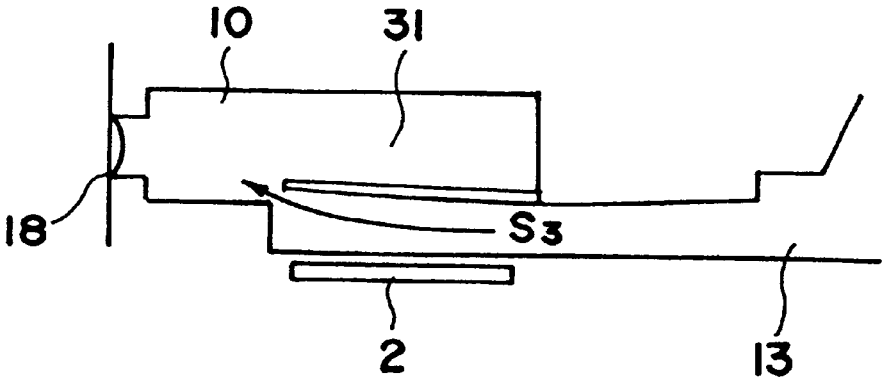

FIGS. 12, (a), (b), (c) shows Example 5. As is different from the foregoing embodiment, the region in direct communication with the ejection outlet is not in communication with the liquid chamber side, by which the structure is simplified.

The liquid is supplied only from the liquid supply passage 12 along the surface of the bubble generation region side of the movable member 31. The free end 32 of the movable member 31, the positional relation of the fulcrum 33 relative to the ejection outlet 18 and the structure of facing to the heat generating element 2 are similar to the above-described embodiment. According to this embodiment, the advantageous effects in the ejection efficiency, the liquid supply performance and so on described above, are accomplished. Particularly, the retraction of the meniscus is suppressed, and a forced refilling is effected substantially thoroughly using the pressure upon the collapse of bubble. FIG. 12, (a) shows a state in which the bubble generation is caused by the heat generating element 2, and FIG. 10, (b) shows the state in which the bubble is going to contract. At this time, the returning of the movable member 31 to the initial position and the liquid supply by $S_3$ are effected. In FIG. 12, (c), the small retraction M of the meniscus upon the returning to the initial position of the movable member, is being compensated for by the refilling by the capillary force in the neighborhood of the ejection outlet 18.

In this example, too, the bubble generation and ejection are stabilized, and the ejection efficiency and the durability of the movable member 31 are stabilized, by selecting, in accordance with the foregoing embodiment, the areas of the heat generating element 2 and the movable member 31, the height of the first liquid flow path, the height of the second liquid flow path, the longitudinal elasticity of the movable member 31, and/or the viscosity of the liquid.

Example 6 of Head

Figure 13:
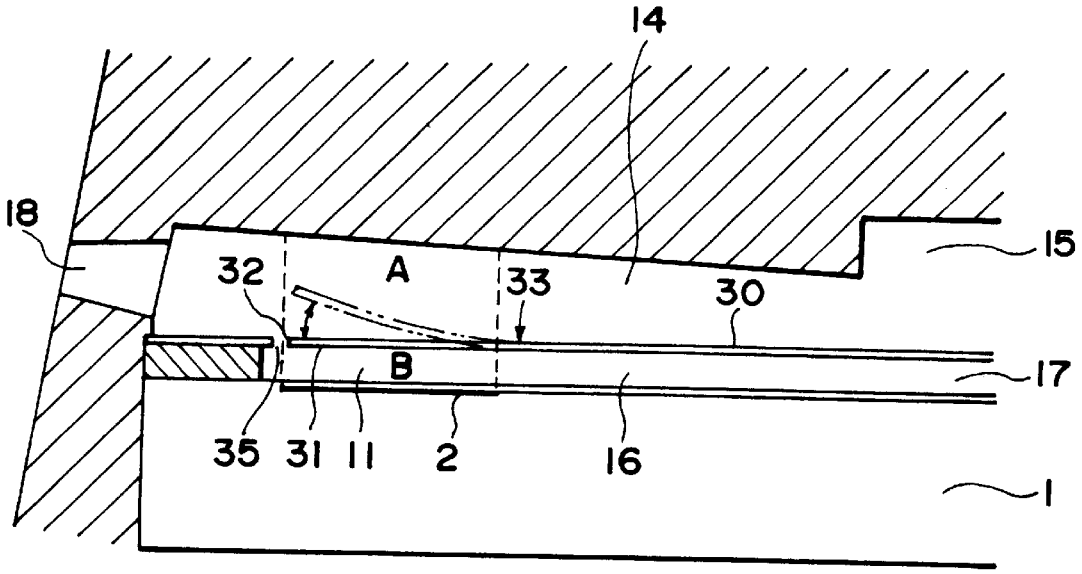
FIG. 13 is a sectional view of a liquid ejecting head (two-path) according to a sixth embodiment of the present invention.
Figure 14:
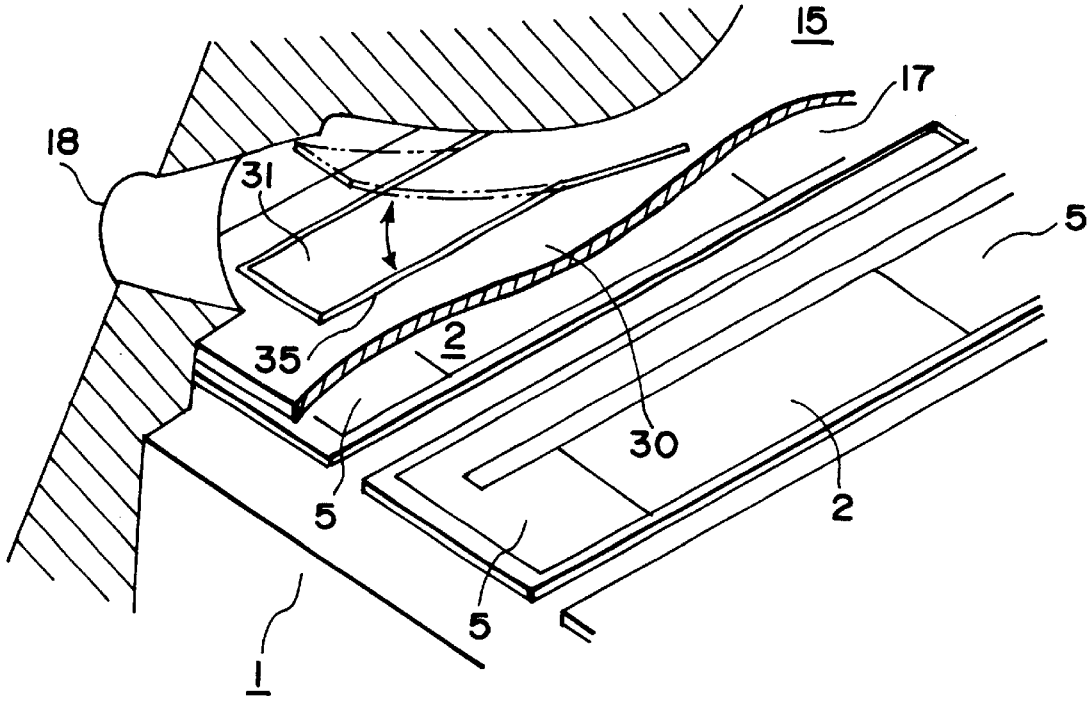
FIG. 14 is a partly broken perspective view of a liquid ejecting head according to a sixth embodiment of the present invention.
Figure 15A:
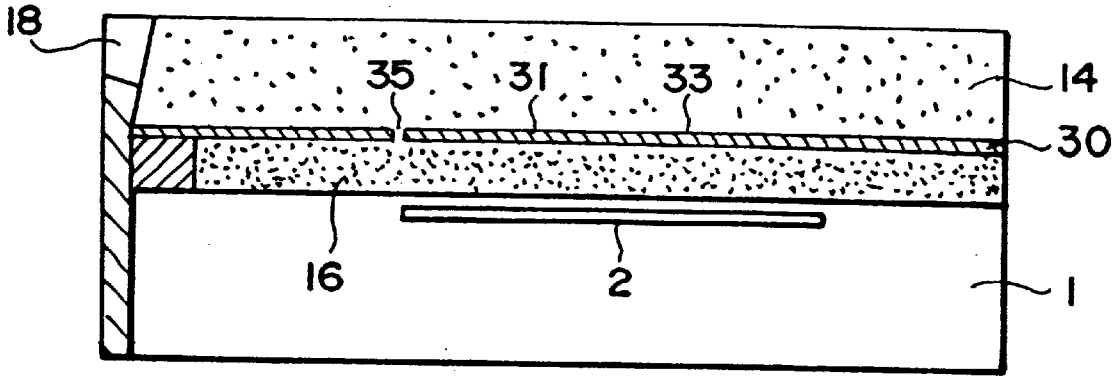
FIGS. 15, (a) and (b) is an illustration of operation in the sixth embodiment.
Figure 15B:
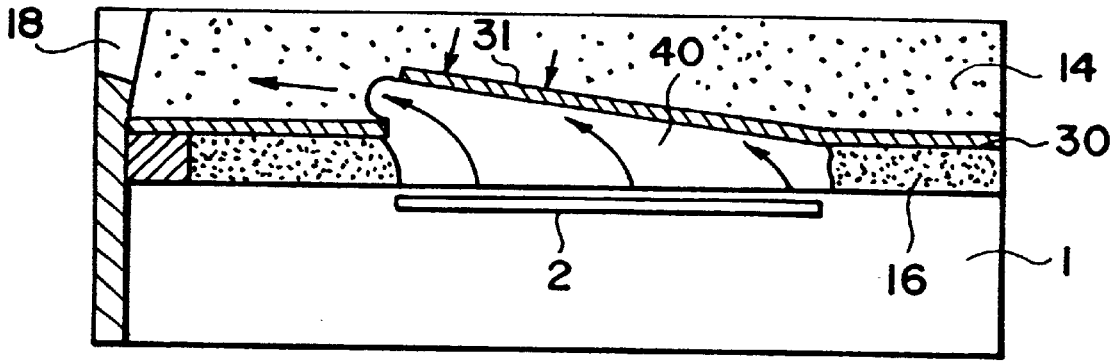

Referring to FIG. 13 to FIG. 15, the description will be made as to Example 6.

In this example, the same ejection principle is used, and the liquid wherein the bubble generation is carried out (bubble generation liquid), and the liquid which is mainly ejected (ejection liquid) are separated.

FIG. 13 is a schematic sectional view, in a direction of flow of the liquid, of the liquid ejecting head according to this embodiment. In the liquid ejecting head, there is provided a second liquid flow path 16 for the bubble generation liquid on an element substrate 1 provided with a heat generating element 2 for applying thermal energy for generating the bubble in the liquid, and there is further provided, on the second liquid flow path 16, a first liquid flow path 14 for the ejection liquid, in direct communication with the ejection outlet 18. The upstream side of the first liquid flow path is in fluid communication with a first common liquid chamber 15 for supplying the ejection liquid into a plurality of first liquid flow paths, and the upstream side of the second liquid flow path is in fluid communication with the second common liquid chamber for supplying the bubble generation liquid to a plurality of second liquid flow paths. The upstream of the first liquid flow path 14 is in fluid communication with a first common liquid chamber 15 for supplying the ejection liquid to the plurality of first liquid flow paths, and the upstream of the second liquid flow path 16 is in fluid communication with the second common liquid chamber 17 for supplying the bubble generation liquid to a plurality of second liquid flow paths. In the case that bubble generation liquid and ejection liquid are the same liquids, the number of the common liquid chambers may be one.

Between the first and second liquid flow paths, there is a separation wall 30 of an elastic material such as metal so that first flow path 14 and the second flow path 16 are separated. In the case that mixing of the bubble generation liquid and the ejection liquid should be minimum, the first liquid flow path 14 and the second liquid flow path 16 are preferably isolated by the partition wall 30. However, when the mixing to a certain extent is permissible, the complete isolation is not inevitable.

When the viscosity of the liquid may be the same as with Embodiment 1 when there is no need of separating the bubble generation liquid and the ejection liquid from the standpoint of the stabilized ejection. When the bubble generation liquid and the ejection liquid are separated, the bubble generation liquid has the viscosity of 1 to 100 cP, preferably 1 to 10 cP to provide the stabilized ejection. The ejection liquid has a viscosity of 1–1000 cP, and preferably 1 to 100 cP from the standpoint of stabilized ejection.

The movable member 31 is in the form of a cantilever wherein such a portion of separation wall as is in an upward projected space of the surface of the heat generating element (ejection pressure generating region, region A and bubble generating region 11 of the region B in FIG. 15) constitutes a free end by the provision of the slit 35 at the ejection outlet side (downstream with respect to the flow of the liquid), and the common liquid chamber (15, 17) side thereof is a fulcrum or fixed portion 33. This movable member 31 is located faced to the bubble generating region 11 (B), and therefore, it functions to open toward the ejection outlet side of the first liquid flow path upon bubble generation of the bubble generation liquid (in the direction indicated by the arrow, in the Figure). In the example of FIG. 14, too, a partition wall 30 is disposed, with a space for constituting a second liquid flow path, above an element substrate 1 provided with a heat generating resistor portion as the heat generating element 2 and wiring electrodes 5 for applying an electric signal to the heat generating resistor portion.

As for the positional relation among the fulcrum 33 and the free end 32 of the movable member 31 and the heat generating element 2, are the same as in the previous example.

In the previous example, the description has been made as to the relation between the structures of the liquid supply passage 12 and the heat generating element 2. The relation between the second liquid flow path 16 and the heat generating element 2 is the same in this embodiment.

Referring to FIG. 15, the operation of the liquid ejecting head of this embodiment will be described. The used ejection liquid in the first liquid flow path 14 and the used bubble generation liquid in the second liquid flow path 16 were the same water base inks.

By the heat generated by the heat generating element 2, the bubble generation liquid in the bubble generation region in the second liquid flow path generates a bubble 40, by film boiling phenomenon as described hereinbefore.

In this embodiment, the bubble generation pressure is not released in the three directions except for the upstream side in the bubble generation region, so that pressure produced by the bubble generation is propagated concentratedly on the movable member 6 side in the ejection pressure generation portion, by which the movable member 6 is displaced from the position indicated in FIG. 15, (a) toward the first liquid flow path side as indicated in FIG. 15, (b) with the growth of the bubble. The displaced movable member 31 returns to toward the second liquid flow path 16, as shown in FIG. 15, (b) by the elastic force thereof. By such sequences of motions of the movable member 31, the first and second liquid flow paths 16 are brought into wide communication, and the pressure on the basis of the generation of the bubble is propagated mainly toward the ejection outlet 18 of the first liquid flow path 14 with the control of the returning displacement of the movable member 31. By the propagation of the pressure and the mechanical displacement of the movable member 31, the liquid is ejected through the ejection outlet. Then, with the contraction of the bubble, the movable member 31 returns to the position indicated in FIG. 12, (a), and correspondingly, an amount of the liquid corresponding to the ejection liquid is supplied from the upstream in the first liquid flow path 14. In this embodiment, the direction of the liquid supply is codirectional with the closing of the movable member 31 as in the foregoing embodiments, the refilling of the liquid is not impeded by the movable member 31.

The major functions and effects as regards the propagation of the bubble generation pressure with the displacement of the movable member 31, the direction of the bubble growth, the prevention of the back wave and so on, in this embodiment, are the same as with the first embodiment, but the two-flow-path structure is advantageous in the following points.

The ejection liquid and the bubble generation liquid may be separated, and the ejection liquid is ejected by the pressure produced in the bubble generation liquid. Accordingly, a high viscosity liquid such as polyethylene glycol or the like with which bubble generation and therefore ejection force is not sufficient by heat application, and which has not been ejected in good order, can be ejected. For example, this liquid is supplied into the first liquid flow path, and liquid with which the bubble generation is in good order is supplied into the second path 16 as the bubble generation liquid. An example of the bubble generation liquid a mixture liquid (1–2 cP approx.) of ethanol and water (4:6). By doing so, the ejection liquid can be properly ejected.

Additionally, by selecting as the bubble generation liquid a liquid with which the deposition such as burnt deposit does not remain on the surface of the heat generating element even upon the heat application, the bubble generation is stabilized to assure the proper ejections. Furthermore, according to the head structure of this invention, the advantageous effects described above are provided so that high viscous liquid can be ejected with high ejection efficiency and high ejection power.

Furthermore, liquid which is not durable against heat is ejectable. In this case, such a liquid is supplied in the first liquid flow path 14 as the ejection liquid, and a liquid which is not easily altered in the property by the heat and with which the bubble generation is in good order, is supplied in the second liquid flow path 16. By doing so, the liquid can be ejected without thermal damage and with high ejection efficiency and with high ejection pressure.

In this example, too, the bubble generation and ejection are stabilized, and the ejection efficiency and the durability of the movable member 31 are stabilized, by selecting, in accordance with the foregoing embodiment, the areas of the heat generating element 2 and the movable member 31, the height of the first liquid flow path, the height of the second liquid flow path, the longitudinal elasticity of the movable member 31, and/or the viscosity of the liquid.

Liquid ejection was carried out using a head having a structure shown in the figures.

Other Embodiments

In the foregoing, the description has been made as to the major parts of the liquid ejecting head and the liquid ejecting method according to the embodiments of the present invention. The description will now be made as to further detailed embodiments usable with the foregoing embodiments. The following examples are usable with both of the single-flow-path type and two-flow-path type without specific statement.

<Liquid Flow Path Ceiling Configuration>

FIG. 16 is a sectional view taken along the length of the flow path of the liquid ejecting head according to the embodiment. Grooves for constituting the first liquid flow paths 14 (or liquid flow paths 10 in FIG. 2) are formed in grooved member 50 on a partition wall 30. In this embodiment, the height of the flow path ceiling adjacent the free end 32 position of the movable member is greater to permit larger operation angle θ of the movable member. The operation range of the movable member is determined in consideration of the structure of the liquid flow path, the durability of the movable member and the bubble generation power or the like. It is desirable that it moves in the angle range wide enough to include the angle of the position of the ejection outlet. By making the displacement height of the free end of the movable member larger than the diameter of the ejection outlet, as shown in the Figure, the ejection powers sufficiently transmitted. As shown in this Figure, a height of the liquid flow path ceiling at the fulcrum 33 position of the movable member is lower than that of the liquid flow path ceiling at the free end 32 position of the movable member, so that release of the pressure wave to the upstream side due to the displacement of the movable member can be further effectively prevented.

<Positional Relation Between Second Liquid Flow Path and Movable Member>

Figure 17A:
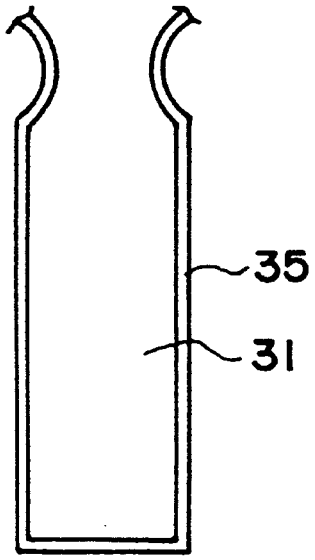
FIGS. 17, (a) to (c) is an illustration of a structure of a movable member and a liquid flow path.
Figure 17B:
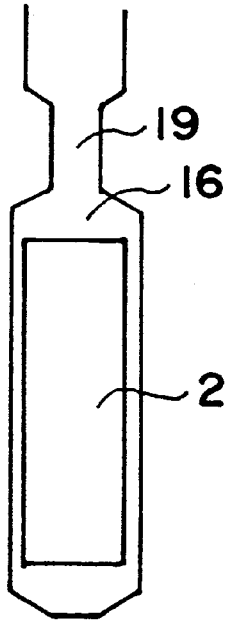
Figure 17C:
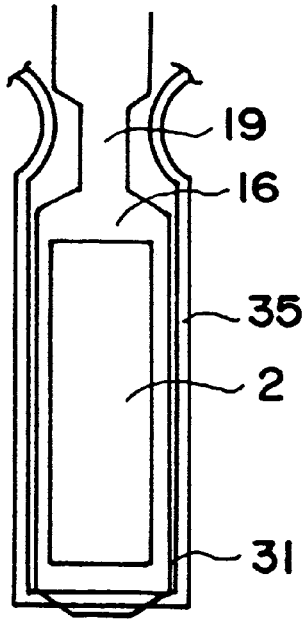

FIG. 17 is an illustration of a positional relation between the above-described movable member 31 and second liquid flow path 16, and (a) is a view of the movable member 31 position of the partition wall 30 as seen from the above, and (b) is a view of the second liquid flow path 16 seen from the above without partition wall 30. FIG. 16, (c) is a schematic view of the positional relation between the movable member 6 and the second liquid flow path 16 wherein the elements are overlaid. In these Figures, the bottom is a front side having the ejection outlets.

The second liquid flow path 16 of this embodiment has a throat portion 19 upstream of the heat generating element 2 with respect to a general flow of the liquid from the second common liquid chamber side to the ejection outlet through the heat generating element position, the movable member position along the first flow path, so as to provide a chamber (bubble generation chamber) effective to suppress easy release, toward the upstream side, of the pressure produced upon the bubble generation in the second liquid flow path 16.

In the case of the conventional head wherein the flow path where the bubble generation occurs and the flow path from which the liquid is ejected, are the same, a throat portion may be provided to prevent the release of the pressure generated by the heat generating element toward the liquid chamber. In such a case, the cross-sectional area of the throat portion should not be too small in consideration of the sufficient refilling of the liquid.

However, in the case of this embodiment, much or most of the ejected liquid is from the first liquid flow path, and the bubble generation liquid in the second liquid flow path having the heat generating element is not consumed much, so that filling amount of the bubble generation liquid to the bubble generation region 11 may be small. Therefore, the clearance at the throat portion 19 can be made very small, for example, as small as several μm–ten and several μm, so that release of the pressure produced in the second liquid flow path can be further suppressed and to further concentrate it to the movable member side. The pressure can be used as the ejection pressure through the movable member 31, and therefore, the high ejection energy use efficiency and ejection pressure can be accomplished. The configuration of the second liquid flow path 16 is not limited to the one described above, but may be any if the pressure produced by the bubble generation is effectively transmitted to the movable member side.

As shown in FIG. 16, (c), the lateral sides of the movable member 31 cover respective parts of the walls constituting the second liquid flow path so that falling of the movable member 31 into the second liquid flow path is prevented. By this, the falling of the movable member 31 into the second liquid flow path 16 can be avoided. By doing so, the above-described separation between the ejection liquid and the bubble generation liquid is further enhanced. Furthermore, the release of the bubble through the slit can be suppressed so that ejection pressure and ejection efficiency are further increased. Moreover, the above-described effect of the refilling from the upstream side by the pressure upon the collapse of bubble, can be further enhanced. With the feature of the present invention that displacement start of the free end of the movable member occurs before the contact of the bubble to the movable member, the elasticity, ejection liquid, transmission property of the pressure of the bubble generation liquid, driving condition for the bubble formation, each liquid passage structure or the like and the balance among them; it is preferable that elastic deformation is easy, that transmission of the pressure is easy, that growing speed is high, that flow path resistance against the motion of the movable member is small. In such a case, the pressure wave upon the bubble generation is directed to the ejection outlet side, and therefore, the subsequent growth of the bubble is directed to the ejection outlet side so that bubble is assuredly and efficiently guided.

<Movable Member and the Separation Wall>

Figure 18:
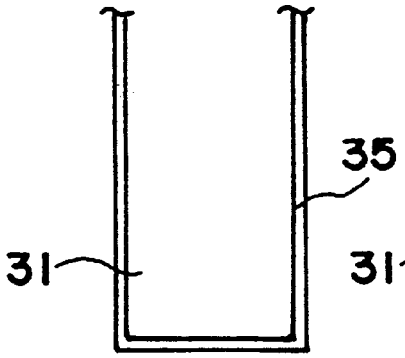
FIGS. 18, (a) to (c) illustrates another configuration of a movable member.
Figure 18B:
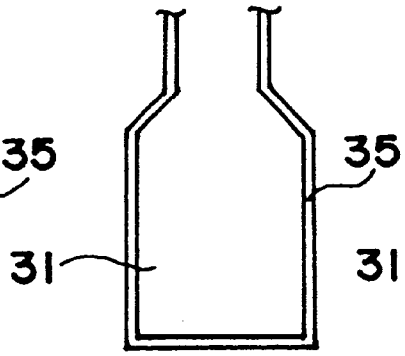
Figure 18C:
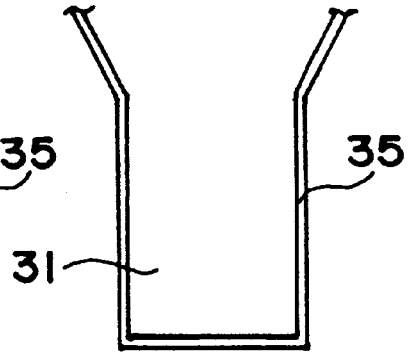
Figure 19:
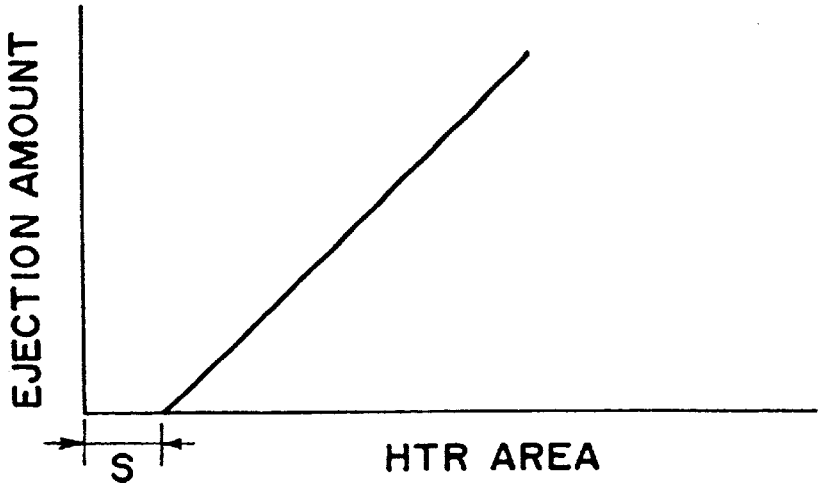
FIG. 19 is a graph shown a relation between a heat generating element area and an ink ejection amount.

FIG. 18 shows another example of the movable member 31, wherein reference numeral 35 designates a slit formed in the partition wall, and the slit is effective to provide the movable member 31. In FIG. 17, (a), the movable member has a rectangular configuration, and in (b), it is narrower in the fulcrum side to permit increased mobility of the movable member, and in (c), it has a wider fulcrum side to enhance the durability of the movable member. The configuration narrowed and arcuated at the fulcrum side is desirable as shown in FIG. 17, (a), since both of easiness of motion and durability are satisfied. However, the configuration of the movable member is not limited to the one described above, but it may be any if it does not enter the second liquid flow path side, and motion is easy with high durability. In the foregoing examples, the plate or film movable member 31 and the separation wall 5 having this movable member was made of a nickel having a thickness of 5 μm, but this is not limited to this example, but it may be any if it has anti-solvent property against the bubble generation liquid and the ejection liquid, and if the elasticity is enough to permit the operation of the movable member, and if the required fine slit can be formed.

Preferable examples of the materials for the movable member include durable materials such as metal such as silver, nickel, gold, iron, titanium, aluminum, platinum, tantalum, stainless steel, phosphor bronze or the like, alloy thereof, or resin material having nitrile group such as acrylonitrile, butadiene, stylene or the like, resin material having amide group such as polyamide or the like, resin material having carboxyl such as polycarbonate or the like, resin material having aldehyde group such as polyacetal or the like, resin material having sulfon group such as polysulfone, resin material such as liquid crystal polymer or the like, or chemical compound thereof; or materials having durability against the ink, such as metal such as gold, tungsten, tantalum, nickel, stainless steel, titanium, alloy thereof, materials coated with such metal, resin material having amide group such as polyamide, resin material having aldehyde group such as polyacetal, resin material having ketone group such as polyetheretherketone, resin material having imide group such as polyimide, resin material having hydroxyl group such as phenolic resin, resin material having ethyl group such as polyethylene, resin material having alkyl group such as polypropylene, resin material having epoxy group such as epoxy resin material, resin material having amino group such as melamine resin material, resin material having methylol group such as xylene resin material, chemical compound thereof, ceramic material such as silicon dioxide or chemical compound thereof. Preferable examples of partition or division wall include resin material having high heat-resistive, high anti-solvent property and high molding property, more particularly recent engineering plastic resin materials such as polyethylene, polypropylene, polyamide, polyethylene terephthalate, melamine resin material, phenolic resin, epoxy resin material, polybutadiene, polyurethane, polyetheretherketone, polyether sulfone, polyallylate, polyimide, polysulfone, liquid crystal polymer (LCP), or chemical compound thereof, or metal such as silicon dioxide, silicon nitride, nickel, gold, stainless steel, alloy thereof, chemical compound thereof, or materials coated with titanium or gold.

The thickness of the separation wall is determined depending on the used material and configuration from the standpoint of sufficient strength as the wall and sufficient operativity as the movable member, and generally, 0.5 $\mu$m–10 $\mu$m approx. is desirable.

The width of the slit 35 for providing the movable member 31 is 2 $\mu$m in the embodiments. When the bubble generation liquid and ejection liquid are different materials, and mixture of the liquids is to be avoided, the gap is determined so as to form a meniscus between the liquids, thus avoiding mixture therebetween. For example, when the bubble generation liquid has a viscosity about 2 cP, and the ejection liquid has a viscosity not less than 100 cP, 5 $\mu$m approx. Slit is enough to avoid the liquid mixture, but not more than 3 $\mu$m is desirable.

In this example, the movable member has a thickness of $\mu$m order as preferable thickness, and a movable member having a thickness of cm order is not used in usual cases. When a slit is formed in the movable member having a thickness of $\mu$m order, and the slit has the width (W $\mu$m) of the order of the thickness of the movable member, it is desirable to consider the variations in the manufacturing.

When the thickness of the member opposed to the free end and/or lateral edge of the movable member formed by a slit, is equivalent to the thickness of the movable member (FIGS. 13, 14 or the like), the relation between the slit width and the thickness is preferably as follows in consideration of the variation in the manufacturing to stably suppress the liquid mixture between the bubble generation liquid and the ejection liquid. When the bubble generation liquid has a viscosity not more than 3 cp, and a high viscous ink (5 cp, 10 cp or the like) is used as the ejection liquid, the mixture of the 2 liquids can be suppressed for a long term if $W/t \leqq 1$ is satisfied.

The slit providing the "substantial sealing", preferably has several microns width, since the liquid mixture prevention is assured.

When the separated bubble generation liquid and ejection liquid are used as has been described hereinbefore, the movable member functions in effect as the separation member. When the movable member moves in accordance with generation of the bubble, a small amount of the bubble generation liquid may be mixed into the ejection liquid. Usually, the ejection liquid for forming an image in the case of the ink jet recording, contains 3% to 5% approx. of the coloring material, and therefore, if content of the leaked bubble generation liquid in the ejection liquid is not more than 20%, no significant density change results. Therefore, the present invention covers the case where the mixture ratio of the bubble generation liquid of not more than 20%.

In the foregoing embodiment, the mixing of the bubble generation liquid is at most 15%, even if the viscosity thereof is changed, and in the case of the bubble generation liquid having the viscosity not more than 5 cP, the mixing ratio was at most 10% approx., although it is different depending on the driving frequency.

The ratio of the mixed liquid can be reduced by reducing the viscosity of the ejection liquid in the range below 20 cps (for example not more than 5%).

The description will be made as to positional relation between the heat generating element and the movable member in this head. The configuration, dimension and number of the movable member and the heat generating element are not limited to the following example. By an optimum arrangement of the heat generating element and the movable member, the pressure upon bubble generation by the heat generating element, can be effectively used as the ejection pressure.

In a conventional bubble jet recording method, energy such as heat is applied to the ink to generate instantaneous volume change (generation of bubble) in the ink, so that ink is ejected through an ejection outlet onto a recording material to effect printing. In this case, the area of the heat generating element and the ink ejection amount are proportional to each other. However, there is a non-bubble-generation region S not contributable to the ink ejection. This fact is confirmed from observation of burnt deposit on the heat generating element, that is, the non-bubble-generation area S extends in the marginal area of the heat generating element. It is understood that marginal approx. 4 $\mu$m width is not contributable to the bubble generation. In order to effectively use the bubble generation pressure, it is preferable that movable range of the movable member covers the effective bubble generating region of the heat generating element, namely, the inside area beyond the marginal approx. 4 $\mu$m width. In this example, the effective bubble generating region is approx. 4 $\mu$m and inside thereof, but this is different if the heat generating element and forming method is different.

Figure 20A:
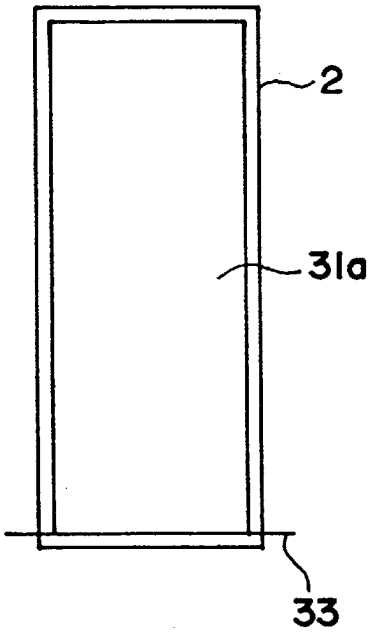
FIGS. 20, (a) and (b) shows a positional relation between a movable member and a heat generating element.
Figure 20B:
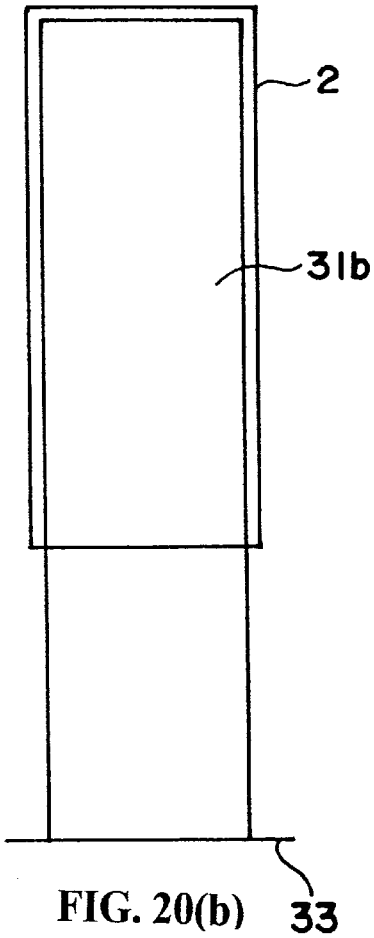

FIG. 20 is a schematic view as seen from the top and showing a positional relation ship between the movable member and the heat generating element, wherein the use is made with a heat generating element 2 of 58×150 $\mu$m, and with a movable member 301, (a) in the Figure, and a movable member 302, (b), in the Figure which have different total area.

The dimension of the movable member 301 is 53×145 $\mu$m, and is smaller than the area of the heat generating element 2, but it has an area equivalent to the effective bubble generating region of the heat generating element 2, and the movable member 301 is disposed to cover the effective bubble generating region. On the other hand, the dimension of the movable member 302 is 53×220 μm, and is larger than the area of the heat generating element 2 (the width dimension is the same, but the dimension between the fulcrum and movable leading edge is longer than the length of the heat generating element), similarly to the movable member 301. It is disposed to cover the effective bubble generating region. The tests have been carried out with the two movable members 301 and 302 to check the durability and the ejection efficiency. The conditions were as follows:
Bubble generation liquid: aqueous solution of ethanol (40%)
Ejection ink: dye ink
Voltage: 20.2 V
Frequency: 3 kHz The results of the experiments show that movable member 301 was damaged at the fulcrum when $1\times10^7$ pulses were applied. (b) The movable member 302 was not damaged even after $3\times10^8$ pulses were applied. Additionally, the ejection amount relative to the supplied energy and the kinetic energy determined by the ejection speed, are improved by approx. 1.5–2.5 times. From the results, it is understood that movable member having an area larger than that of the heat generating element and disposed to cover the portion right above the effective bubble generating region of the heat generating element, is preferable from the standpoint of durability and ejection efficiency.

Figure 21:
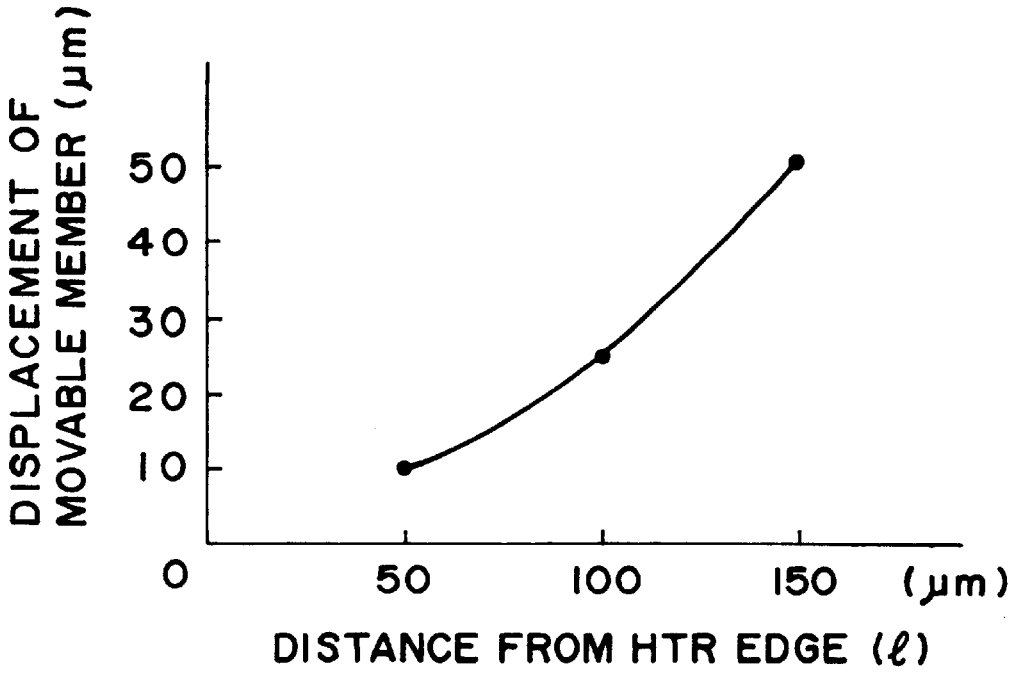
FIG. 21 is a graph showing a relation between a distance between an edge of a heat generating element and a fulcrum and a displacement of the movable member.
Figure 22:
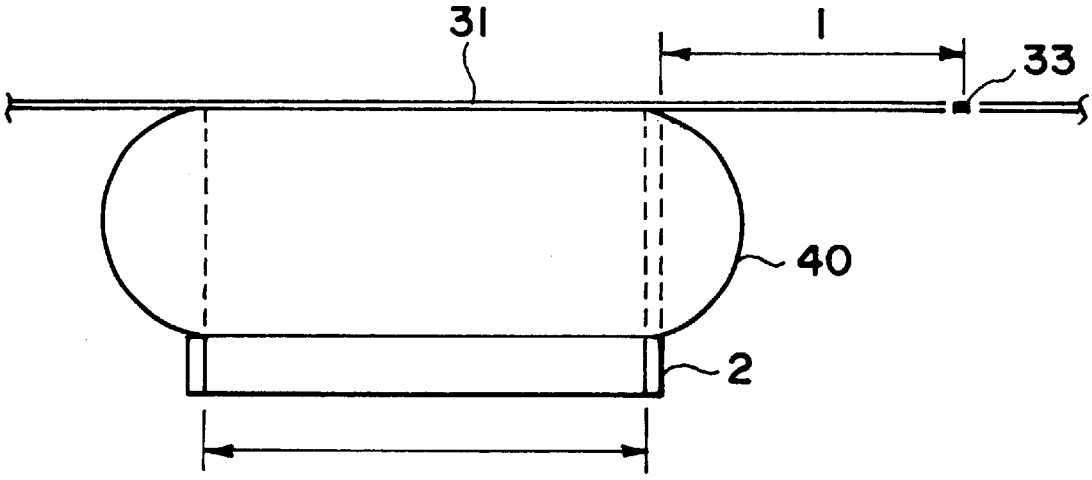
FIG. 22 illustrates a positional relation between a heat generating element and a movable member.

FIG. 21 shows a relation between a distance between the edge of the heat generating element and the fulcrum of the movable member and the displacement of the movable member. FIG. 22 is a section view, as seen from the side, which shows a positional relation between the heat generating element 2 and the movable member 31. The heat generating element 2 has a dimension of 40×105 μm. It will be understood that displacement increases with increase with the distance 1 from the edge of the heat generating element 2 and the fulcrum 33 of the movable member 31. Therefore, it is desirable to determinate the position of the fulcrum of the movable member on the basis of the optimum displacement depending on the required ejection amount of the ink, flow passage structure, heat generating element configuration and so on.

When the fulcrum of the movable member is right above the effective bubble generating region of the heat generating element, the bubble generation pressure is directly applied to the fulcrum in addition to the stress due to the displacement of the movable member, and therefore, the durability of the movable member lowers. The experiments by the inventors have revealed that when the fulcrum is provided right above the effective bubble generating region, the movable wall is damaged after application of $1\times10^6$ pulses, that is, the durability is lower. Therefore, by disposing the fulcrum of the movable member outside the right above position of the effective bubble generating region of the heat generating element, a movable member of a configuration and/or a material not providing very high durability, can be practically usable. On the other hand, even if the fulcrum is right above the effective bubble generating region, it is practically usable if the configuration and/or the material is properly selected. By doing so, a liquid ejecting head with the high ejection energy use efficiency and the high durability can be provided.

<Element Substrate>

The description will be made as to a structure of the element substrate provided with the heat generating element for heating the liquid.

Figure 23A:
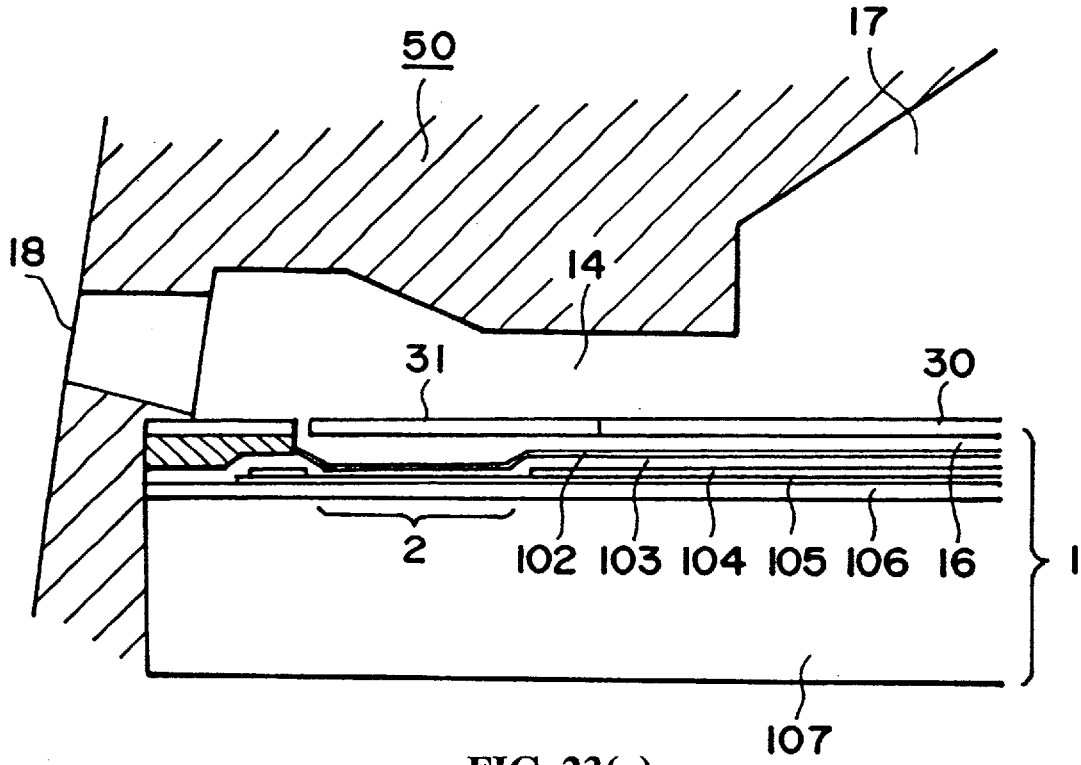
FIGS. 23, (a) and (b) is a longitudinal sectional view of a liquid ejecting head.
Figure 23B:
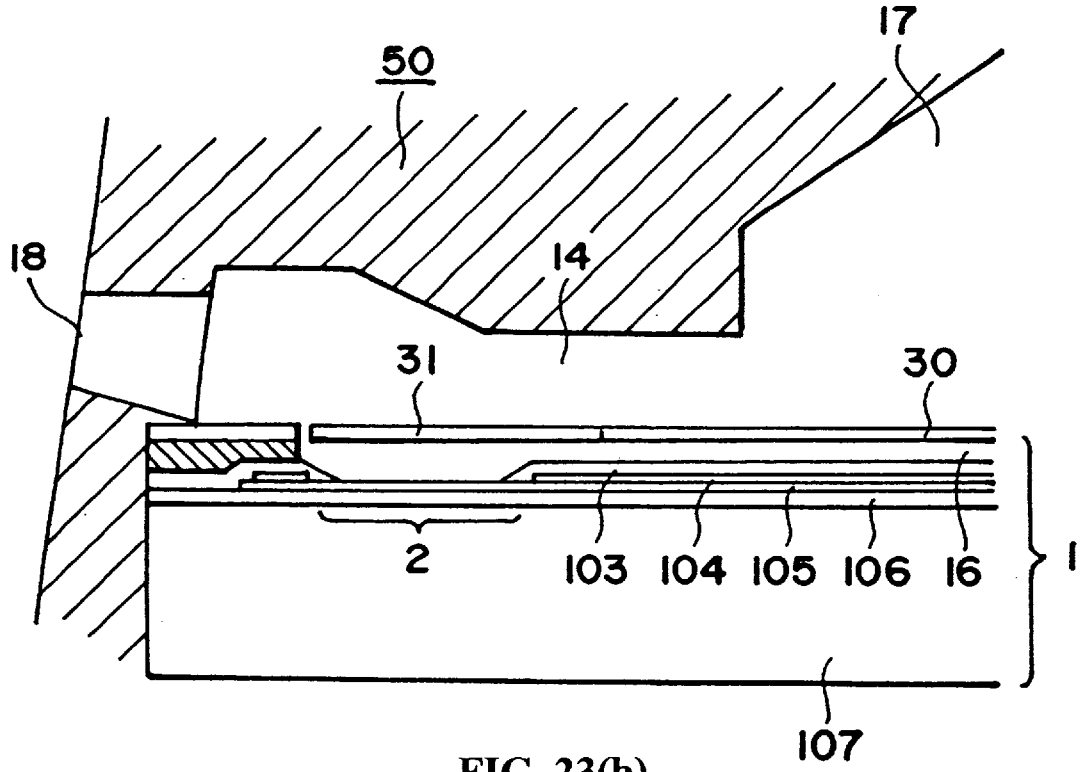
Figure 24:
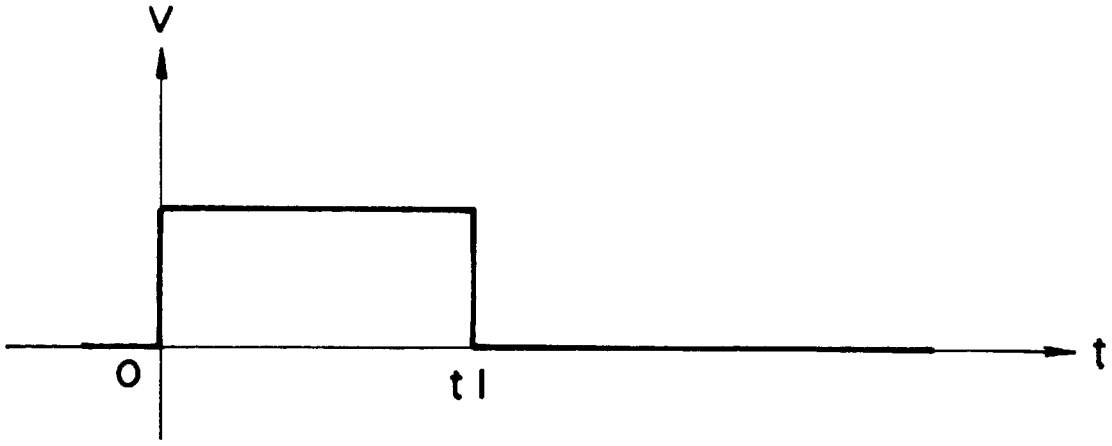
FIG. 24 is a schematic view showing a configuration of a driving pulse.

FIG. 23 is a longitudinal section of the liquid ejecting head applicable to the present invention.

On the element substrate 1, a grooved member 50 is mounted, the member 50 having second liquid flow paths 16, separation walls 30, first liquid flow paths 14 and grooves for constituting the first liquid flow path.

The element substrate 1 has, as shown in FIG. 12, patterned wiring electrode (0.2–1.0 μm thick) of aluminum or the like and patterned electric resistance layer 105 (0.01–0.2 μm thick) of hafnium boride ($HfB_2$), tantalum nitride (TaN), tantalum aluminum (TaAl) or the like constituting the heat generating element on a silicon oxide film or silicon nitride film 106 for insulation and heat accumulation, which in turn is on the substrate 107 of silicon or the like. A voltage is applied to the resistance layer 105 through the two wiring electrodes 104 to flow a current through the resistance layer to effect heat generation. Between the wiring electrode, a protection layer of silicon oxide, silicon nitride or the like of 0.1–2.0 μm thick is provided on the resistance layer, and in addition, an anti-cavitation layer of tantalum or the like (0.1–0.6 μm thick) is formed thereon to protect the resistance layer 105 from various liquid such as ink. The pressure and shock wave generated upon the bubble generation and collapse is so strong that durability of the oxide film which is relatively fragile is deteriorated. Therefore, metal material such as tantalum (Ta) or the like is used as the anti-cavitation layer.

The protection layer may be omitted depending on the combination of liquid, liquid flow path structure and resistance material. One of such examples is shown in FIG. 22, (b). The material of the resistance layer not requiring the protection layer, includes, for example, iridium-tantalum-aluminum alloy or the like.

Thus, the structure of the heat generating element in the foregoing embodiments may include only the resistance layer (heat generation portion) or may include a protection layer for protecting the resistance layer.

In this example, the heat generating element has a heat generation portion having the resistance layer which generates heat in response to the electric signal. This is not limiting, and it will suffice if a bubble enough to eject the ejection liquid is created in the bubble generation liquid. For example, heat generation portion may be in the form of a photothermal transducer which generates heat upon receiving light such as laser, or the one which generates heat upon receiving high frequency wave. On the element substrate 1, function elements such as a transistor, a diode, a latch, a shift register and so on for selectively driving the electrothermal transducer element may also be integrally built in, in addition to the resistance layer 105 constituting the heat generation portion and the electrothermal transducer constituted by the wiring electrode 104 for supplying the electric signal to the resistance layer.

In order to eject the liquid by driving the heat generation portion of the electrothermal transducer on the above-described element substrate 1, the resistance layer 105 is supplied through the wiring electrode 104 with rectangular pulses as shown in FIG. 23 to cause instantaneous heat generation in the resistance layer 105 between the wiring electrode 104.

In the case of the heads of the foregoing examples, the applied energy has a voltage of 24 V, a pulse width of 7 μsec, current of 150 mA and a frequency of 6 KHz, by which the liquid ink is ejected through the ejection outlet through the process described hereinbefore. However, the driving signal conditions are not limited to this, but may be any if the bubble generation liquid is properly capable of bubble generation.

<Head Structure for 2 Flow Paths>

Figure 25:
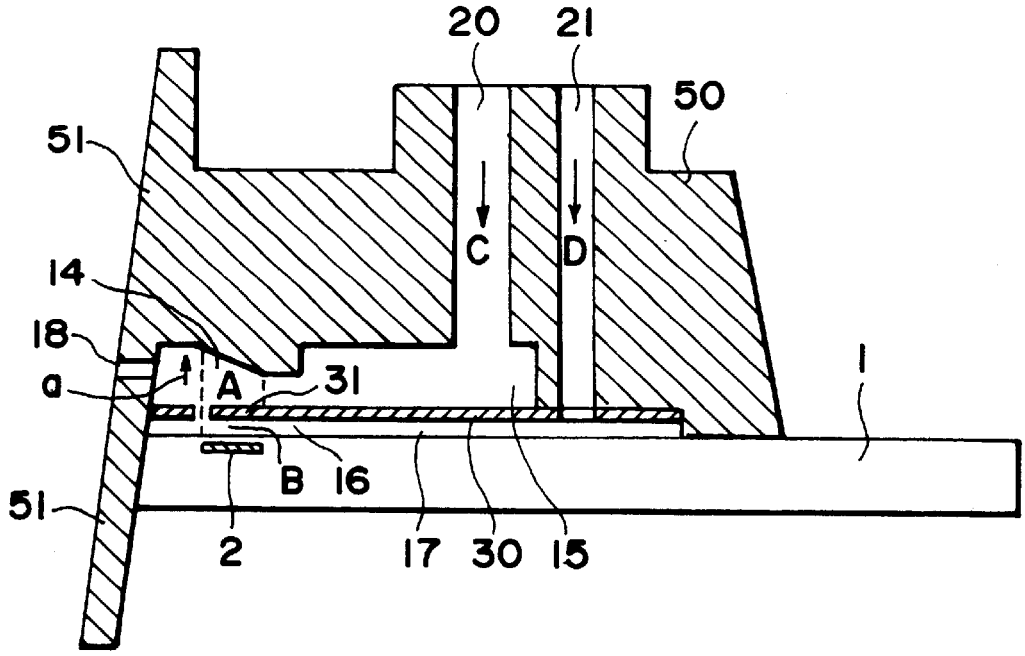
FIG. 25 is a sectional view illustrating a supply passage of liquid usable in a liquid ejecting head of the present invention.

The description will be made as to a structure of the liquid ejecting head with which different liquids are separately accommodated in first and second common liquid chamber, and the number of parts can be reduces so that manufacturing cost can be reduced. FIG. 25 is a sectional view illustrating supply passage of a liquid ejecting head applicable to the present invention, wherein same reference numerals as in the previous embodiment are assigned to the elements having the corresponding functions, and detailed descriptions thereof are omitted for simplicity. In this example, a grooved member 50 has an orifice plate 51 having an ejection outlet 18, a plurality of grooves for constituting a plurality of first liquid flow paths 14 and a recess for constituting the first common liquid chamber 15 for supplying the liquid (ejection liquid) to the plurality of liquid flow paths 14. A separation wall 30 is mounted to the bottom of the grooved member 50 by which plurality of first liquid flow paths 14 are formed. Such a grooved member 50 has a first liquid supply passage 20 extending from an upper position to the first common liquid chamber 15. The grooved member 50 also has a second liquid supply passage 21 extending from an upper position to the second common liquid chamber 17 through the separation wall 30.

Figure 36:
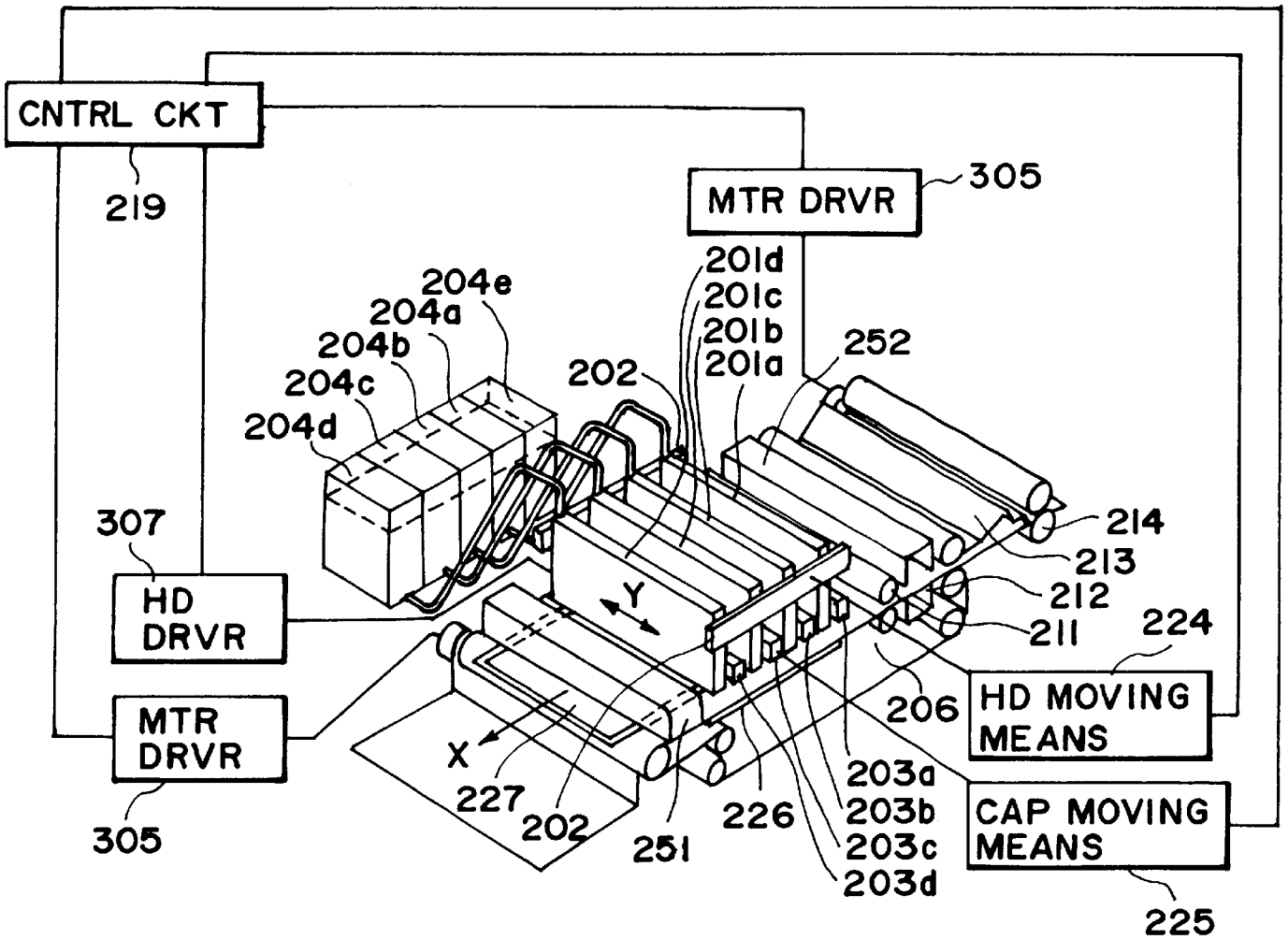
FIG. 36 is shows a liquid ejection system.

As indicated by an arrow C in FIG. 25, the first liquid (ejection liquid) is supplied through the first liquid supply passage 20 and first common liquid chamber 15 to the first liquid flow path 14, and the second liquid (bubble generation liquid) is supplied to the second liquid flow path 16 through the second liquid supply passage 21 and the second common liquid chamber 17 as indicated by arrow D in FIG. 36. In this example, the second liquid supply passage 21 is extended in parallel with the first liquid supply passage 20, but this is not limited to the exemplification, but it may be any if the liquid is supplied to the second common liquid chamber 17 through the separation wall 30 outside the first common liquid chamber 15.

The (diameter) of the second liquid supply passage 21 is determined in consideration of the supply amount of the second liquid. The configuration of the second liquid supply passage 21 is not limited to circular or round but may be rectangular or the like.

Figure 26:
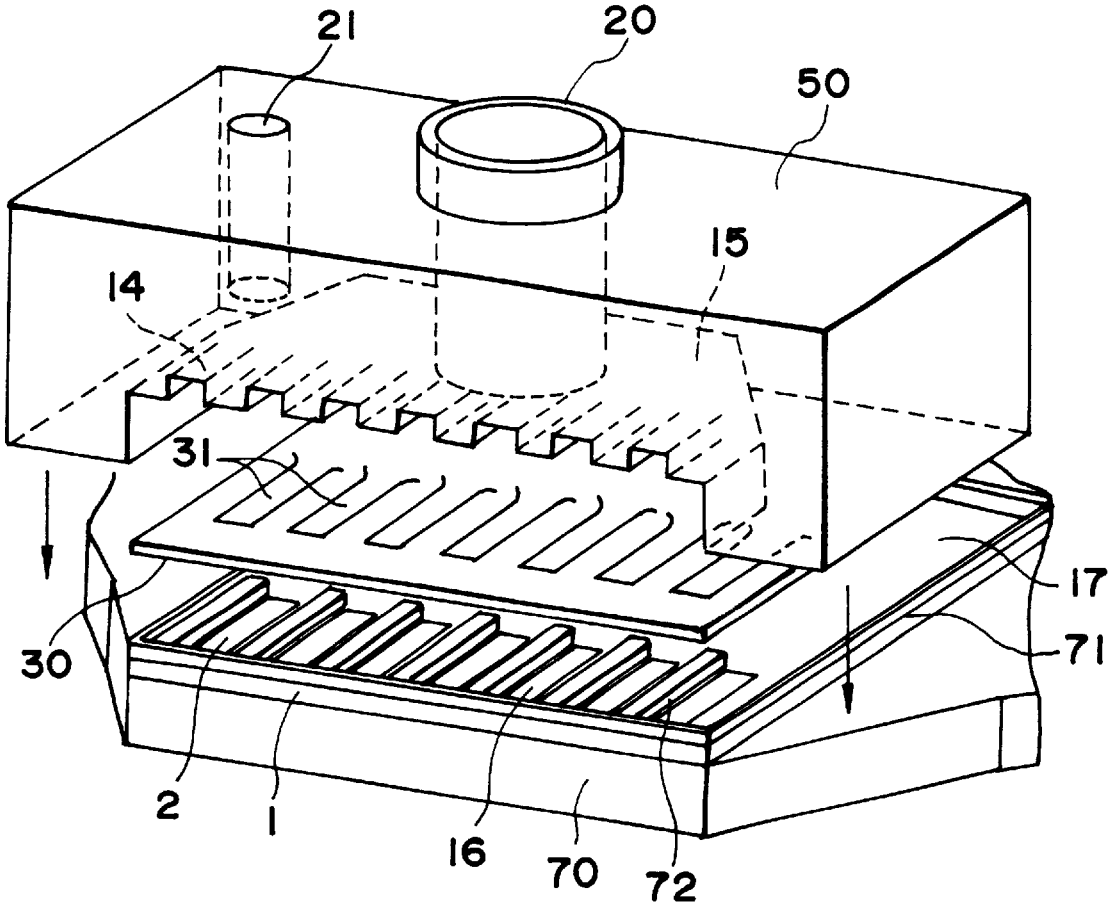
FIG. 26 is an exploded perspective view of a liquid ejecting head of the present invention.

The second common liquid chamber 17 may be formed by dividing the grooved by a separation wall 30. As for the method of forming this, as shown in FIG. 26 which is an exploded perspective view, a common liquid chamber frame and a second liquid passage wall are formed of a dry film, and a combination of a grooved member 50 having the separation wall fixed thereto and the element substrate 1 are bonded, thus forming the second common liquid chamber 17 and the second liquid flow path 16.

In this example, the element substrate 1 is constituted by providing the supporting member 70 of metal such as aluminum with a plurality of electrothermal transducer elements as heat generating elements for generating heat for bubble generation from the bubble generation liquid through film boiling. Above the element substrate 1, there are disposed the plurality of grooves constituting the liquid flow path 16 formed by the second liquid passage walls, the recess for constituting the second common liquid chamber (common bubble generation liquid chamber) 17 which is in fluid communication with the plurality of bubble generation liquid flow paths for supplying the bubble generation liquid to the bubble generation liquid passages, and the separation or dividing walls 30 having the movable walls 31.

The grooved member 50 is provided with grooves for constituting the ejection liquid flow paths (first liquid flow paths) 14 by mounting the separation walls 30 thereto, a recess for constituting the first common liquid chamber (common ejection liquid chamber) 15 for supplying the ejection liquid to the ejection liquid flow paths, the first supply passage (ejection liquid supply passage) 20 for supplying the ejection liquid to the first common liquid chamber, and the second supply passage (bubble generation liquid supply passage) 21 for supplying the bubble generation liquid to the second common liquid chamber 17. The second supply passage 21 is connected with a fluid communication path in fluid communication with the second common liquid chamber 17, penetrating through the separation wall 30 disposed outside of the first common liquid chamber 15. By the provision of the fluid communication path, the bubble generation liquid can be supplied to the second common liquid chamber 15 without mixture with the ejection liquid.

The positional relation among the element substrate 1, separation wall 30, grooved top plate 50 is such that movable members 31 are arranged corresponding to the heat generating elements on the element substrate 1, and that ejection liquid flow paths 14 are arranged corresponding to the movable members 31. In this example, one second supply passage is provided for the grooved member, but it may be plural in accordance with the supply amount. The cross-sectional area of the flow path of the ejection liquid supply passage 20 and the bubble generation liquid supply passage 21 may be determined in proportion to the supply amount. By the optimization of the cross-sectional area of the flow path, the parts constituting the grooved member 50 or the like can be downsized.

As described in the foregoing, according to this embodiment, the second supply passage for supplying the second liquid to the second liquid flow path and the first supply passage for supplying the first liquid to the first liquid flow path, can be provided by a single grooved top plate, so that number of parts can be reduced, and therefore, the reduction of the manufacturing steps and therefore the reduction of the manufacturing cost, are accomplished.

Furthermore, the supply of the second liquid to the second common liquid chamber in fluid communication with the second liquid flow path, is effected through the second liquid flow path which penetrates the separation wall for separating the first liquid and the second liquid, and therefore, one bonding step is enough for the bonding of the separation wall, the grooved member and the heat generating element substrate, so that manufacturing is easy, and the accuracy of the bonding is improved.

Since the second liquid is supplied to the second liquid common liquid chamber, penetrating the separation wall, the supply of the second liquid to the second liquid flow path is assured, and therefore, the supply amount is sufficient so that stabilized ejection is accomplished.

<Ejection Liquid and Bubble Generation Liquid>

As described in the foregoing examples, according to the present invention, by the structure having the movable member described above, the liquid can be ejected at higher ejection force or ejection efficiency than the conventional liquid ejecting head. When the same liquid is used for the bubble generation liquid and the ejection liquid, it is possible that liquid is not deteriorated, and that deposition on the heat generating element due to heating can be reduced. Therefore, a reversible state change is accomplished by repeating the gassification and condensation. So, various liquids are usable, if the liquid is the one not deteriorating the liquid flow passage, movable member or separation wall or the like.

Among such liquids, the one having the ingredient as used in conventional bubble jet device, can be used as a recording liquid. When the two-flow-path structure of the present invention is used with different ejection liquid and bubble generation liquid, the bubble generation liquid having the above-described property is used, more particularly, the examples includes: methanol, ethanol, n-propyl alcohol, isopropyl alcohol, n-hexane, n-heptane, n-octane, toluene, xylene, methylene dichloride, trichloroethylene, Freon TF, Freon BF, ethyl ether, dioxane, cyclohexane, methyl acetate, ethyl acetate, acetone, methyl ethyl ketone, water, or the like, and a mixture thereof.

As for the ejection liquid, various liquids are usable without paying attention to the degree of bubble generation property or thermal property. The liquids which have not been conventionally usable, because of low bubble generation property and/or easiness of property change due to heat, are usable.

However, it is desired that ejection liquid by itself or by reaction with the bubble generation liquid, does not impede the ejection, the bubble generation or the operation of the movable member or the like. As for the recording ejection liquid, high viscous ink or the like is usable. As for another ejection liquid, pharmaceuticals and perfume or the like having a nature easily deteriorated by heat is usable. The ink of the following ingredient was used as the recording liquid usable for both of the ejection liquid and the bubble generation liquid, and the recording operation was carried out. Since the ejection speed of the ink is increased, the shot accuracy of the liquid droplets is improved, and therefore, highly desirable images were recorded.

| Dye ink viscosity of 2 cp: | |
|---|---|
| (C.I. Food black 2) dye | 3 wt. % |
| Diethylene glycol | 10 wt. % |
| Thio diglycol | 5 wt. % |
| Ethanol | 3 wt. % |
| Water | 77 wt. % |

Recording operations were also carried out using the following combination of the liquids for the bubble generation liquid and the ejection liquid. As a result, the liquid having a ten and several cps viscosity, which was unable to be ejected heretofore, was properly ejected, and even 150 cps liquid was properly ejected to provide high quality image.

| | |
|---|---|
| Bubble generation liquid 1: | |
| Ethanol | 40 wt. % |
| Water | 60 wt. % |
| Bubble generation liquid 2: | |
| Water | 100 wt. % |
| Bubble generation liquid 3: | |
| Isopropyl alcohol | 10 wt. % |
| Water | 90 wt. % |
| Ejection liquid 1; Pigment ink (approx. 15 cp): | |
| Carbon black | 5 wt. % |
| Stylene-acrylate-acrylate ethyl copolymer resin material Dispersion material (oxide = 140, weight average molecular weight = 8000) | 1 wt. % |
| Mono-ethanol amine | 0.25 wt. % |

-continued

| | |
|---|---|
| Glyceline | 69 wt. % |
| Thiodiglycol | 5 wt. % |
| Ethanol | 3 wt. % |
| Water | 16.75 wt. % |
| Ejection liquid 2 (55 cp): | |
| Polyethylene glycol 200 | 100 wt. % |
| Ejection liquid 3 (150 cp): | |
| Polyethylene glycol 600 | 100 wt. % |

In the case of the liquid which has not been easily ejected, the ejection speed is low, and therefore, the variation in the ejection direction is expanded on the recording paper with the result of poor shot accuracy. Additionally, variation of ejection amount occurs due to the ejection instability, thus preventing the recording of high quality image. However, according to the embodiments, the use of the bubble generation liquid permits sufficient and stabilized generation of the bubble. Thus, the improvement in the shot accuracy of the liquid droplet and the stabilization of the ink ejection amount can be accomplished, thus improving the recorded image quality remarkably.

<Manufacturing of Liquid Ejecting Head>

The description will be made as to the manufacturing step of the liquid ejecting head according to the present invention.

In the case of the liquid ejecting head as shown in FIG. 5, a foundation 34 for mounting the movable member 31 is patterned and formed on the element substrate 1, and the movable member 31 is bonded or welded on the foundation 34. Then, a grooved member having a plurality of grooves for constituting the liquid flow paths 10, ejection outlet 18 and a recess for constituting the common liquid chamber 13, is mounted to the element substratel with the grooves and movable members aligned with each other.

The description will be made as to a manufacturing step for the liquid ejecting head having the two-flow-path structure as shown in FIG. 13 and FIG. 26.

Generally, walls for the second liquid flow paths 16 are formed on the element substratel, and separation walls 30 are mounted thereon, and then, a grooved member 50 having the grooves for constituting the first liquid flow paths 14, is mounted further thereon. Or, the walls for the second liquid flow paths 16 are formed, and a grooved member 50 having the separation walls 30 is mounted thereon.

The description will be made as to the manufacturing method for the second liquid flow path.

Figure 27:
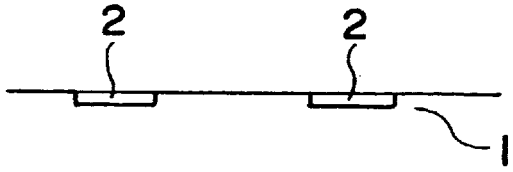
FIGS. 27, (a) to (e) shows a process step of manufacturing method of a liquid ejecting head according to the present invention.
Figure 27:
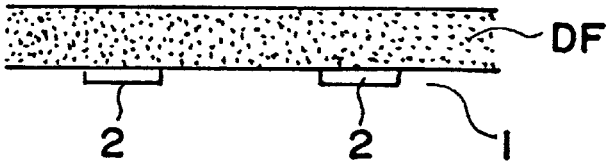
Figure 27:
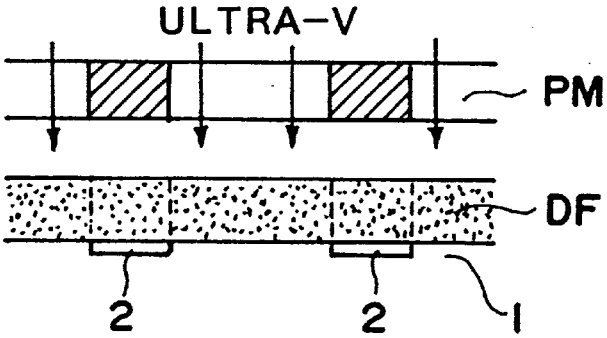
Figure 27:
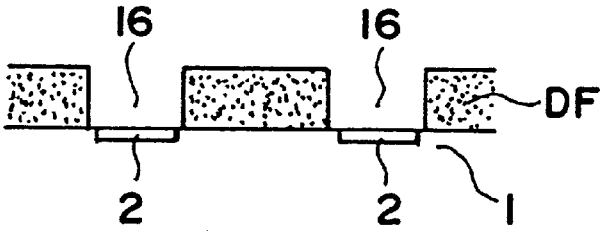
Figure 27:
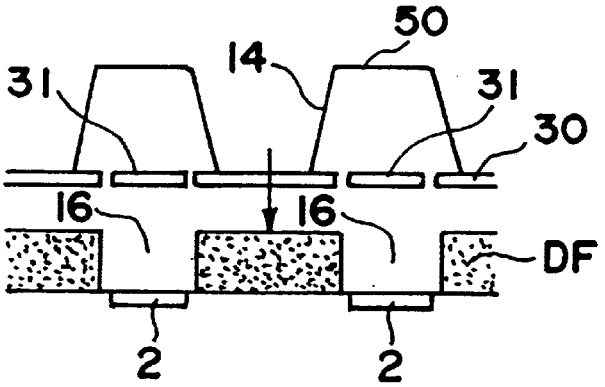

FIGS. 27, (a)–(e), is a schematic sectional view for illustrating a manufacturing method for the liquid ejecting head according to a first manufacturing embodiment of the present invention.

In this embodiment, as shown in FIG. 27), (a), elements for electrothermal conversion having heat generating elements 2 of hafnium boride, tantalum nitride or the like, are formed, using a manufacturing device as in a semiconductor manufacturing, on an element substrate (silicon wafer) 1, and thereafter, the surface of the element substrate 1 is cleaned for the purpose of improving the adhesiveness or contactness with the photosensitive resin material in the next step. In order to further improve the adhesiveness or contactness, the surface of the element substrate is treated with ultraviolet-radiation-ozone or the like. then, liquid comprising a silane coupling agent, for example, (A189, available from NIPPON UNICA) diluted by ethyl alcoholic to 1 weight % is applied on the improved surface by spin coating.

Subsequently, the surface is cleaned, and as shown in FIG. 27, (b), an ultraviolet radiation photosensitive resin film (dry film Ordyl SY-318 available from Tokyo Ohka Kogyo Co., Ltd.) DF is laminated on the substratel having the thus improved surface.

Then, as shown in FIG. 27, (c), a photo-mask PM is placed on the dry film DF, and the portions of the dry film DF which are to remain as the second flow passage wall is illuminated with the ultraviolet radiation through the photo-mask PM. The exposure process was carried out using MPA-600, available from, CANON KABUSHIKI KAISHA), and the exposure amount was approx. 600 mJ/cm$^2$.

Then, as shown in FIG. 27, (d), the dry film DF was developed by developing liquid which is a mixed liquid of xylene and butyl Cellosolve acetate (BMRC-3 available from Tokyo Ohka Kogyo Co., Ltd.) to dissolve the unexposed portions, while leaving the exposed and cured portions as the walls for the second liquid flow paths 16. Furthermore, the residuals remaining on the surface of the element substrate 1 is removed by oxygen plasma ashing device (MAS-800 available from Alcan-Tech Co., Inc.) for approx. 90 sec, and it is exposed to ultraviolet radiation for 2 hours at 150° C. with the dose of 100 mJ/cm$_2$ to completely cure the exposed portions.

By this method, the second liquid flow paths can be formed with high accuracy on a plurality of heater boards (element substrates) cut out of the silicon substrate. The silicon substrate is cut into respective heater boards 1 by a dicing machine having a diamond blade of a thickness of 0.05 mm (AWD-4000 available from Tokyo Seimitsu). The separated heater boards 1 are fixed on the aluminum base plate 70 (FIG. 30) by adhesive material (SE4400 available from Toray). Then, the printed board 73 connected to the aluminum base plate 70 beforehand is connected with the heater board 1 by aluminum wire (not shown) having a diameter of 0.05 mm.

As shown in FIG. 27, (e), a joining member of the grooved member 50 and separation wall 30 were positioned and connected to the heater board 1. More particularly, grooved member having the separation wall 30 and the heater board 1 are positioned, and are engaged and fixed by a confining spring. Thereafter, the ink and bubble generation liquid supply member 80 is fixed on the ink. Then, the gap among the aluminum wire, grooved member 50, the heater boardl and the ink and bubble generation liquid supply member 80 are sealed by a silicone sealant (TSE399, available from Toshiba silicone).

By forming the second liquid flow path through the manufacturing method, accurate flow paths without positional deviation relative to the heaters of the heater board, can be provided. By coupling the grooved member 50 and the separation wall 30 in the prior step, the positional accuracy between the first liquid flow path 14 and the movable member 31 is enhanced.

By the high accuracy manufacturing technique, the ejection stabilization is accomplished, and the printing quality is improved. Since they are formed all together on a wafer, massproduction at low cost is possible.

In this embodiment, the use is made with an ultraviolet radiation curing type dry film for the formation of the second liquid flow path. But, a resin material having an absorption band adjacent particularly 248 nm (outside the ultraviolet range) may be laminated. it is cured, and such portions going to be the second liquid flow paths are directly removed by eximer laser.

Figure 28:
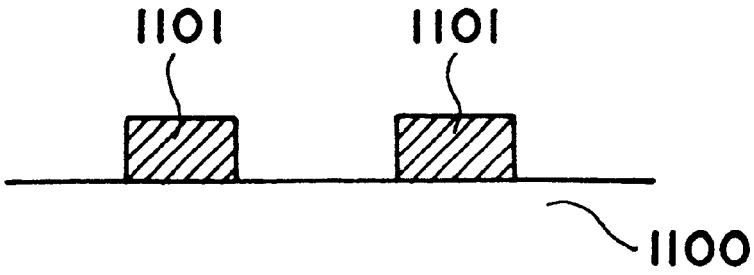
FIGS. 28, (a) to (d) shows process steps of a manufacturing method for a liquid ejecting head according to an embodiment of the present invention.
Figure 28:
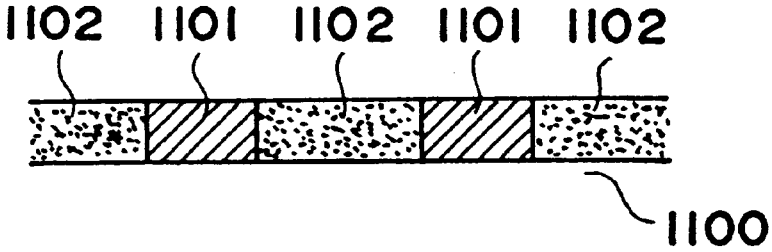
Figure 28:
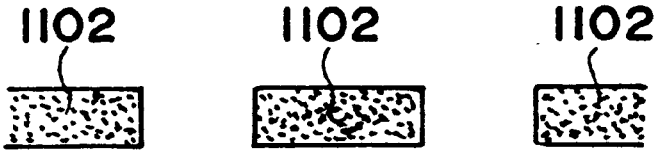
Figure 28:
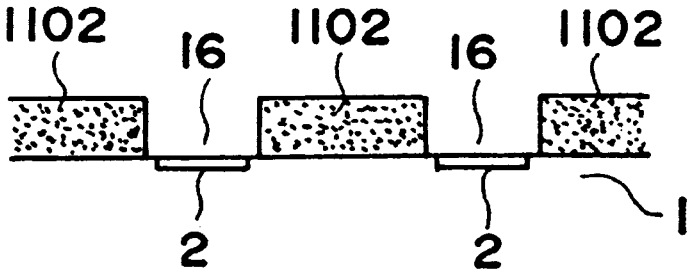

FIGS. 28, (a)–(d), is a schematic sectional view for illustration of a manufacturing method of the liquid ejecting head according to a second embodiment of the present invention.

In this embodiment, as shown in FIG. 28, (a), a resist 101 having a thickness of 15 $\mu$m is patterned in the shape of the second liquid flow path on the SUS substrate 1100.

Then, as shown in FIG. 28, (b), the SUS substrate 20 is coated with 15 $\mu$m thick of nickel layer 1102 on the SUS substrate 1100 by electroplating. The plating solution used comprised nickel amidosulfate nickel, stress decrease material (zero ohru, available from World Metal Inc.), boric acid, pit prevention material (NP-APS, available from World Metal Inc.) and nickel chloride. As to the electric field upon electro-deposition, an electrode is connected on the anode side, and the SUS substrate 1100 already patterned is connected to the cathode, and the temperature of the plating solution is 50° C., and the current temperature is 5 A/cm$^2$.

Then, as shown in FIG. 28, (c), the SUS substrate 1100 having been subjected to the plating is subjected then to ultrasonic vibration to remove the nickel layer 1102 portions from the SUS substrate 1100 to provide the second liquid flow path.

On the other hand, the heater board having the elements for the electrothermal conversion, are formed on a silicon wafer by a manufacturing device as used in semiconductor manufacturing. The wafer is cut into heater boards by the dicing machine similarly to the foregoing embodiment. The heater board 1 is mounted to the aluminum base plate 70 already having a printed board 73 mounted thereto, and the printed board 73 and the aluminum wire (not shown) are connected to establish the electrical wiring. On such a heater board 1, the second liquid flow path provided through the foregoing process is fixed, as shown in FIG. 28, (d). For this fixing, it may not be so firm if a positional deviation does not occur upon the top plate joining, since the fixing is accomplished by a confining spring with the top plate having the separation wall fixed thereto in the later step, as in the first embodiment.

In this embodiment, for the positioning and fixing, the use was made with an ultraviolet radiation curing type adhesive material (Amicon UV-300, available from GRACE JAPAN, and with an ultraviolet radiation projecting device operated with the exposure amount of 100 mJ/cm$^2$ for approx. 3 sec to complete the fixing.

According to the manufacturing method of this embodiment, the second liquid flow paths can be provided without positional deviation relative to the heat generating elements, and since the flow passage walls are of nickel, it is durable against the alkali property liquid so that the reliability is high.

Figure 29:
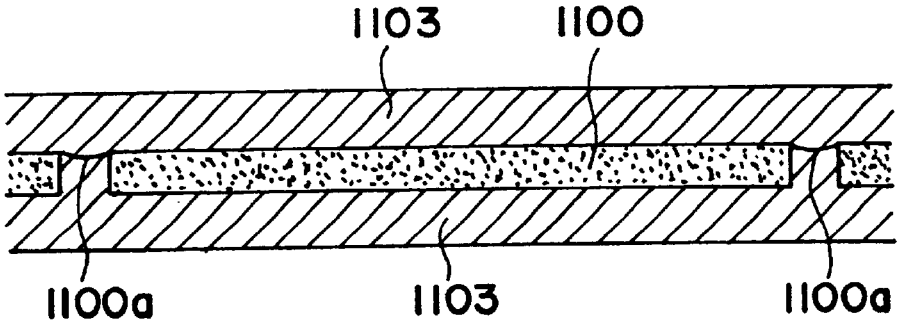
FIGS. 29, (a) to (d) shows process steps of a manufacturing method for a liquid ejecting head according to an embodiment of the present invention.
Figure 29:
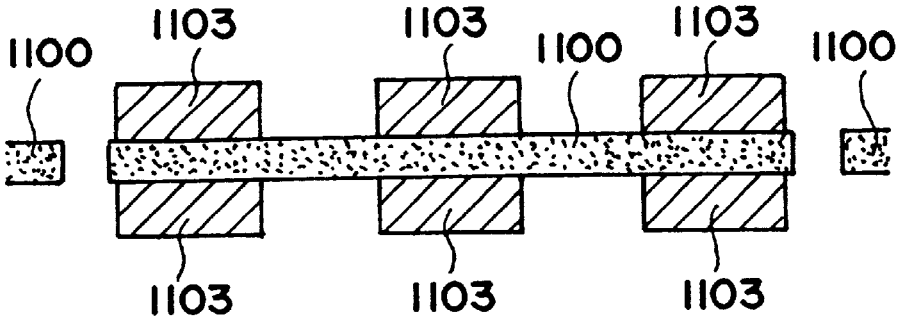
Figure 29:
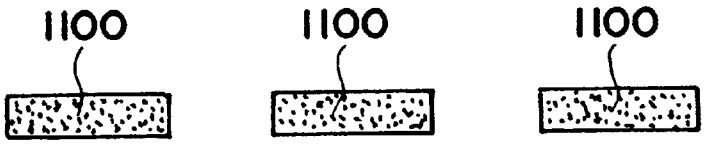
Figure 29:
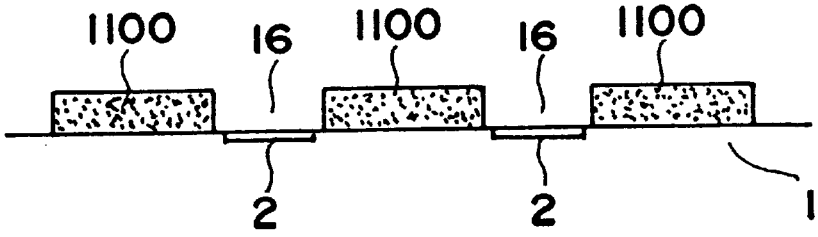

FIGS. 29, (a)–(d), is a schematic sectional view for illustrating a manufacturing method of the liquid ejecting head according to a third embodiment of the present invention.

In this embodiment, as shown in FIG. 29, (a), the resist 1103 is applied on both of the sides of the SUS substrate 1100 having a thickness of 15 $\mu$m and having an alignment hole or mark 1100*a*. The resist used was PMERP-AR900 available from Tokyo Ohka Kogyo Co., Ltd.

Thereafter, as shown in FIG. 29, (b), the exposure operation was carried out in alignment with the alignment hole 1100*a* of the element substrate 1100, using an exposure device (MPA-600 available from CANON KABUSHIKI KAISHA, JAPAN) to remove the portions of the resist 1103 which are going to be the second liquid flow path. The exposure amount was 800 mJ/cm$^2$.

Subsequently, as shown in FIG. 29, (c), the SUS substrate 1100 having the patterned resist 1103 on both sides, is dipped in etching liquid (aqueous solution of ferric chloride or cuprous chloride) to etch the portions exposed through the resist 1103, and the resist is removed.

Then, as shown in FIG. 29, (d), similarly to the foregoing embodiment of the manufacturing method, the SUS substrate 1100 having been subjected to the etching is positioned and fixed on the heater board 1, thus assembling the liquid ejecting head having the second liquid flow paths 16.

According to the manufacturing method of this embodiment, the second liquid flow paths 16 without the positional deviation relative to the heaters can be provided, and since the flow paths are of SUS, the durability against acid and alkali liquid is high, so that high reliability liquid ejecting head is provided.

As described in the foregoing, according to the manufacturing method of this embodiment, by mounting the walls of the second liquid flow path on the element substrate in a prior step, the electrothermal transducers and second liquid flow paths are aligned with each other with high precision. Since a number of second liquid flow paths are formed simultaneously on the substrate before the cutting, massproduction is possible at low cost.

The liquid ejecting head provided through the manufacturing method of this embodiment has the advantage that the second liquid flow paths and the heat generating elements are aligned at high precision, and therefore, the pressure of the bubble generation can be received with high efficiency so that the ejection efficiency is excellent.

<Liquid Ejection Head Cartridge>

The description will be made as to a liquid ejection head cartridge having a liquid ejecting head according to an embodiment of the present invention.

Figure 30:
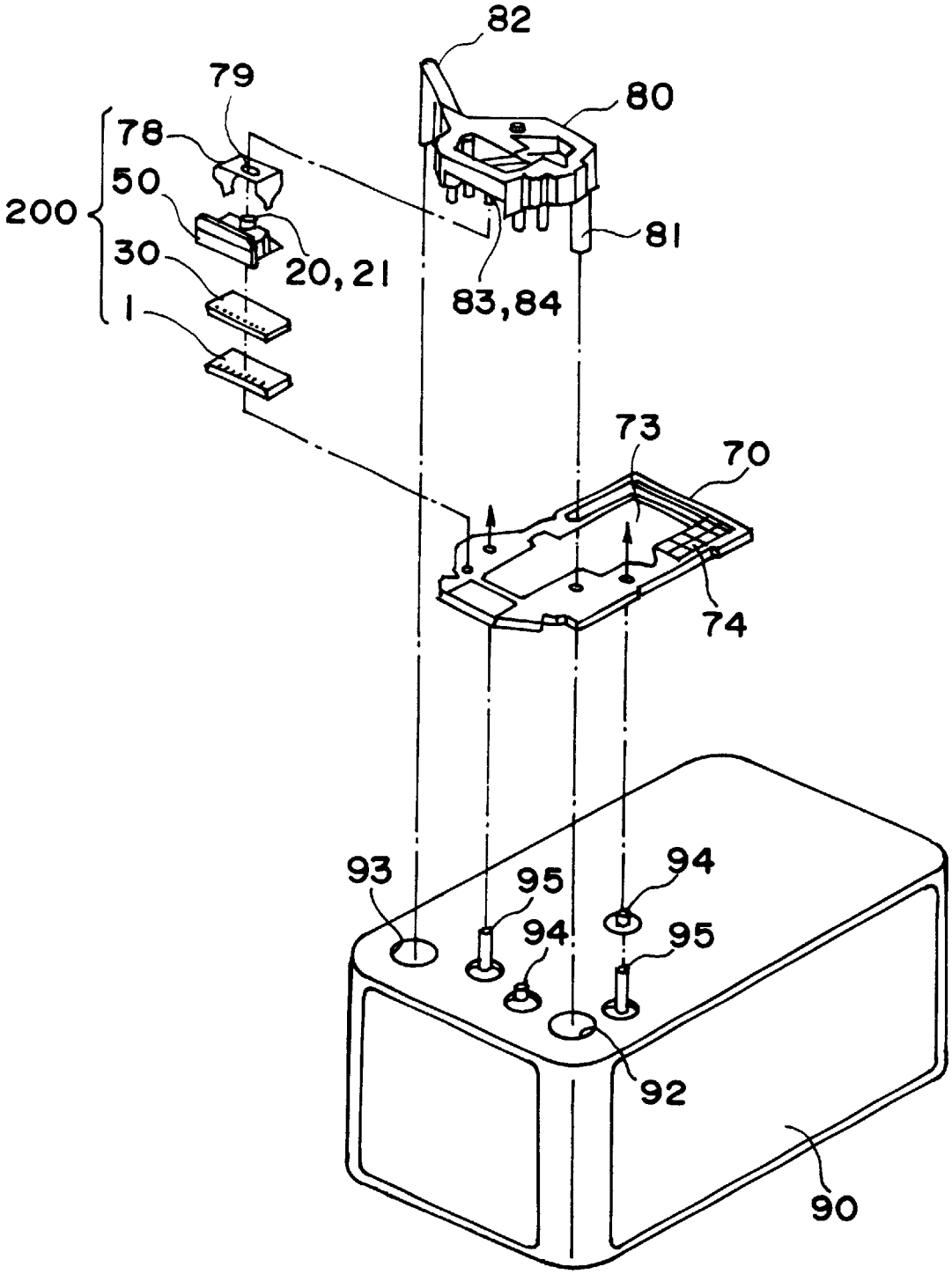
FIG. 30 is an exploded perspective view of a liquid ejection head cartridge.

FIG. 30 is a schematic exploded perspective view of a liquid ejection head cartridge including the above-described liquid ejecting head, and the liquid ejection head cartridge comprises generally a liquid ejecting head portion 200 and a liquid container 80.

The liquid ejecting head portion 200 comprises an element substrate 1, a separation wall 30, a grooved member 50, a confining spring 78, liquid supply member 90 and a supporting member 70. The element substrate 1 is provided with a plurality of heat generating resistors for supplying heat to the bubble generation liquid, as described hereinbefore. A bubble generation liquid passage is formed between the element substrate 1 and the separation wall 30 having the movable wall. By the coupling between the separation wall 30 and the grooved top plate 50, an ejection flow path (unshown) for fluid communication with the ejection liquid is formed.

The confining spring 78 functions to urge the grooved member 50 to the element substrate 1, and is effective to properly integrate the element substrate 1, separation wall 30, grooved and the supporting member 70 which will be described hereinafter.

Supporting member 70 functions to support an element substrate 1 or the like, and the supporting member 70 has thereon a circuit board 71, connected to the element substrate 1, for supplying the electric signal thereto, and contact pads 72 for electric signal transfer between the device side when the cartridge is mounted on the apparatus.

The liquid container 90 contains the ejection liquid such as ink to be supplied to the liquid ejecting head and the bubble generation liquid for bubble generation, separately. The outside of the liquid container 90 is provided with a positioning portion 94 for mounting a connecting member for connecting the liquid ejecting head with the liquid container and a fixed shaft 95 for fixing the connection portion. The ejection liquid is supplied to the ejection liquid supply passage 81 of a liquid supply member 80 through a supply passage 84 of the connecting member from the ejection liquid supply passage 92 of the liquid container, and is supplied to a first common liquid chamber through the ejection liquid supply passages 83, 71 and 21 of the members. The bubble generation liquid is similarly supplied to the bubble generation liquid supply passage 82 of the liquid supply member 80 through the supply passage of the connecting member from the supply passage 93 of the liquid container, and is supplied to the second liquid chamber through the bubble generation liquid supply passage 84, 71, 22 of the members.

In such a liquid ejection head cartridge, even if the bubble generation liquid and the ejection liquid are different liquids, the liquids are supplied in good order. In the case that ejection liquid and the bubble generation liquid are the same, the supply path for the bubble generation liquid and the ejection liquid are not necessarily separated.

After the liquid is used up, the liquid containers may be supplied with the respective liquids. To facilitate this supply, the liquid container is desirably provided with a liquid injection port. The liquid ejecting head and the liquid container may be integral with each other or separate from each other.

<Side Shooter Type Head>

The present invention is not limited to a so-called edge shooter type head wherein an ejection outlet is provided at one end of the flow path extended along the surface of the heater, but it applicable to a so-called side shooter type head wherein the ejection outlet is provided opposed to the surface of the heater as shown in FIG. 41, for example. In the side shooter type liquid ejecting head shown in FIG. 31, a substrate 1 is provided with a heat generating element 2 for generating thermal energy for generating a bubble in the liquid therein for each ejection outlet. Above the substrate 1, a second liquid flow path 16 for the bubble generation liquid is formed, and a first liquid flow path 14 for the ejection liquid is formed in direct fluid communication with the ejection outlet 18, the first liquid flow path 14 being formed in a grooved top plate 50. The first liquid flow path 14 is isolated from the second liquid flow path 16 by a separation wall 30 of elastic material such as metal. In these respects, this head is similar to the edge shooter type liquid ejecting head described hereinbefore.

The side shooter type liquid ejecting head is featured by the ejection outlet 18 provided right above the heat generating element 2, in the grooved top plate (orifice plate) 50 disposed above the first liquid flow path 14. In the separation wall 30, there is provided one pair of movable members 31 (double door type) at a portion between the ejection outlet 18 and the heat generating element 2. The both movable members 31 are of cantilever configuration supported by the fulcrum or base portions 31*b*. The free ends 31*a* thereof are disposed opposed to each other with a small space provided by the slit 31C right below the center portion of the ejection outlet 18. At the time of ejection, the movable portions 31, as indicated by arrows in FIG. 41, are opened to the first liquid flow path 14 by bubble generation of the bubble generation liquid in the bubble generating region B, and are closed by contraction of the bubble generation liquid. To the region C, the ejection liquid is refilled from the ejection liquid container which will be described hereinafter, and is prepared for the next bubble generation.

The first liquid flow path 14 and other first liquid flow paths are in fluid communication with an unshown container for retaining the ejection liquid through a first common liquid chamber 15, and the second liquid flow path 16 and other second liquid flow paths are in fluid communication with a container (unshown) for retaining the bubble generation liquid through a second common liquid chamber 17.

In the side shooter type liquid ejecting head having such a structure, the present invention is capable of providing the advantageous effects that refilling of the ejection liquid is improved, and the liquid can be ejected with high ejection pressure and with high ejection energy use efficiency.

With respect to the manufacturing methods, they are substantially the same as with the edge shooter type heads, except that positions of the ejection outlets in the top plate are different and that positions and the structures of the common liquid chambers 15, 17 are different. The relation between the separation wall 30 having the movable member and the flow passage wall constituting the second liquid flow path 16, is the same.

Figure 31:
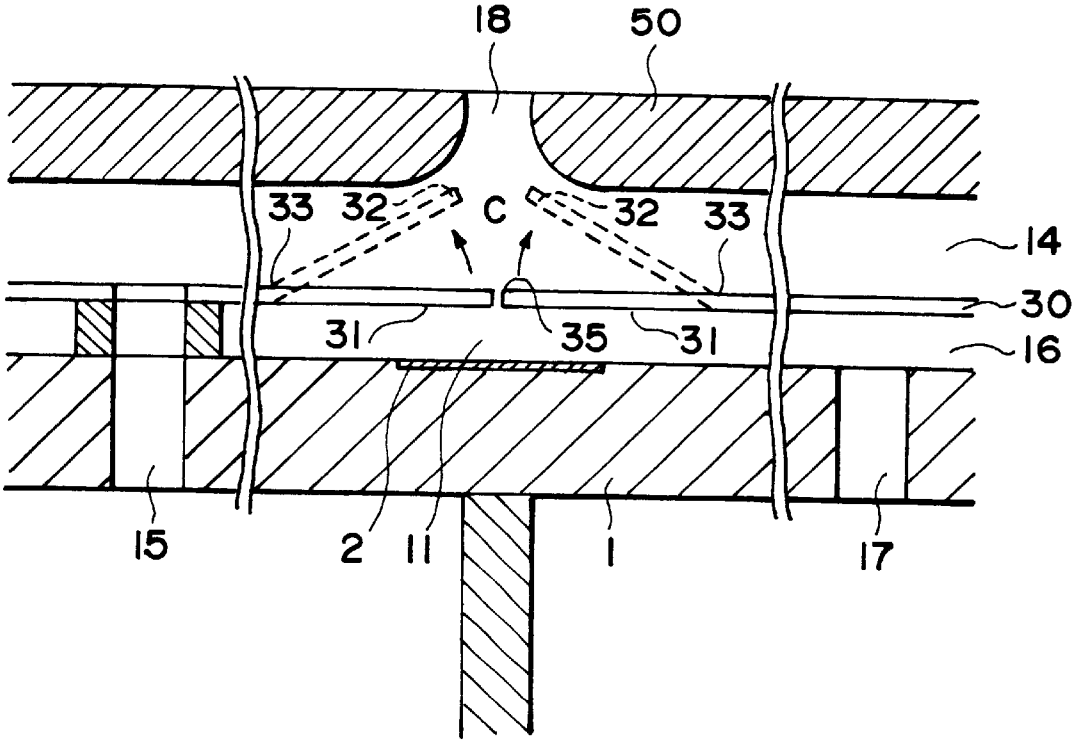
FIG. 31 is a sectional view of a major part of a liquid ejecting head of a side shooter type, according to an embodiment of the present invention.

Also in the case of the side shooter type, the bubble generation and ejection are stabilized, and the ejection efficiency and the durability of the movable member 31 are stabilized, by selecting, in accordance with the foregoing embodiment, the areas of the heat generating element 2 and the movable member 31, the height of the first liquid flow path, the height of the second liquid flow path, the longitudinal elasticity of the movable member 31, and/or the viscosity of the liquid, similarly to the case of the edge shooter type. When there are provided two movable members 31 for a heat generating element 2 as shown in FIG. 31 in a side shooter type head, the area of the movable member 31 is a total of the two.

Embodiment 2 of the Ejection Method

In this embodiment, the use is made with the area of the movable member, heights of the first liquid flow path and the second liquid flow path, the longitudinal elasticity of the movable member, and the viscosity of the liquid, as selected in the manner described in the foregoing, in an edge shooter type head, wherein the fulcrum of the movable member is disposed at a side different from ejection outlet for the ejection liquid with respect to the displacement region where the free end of the movable member displaces, and wherein the free end is faced to the effective bubble generation region disposed downstream of the center portion of the length in the direction from the fulcrum of the effective bubble generation region of the heat generating element toward the free end, and a part of the effective bubble generation region downstream of the effective bubble generation region faced to the free end, is directly faced to the displacement region.

According to this embodiment, under that condition that free end is disposed at the ejection outlet side, such a portion of the bubble generated from the effective bubble generation region as is directly directed to the ejection outlet, is at a front portion of a downstream side of the center portion of the effective bubble generation region with respect to the direction from the fulcrum toward the free end; and this can be used for providing the environmental condition tending to move the free end with the pressure inclination formation to directly move the free end. More particularly, the acoustic wave (compressional wave) produced upon the bubble generation from the effective bubble generation region is propagated directly through the liquid to quickly provide the pressure inclination (distribution) in the displacement region (liquid flow path) of the movable member. As a result, the amount of the liquid which is along the movement direction on the movable member surface adjacent the free end of the movable member and which moves toward the ejection outlet, is increased.

According to this embodiment, the region where the flow of the liquid is separated toward the ejection outlet side and the fulcrum or fixed side in the displacement region, can be shifted toward the fulcrum side in the region faced to the movable member, so that the ejection amount of the liquid can be further stabilized, thus improving the ejection efficiency and optimizing the refilling function, and therefore, making the refilling speedy.

The reflection and the inducing structure alone can enhance the pressure distribution to make the motion of liquid proper.

By the reflection and inducing structure in addition to the effective bubble generation region directly faced to the displacement region in this embodiment, the environmental condition is optimized. Or, using the structure, the induction of the bubble toward the ejection outlet side can be properly effected, and the overall ejection efficiency is improved.

Figure 32:
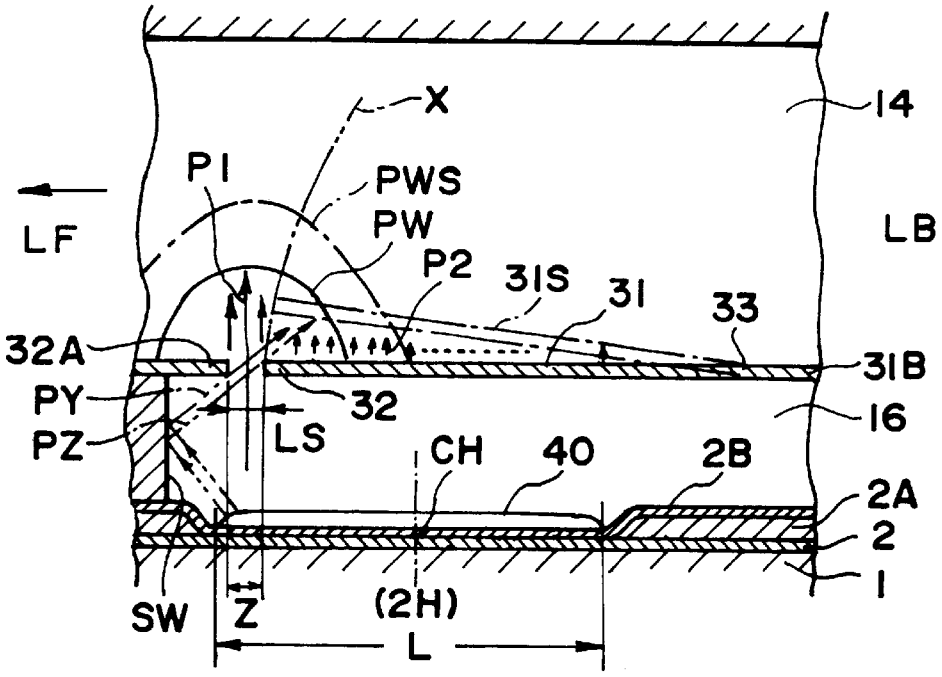
FIG. 32 is a schematic sectional view of a liquid ejecting head taken along a liquid flow path direction, for illustration of a liquid ejecting method according to Embodiment 2 of the present invention.

Referring to FIG. 32, the description will be made as to the embodiment.

FIG. 32 is a longitudinal schematic sectional view of an example of a liquid ejecting head for carrying out the liquid ejecting method.

The liquid ejecting head includes a heat generating resistor, on an element substrate 1 as an electrothermal transducer for constituting a heat generating element 2 (effective bubble generation region 2H is 40 $\mu$m×115 $\mu$m, and having a length L) for applying heat to the liquid, and a liquid flow path is provided on the element substrate 1 and includes a second liquid flow path 16 having a bubble generating region corresponding to the heat generating element 2.

The liquid flow path has a first liquid flow path 14 in fluid communication with the ejection outlet unshown, and is in fluid communication with a common liquid chamber unshown for supplying the liquid to a plurality of liquid flow paths to receive an amount of the liquid corresponding to the liquid ejected from the ejection outlet, from the common liquid chamber. The heat generating element 2 has a protection layer 2B with the electrode 2A, and it receives a driving pulse for generating film boiling to generate the bubble 40.

Above the element substrate in the liquid flow path 10, a movable member or plate 31 in the form of a cantilever of an elastic material such as metal (of Ni having a thick of 5 $\mu$m) is provided faced to the heat generating element 2. One end of the movable member 31 is fixed to a supporting member (unshown) formed by patterning photosensitive resin material on the element substrate 1 or the wall of the liquid flow path. By this, the movable member 31 is supported and provides the fulcrum 33.

The movable member 31 is so positioned that it has a fulcrum 33 in an upstream side with respect to a general flow of the liquid from the common liquid chamber 13 toward the ejection outlet 18 through the movable member 31 caused by the ejecting operation and so that it has a free end (free end portion) 32 in a downstream side of the fulcrum 33. The movable member 31 is faced to the heat generating element 2 with a predetermined gap as if it covers the heat generating element 2. A bubble generation region 11 is constituted between the heat generating element 21 and movable member 31. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 10 is divided by the movable member 31, into a first liquid flow path 14 which is directly in communication with the ejection outlet 18 and a second liquid flow path 16 having the bubble generation region 11 and the liquid supply port 12.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No. 4,723,129. The bubble and the pressure caused by the generation of the bubble act mainly on the movable member, so that movable member 31 moves or displaces to widely open toward the ejection outlet side about the fulcrum 33. By the displacement of the movable member 31 or the state after the displacement, the propagation of the pressure caused by the generation of the bubble and the growth of the bubble 40 per se are directed toward the ejection outlet 18.

The heat generating resistor comprises an electrode 2A and a protection layer 2B, and the effective bubble generation region 2H (L) is slightly smaller than the length of the heat generating element 2. The head has a communicating portion (length of LS) which is directly in communication with the first liquid flow path 14 without facing to the movable member 31 (in the Figure, the space between the separation wall 32A and the free end 32), and such a portion of the effective bubble generation region of the heat generating element 2 as is faced to the communicating portion is called partial effective bubble generation region Z. As shown in FIG. 32, the partial effective bubble generation region Z permits the effective use of the transmission of the acoustic wave to provide the environment facilitating the motion of the free end 32 in terms of the pressure inclination formation in the first liquid path. More particularly, the acoustic wave (compressional wave) upon the bubble generation from the effective bubble generation region 2H is directly applied reciprocally to the liquid in the first liquid flow path 14 to assure the quick formation of the pressure inclination facilitating the movable member 31 to displace into the liquid, particularly into the displacement region (liquid flow path) of the movable member 31. As a result, the amount of the liquid which is along the movement direction on the movable member surface adjacent the free end of the movable member and which moves toward the ejection outlet, is increased.

The acoustic wave P1 (directly propagated) and acoustic wave P2 (passing through the movable member 31) is propagated at a speed of substantially 1000 m/sec during the period of 0.21 $\mu$sec before the formation of the bubble 40, and therefore, the pressure inclination is formed by reciprocation thereof in the liquid passage (not more than distance 100 $\mu$m at the max.). The pressure distribution is schematically shown by curve PW. The pressure distribution formation by the acoustic wave P1, is maximized adjacent the free end 32 of the movable member 31 to provide the environment to greatly move the liquid in the first liquid flow path 14 corresponding to the surface of the movable member 31 toward the fulcrum 33 of the movable member 31. Namely, the separation region where the flow of the liquid is separated to the one directed to the ejection outlet side and the other directed toward the fulcrum 33 side in the displacement region, can be shifted to the fulcrum 33 side of the surface region of the movable member, and therefore, the ejection amount of the liquid can be stabilized, and the refilling is optimized and made speedy.

PWS represents the case where the pressure distribution P1 thereof enhanced the pressure inclination, so that range in which the initial force for the movement of the liquid toward above the movable member 31 and toward the fulcrum 33 side, is enlarged. The curve PWS of the pressure distribution increases with increase of the length LS of said communicating portion (between the separation wall 32A and the free end 32 of the movable member 31 faced thereto), but it is desirable that at least the free end 32 is upstream to the center CH (3) (half of the length L of the effective bubble generation region 2H) (<L/2). Practically, it is between 5 $\mu$m and 30 $\mu$m although it is dependent of the length of the effective bubble generation region 2H. In this embodiment, the communicating portion is faced to the inside of the range of the effective bubble generation region 2H, however, from the standpoint of the efficiency, it is preferably faced to the region including the downstream end of the effective bubble generation region 2H.

Designated by reference numeral 31S is a part of the displacement of the movable member, and X is a trace of the free end 32 motion.

Embodiment 3 of Ejection Method

In this embodiment, the area of the movable member, the heights of the first liquid flow path and the second liquid flow path, the longitudinal elasticity of the movable member and the viscosity of the liquid are determined as described in the foregoing; and the direct communication region where the ejection outlet is in direct fluid communication with the effective bubble generation region of the heat generating element, and the free end of the movable member displaceable by the bubble between the effective bubble generation region and the ejection outlet, are adjacent to the region faced to inside of the minimum inner diameter of the ejection outlet; and the length of the effective bubble generation region opposed to the direct communication region is not less than 5 $\mu$m; or the length of said direct communication region measured along the effective bubble generation region is 5 $\mu$m, so that said bubble is regulated.

Figure 33:
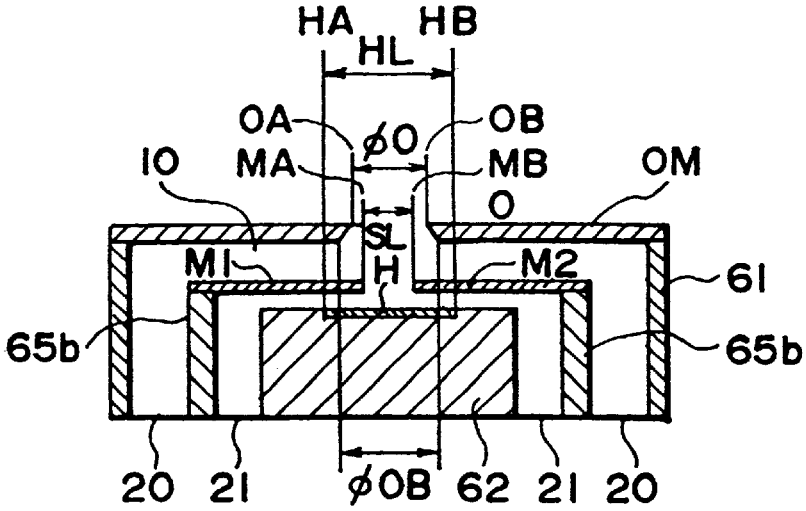
FIGS. 33, (a) to (e) is a schematic sectional view showing liquid ejection steps in a liquid ejecting head of the side shooter type, for illustration of a liquid ejecting method according to Embodiment 3 of the present invention.
Figure 33:
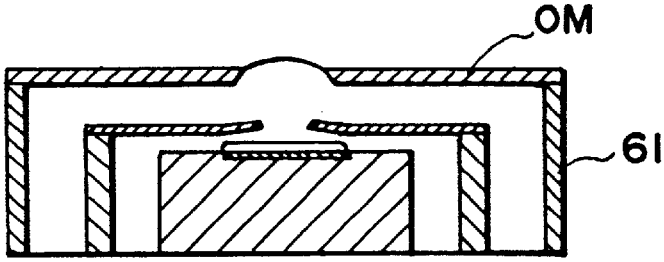
Figure 33:
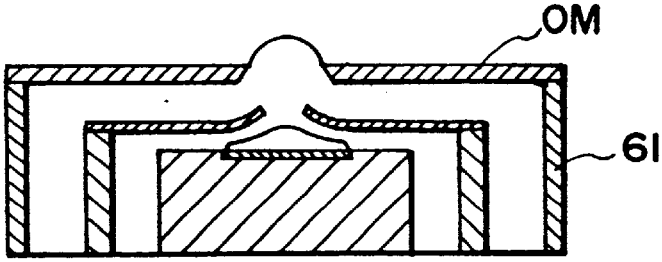
Figure 33:
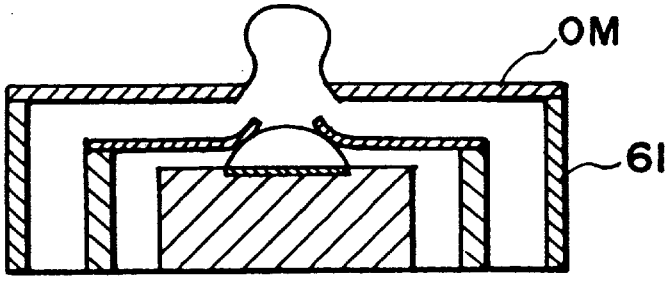
Figure 33:
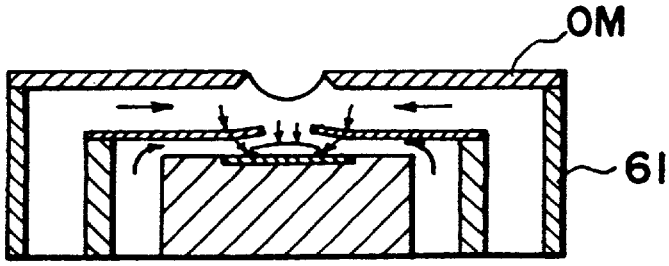

FIG. 33 is a schematic sectional view of an example of a liquid ejecting head for carrying out liquid ejecting method of Embodiment 3.

The liquid ejecting head used in this embodiment, has a heat generating element H having a heat generating surface and an ejection outlet O substantially faced in parallel thereto (so-called side shooter type). The heat generating element H (heat generating resistor of 48 $\mu$m×46 $\mu$m in this embodiment) is provided on a substrate 62, and generations thermal energy for generating a bubble through film boiling as discloses in U.S. Pat. No. 4,723,129. The ejection outlet O is formed in an orifice plate OM which is an ejection outlet portion material. The orifice plate OM is fixed to the substrate supporting member 61, and is formed by electroforming from nickel.

A liquid flow path 10 is provided between the orifice plate OM and the substrate 62 so that it is directly in fluid communication with the ejection outlet O to flow the liquid therethrough. In the embodiment, the liquid to be ejected is a water base ink.

The liquid flow path 10 is provided with two movable members M1, M2 in the form of cantilever types of faced to the heat generating element H. The movable members M1, M2 are disposed adjacent to the upward projected space of the heat generating surface in the direction perpendicular to the heat generating surface of the heat generating element H, and are opposed to each other with the direct communication region therebetween, the direct communication region directly communicating with the ejection outlet O through a slit SL provided by the movable members M1, M2. The movable members M1, M2 are of a material having an elasticity, such as metal. In this embodiment, it is of nickel having a thickness of 5 $\mu$m. The fulcrum sides of the movable members M1, M2 are securedly supported on supporting member 65*b*. The supporting member 65*b* is formed by patterning photosensitive resin material on the substrate 62. There is a gap of approx. 15 μm between the movable members M1, M2 and the heat generating surface.

At least parts of the movable members M1, M2 are faced to the heat generating element H, and are disposed in the region to which the pressure produced by the bubble, is influential. The slit SL at the free ends of the movable members M1, M2 has a region where the growing component of the bubble is directly directed toward the ejection outlets O, and the other components are directed toward the ejection outlet O by the displacements of the movable members M1, M2, and in view of this, it has a width of 5 μm to ejection outlet diameter ϕO.

The structures of this embodiment is shown in FIG. 33, (a). The positions of the ends of the heat generating element H, in the horizontal direction (right-left direction on the Figure) which is substantially parallel to the ejection surface of the ejection outlet O and the heat generating surface of heat generating element H, are indicated by HA, HB, and the length therebetween is HL. The free ends of the movable members M1, M2 in the horizontal direction are indicated by MA, MB, and a slit SL is constituted therebetween. The ejection outlet O formed in the orifice plate OM is tapered to be converged toward the outside to stabilize the configuration of the ejected liquid, as shown in the figure. Therefore, the diameter at the outer surface of the orifice plate OM is different from that at the inner surface, and the diameter at the outer surface has the maximum at the position positions OA, OB, and the ejection outlet diameter ϕOB at the inside is larger than the ϕO.

The second supply passage 21 is defined by the movable member M1, M2, supporting member 65*b* and the substrate 62, and the first supply passage 20 is defined outside thereof by the supporting member 61 and the orifice plate OM. When a bubble is generated in the liquid by the generation of the heat from the heat generating surface of the heat generating element H, the pressure wave due to the generation of the bubble and the bubble growth toward the ejection outlet O causes the liquid ejection to start through the slit SL to bulge the heat generating surface out. The pressure wave from the end of the bubble and the growth thereat is radially directed, and therefore, they are not directed to the ejection outlet O, but the movable members M1, M2 are provided adjacent thereto, so that they causes displacement of the movable members M1, M2.

In FIG. 33, (c), the bubble further expands to further bulge the meniscus out, and further displacements the movable members M1, M2. At this time, the bubble growing component is conducted toward the ejection outlet O, while being concentrated toward the center of the ejection outlet O by the displacement of the movable member M and M2.

In FIG. 33, (d), the bubble further grows closely to the maximum volume, and the grown bubble is guided further to the ejection outlet O by the movable members M1, M2. At this time, the movable members M1, M2 move such that pressure and the growth of the bubble do not escape to the first supply passage 20 of the liquid flow path 10, and provides complete open state relative to the ejection outlet diameter ϕO, so that ejection efficiency is highest.

In FIG. 33, (e), the bubble is contracting, wherein the bubble is quickly contracting due to the decrease of the internal pressure, and the meniscus is retracted from the ejection outlet O, correspondingly, and simultaneously, the movable member M1, M2 return to the initial position from the displaced position, thus smoothly carry out the liquid supply. Therefore, the retraction of the meniscus is small. When the inside of the ejection outlet O is seen with magnification from the outer side of the orifice plate OM, a part of the movable members M1, M2 can be seen through the ejection outlet O when the liquid is transparent. Furthermore, a part of the heat generating element H can been seen through the slit SL provided by the free ends. The slit SL has a width not less than 5 μm, and has a direct communication region for directly propagating the pressure from the bubble from the heat generating element H to the ejection outlet O. By the size of the slit SL, 5 μm, the direct communication region can be assured. Since the slit SL is narrower than the ejection outlet diameter ϕO, the components of the pressure or growth not directly directed to the ejection outlet O is directed to the ejection outlet O by the displacement described above, and the escape of the components toward the liquid supply side can be prevented.

The heat generating element H (electrothermal transducer) is supplied with the electric signal through the wiring electrode (unshown) on the substrate 62.

<Liquid Ejecting Apparatus>

Figure 34:
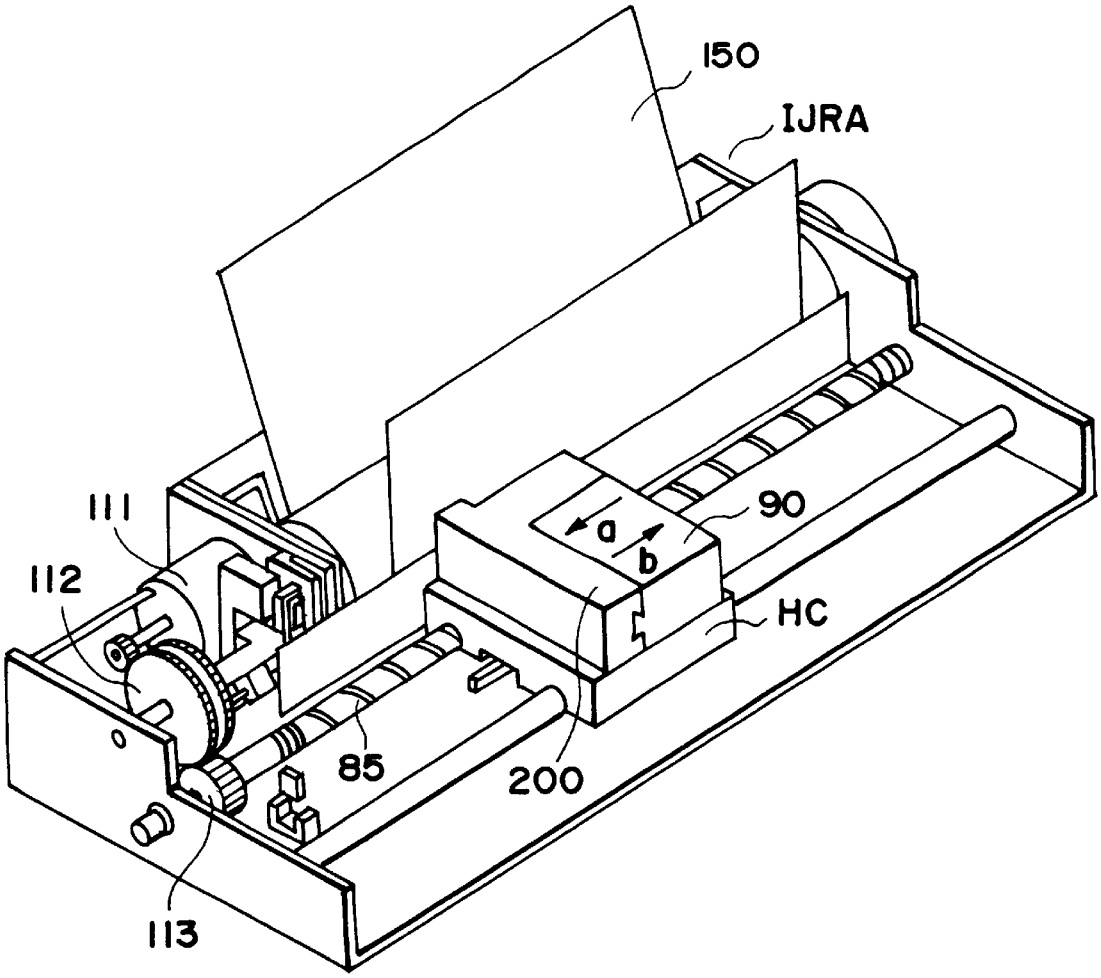
FIG. 34 is a schematic illustration of a liquid ejecting apparatus.

FIG. 34 shows a schematic structure of a liquid ejecting apparatus carrying the above described liquid ejecting head. In this example, the ejection liquid is ink. The apparatus is an ink ejection recording apparatus IJRA. A carriage HC of the liquid ejecting apparatus carries a head cartridge comprising liquid container 90 for accommodating the ink and the liquid ejecting head 200 which are detachably mountable relative to each other, and is reciprocable in a lateral direction (arrows a and b) of a recording material 150 such as recording sheet feed by feeding means.

In FIG. 34, when a driving signal is supplied to the liquid ejecting means on the carriage HC from unshown driving signal supply means, the recording liquid is ejected to the recording material 150 from the liquid ejecting head 20 in response to the signal.

The liquid ejecting apparatus of this example comprises a motor 111 as a driving source for driving the recording material transporting means and the carriage, gears 112, 113 for transmitting the power from the driving source to the carriage, and carriage shaft 115 and so on. By the recording device and the liquid ejecting method using this recording device, good prints can be provided by ejecting the liquid to the various recording material.

Figure 35:
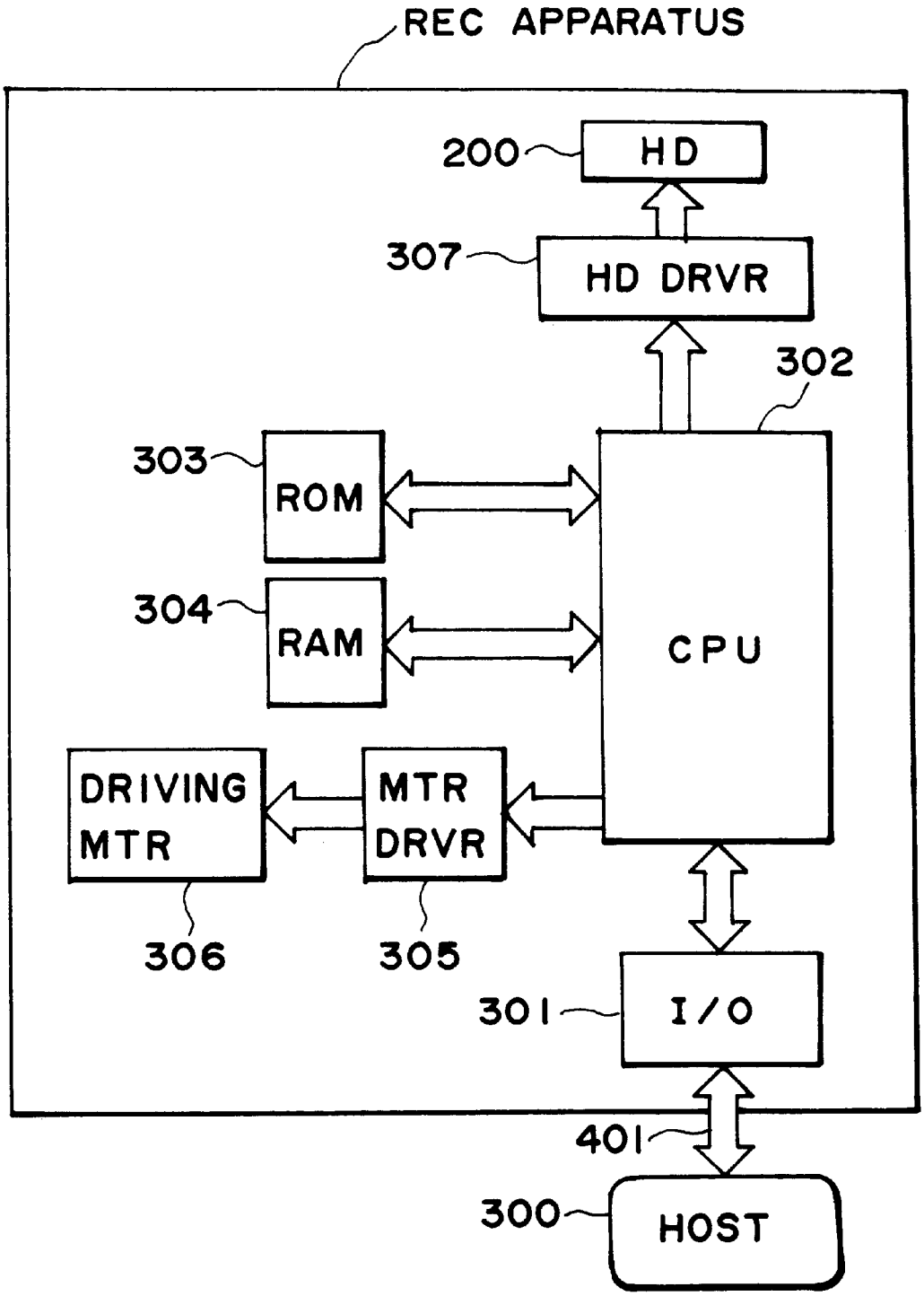
FIG. 35 is a block Figure of an apparatus.

FIG. 35 is a block diagram of the entirety of the device for carrying out ink ejection recording using the liquid ejecting head and the liquid ejecting method applicable to the present invention.

The recording apparatus receives printing data in the form of a control signal from a host computer 300. The printing data is temporarily stored in an input interface 301 of the printing apparatus, and at the same time, is converted into processible data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following control programs stored in a ROMs 303. The CPU 302 processes the aforementioned data inputted to the CPU 302, into printable data (image data), by processing them with the use of peripheral units such as RAMs 304 or the like, following control programs stored in a ROMs 303. The image data and the motor driving data are transmitted to a head 200 and a driving motor 306 through a head driver 307 and a motor driver 305, respectively, which are controlled with the proper timings for forming an image.

As for recording material, to which liquid such as ink is adhered, and which is usable with a recording apparatus such as the one described above, the following can be listed; various sheets of paper; OHP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus for ceramic material, a recording apparatus for three dimensional recording material such as sponge or the like, a textile printing apparatus for recording images on fabric, and the like recording apparatuses.

As for the liquid to be used with these liquid ejection apparatuses, any liquid is usable as long as it is compatible with the employed recording medium, and the recording conditions.

<Recording System>

An exemplary ink jet recording system will be described, which records images on recording medium, using, as the recording head, the liquid ejection head in accordance with the present invention.

FIG. 36 is a schematic perspective view of an ink jet recording system employing the aforementioned liquid ejection head 201 in accordance with the present invention, and depicts its general structure. The liquid ejection head in this embodiment is a full-line type head, which comprises plural ejection orifices aligned with a density of 360 dpi so as to cover the entire recordable range of the recording material 150. It comprises four heads 201*a* to 201*d*, which are correspondent to four colors; yellow (Y), magenta (M), cyan (C) and black (Bk). These four heads are fixedly supported by a holder 202, in parallel to each other and with predetermined intervals.

These heads are driven in response to the signals supplied from a head driver 307, which constitutes means for supplying a driving signal to each head.

Each of the four color inks 201*a* to 201*d* is supplied to a correspondent head from an ink container 204*a*, 204*b*, 205*c* or 204*d*. A reference numeral 204*e* designates a bubble generation liquid container from which the bubble generation liquid is delivered to each head 201*a*–201*d*. Below each head, a head cap 203*a*, 203*b*, 203*c* or 203*d* is disposed, which contains an ink absorbing member composed of sponge or the like. They cover the ejection orifices of the corresponding heads, protecting the heads, and also maintaining the head performance, during a non-recording period.

A reference numeral 206 designates a conveyer belt, which constitutes means for conveying the various recording material such as those described in the preceding embodiments. The conveyer belt 206 is routed through a predetermined path by various rollers, and is driven by a driver roller connected to a motor driver 305.

The ink jet recording system in this embodiment comprises a pre-printing processing apparatus 251 and a post-printing processing apparatus 252, which are disposed on the upstream and downstream sides, respectively, of the ink jet recording apparatus, along the recording material conveyance path.

The pre-printing process and the postprinting process vary depending on the type of recording medium, or the type of ink. For example, when recording material composed of metallic material, plastic material, ceramic material or the like is employed, the recording material is exposed to ultraviolet rays and ozone before printing, activating its surface. In a recording material tending to acquire electric charge, such as plastic resin material, the dust tends to deposit on the surface by static electricity. The dust may impede the desired recording. In such a case, the use is made with ionizer to remove the static charge of the recording material, thus removing the dust from the recording material. When a textile is a recording material, from the standpoint of feathering prevention and improvement of fixing or the like, a pre-processing may be effected wherein alkali property substance, water soluble property substance, composition polymeric, water soluble property metal salt, urea, or thiourea is applied to the textile. The pre-processing is not limited to this, and it may be the one to provide the recording material with the proper temperature. The pre-processing is not limited to this, and it may be the one to provide the recording material with the proper temperature.

On the other hand, the post-processing is a process for imparting, to the recording material having received the ink, a heat treatment, ultraviolet radiation projection to promote the fixing of the ink, or a cleaning for removing the process material used for the pre-treatment and remaining because of no reaction.

In this embodiment, the head is a full line head, but the present invention is of course applicable to a serial type wherein the head is moved along a width of the recording material.

<Head Kit>

Figure 37:
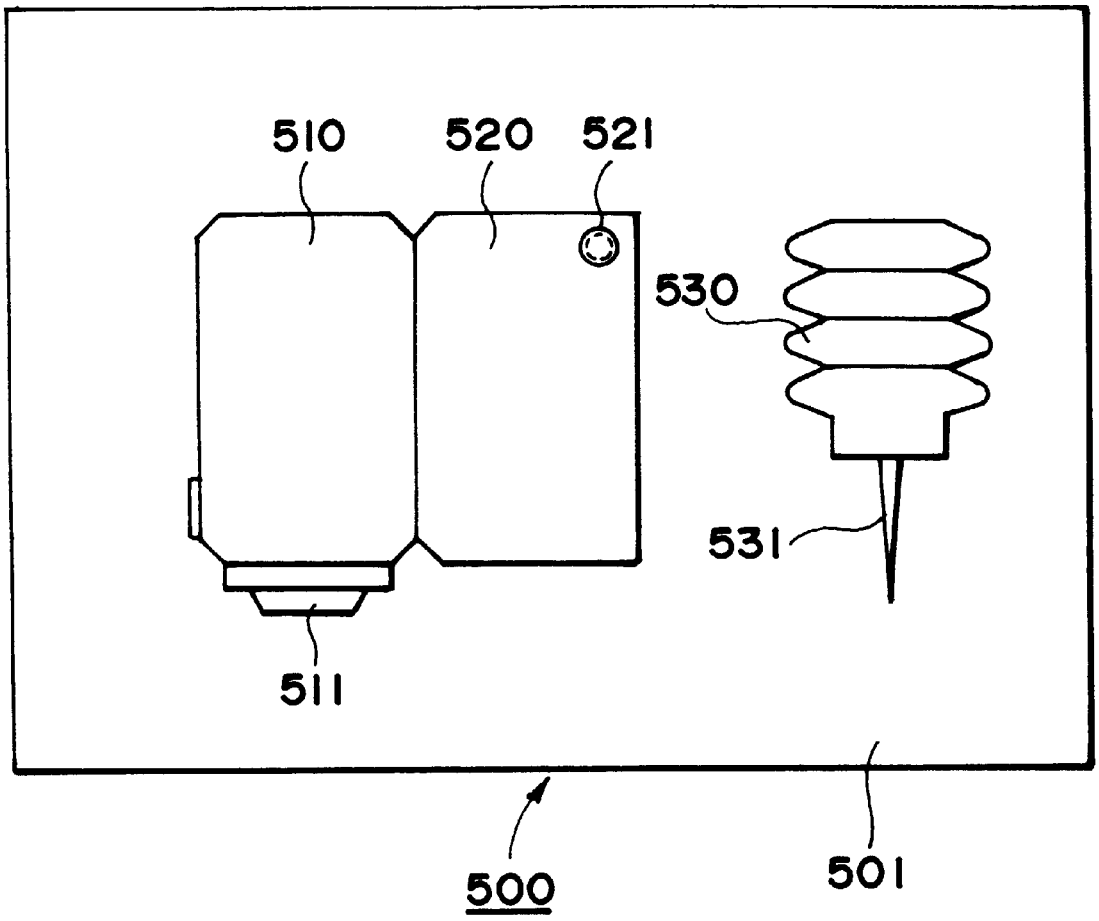
FIG. 37 is a schematic view of a head kit.

A head kit usable for the liquid ejecting head of the present invention will be described. FIG. 37 is a schematic view of a head kit according to an embodiment of the present invention. It comprises a head 510 according to the present invention having an ink ejection portion 511 for ejecting the ink, an ink container 520 (liquid container) separable or non-separable relative to the head, ink filling means for containing the ink for filling into the ink container, and a kit container 501 containing all of them. It comprises a head 510 according to the present invention having an ink ejection portion 511 for ejecting the ink, an ink container 520 (liquid container) separable or non-separable relative to the head, ink filling means for containing the ink for filling into the ink container, and a kit container 501 containing all of them.

When the ink is used up, a part of an inserting portion (injection needle or the like) 531 of the ink filling means is inserted into an air vent 521 of the ink container or into a hole or the like formed in a wall of the ink container or in a connecting portion relative to the head, and the ink in the ink filling means is filled into the ink container. Thus, the liquid ejecting head of the present invention, ink container, ink filling means or the like, are accommodated in the kit container, so that when the ink is used up, the ink can be filled into the ink container without difficulty.

In the head kit 500 of this embodiment, the ink filling means is contained, but the head kit may not have the ink filling means, and instead, the kit container 510 may contain a full ink container detachably mountable to the head as well as the head.

In FIG. 37, there is shown only ink filling means for filling the ink to the ink container, but the kit container may also contain bubble generation liquid filling means 530 for filling the bubble generation liquid into the bubble generation liquid container as well as the ink container.

As described in the foregoing, according to an aspect of the present invention, the liquid adjacent the ejection outlet can be ejected at the high speed and with good directivity so that refilling frequency can be increased, and the shot accuracy is enhanced, so that high image quality of the image can be accomplished.

According to another aspect of the present invention, the pressure wave upon the bubble generation is directed to the ejection outlet side, and therefore, the subsequent growth of the bubble is directed to the ejection outlet side so that bubble is assuredly and efficiently guided.

According to a further aspect of the present invention, the growth of the bubble is further assured toward the ejection outlet.

According to a further aspect of the present invention, the bubble generation is stabilized, and the pressure can be properly directed toward the ejection outlet, so that ejection efficiency and the ejection power can be improved. Additionally, the durability can be improved.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejection head for ejecting liquid with generation of a bubble, comprising:

a heat generating element for generating heat to form the bubble in a liquid flow path communicating with an ejecting outlet for ejecting liquid, said heat generating element including a resistance layer and a pair of electrodes connected to said resistance layer; and a movable member having a fulcrum and a free end located downstream of said fulcrum relative to a direction of flow of liquid in said liquid flow path, said movable member being disposed faced to said heat generating element with a space and displaceable between a first position and a second position further from said heat generating element than said first position, said moveable member being movable from said first position to said second position by pressure produced by generation of the bubble, wherein a period is provided in which a displacing speed of said free end of said movable member is higher than a growing speed of the bubble growing toward said movable member, before the bubble reaches said movable member.

2. A liquid ejection head according to claim 1, further comprising a first liquid flow path in fluid communication with the ejection outlet and having the displacement region and a second liquid flow path including said bubble generating region and a heat generating element, wherein the movable member is disposed between the first liquid flow path and the second liquid flow path.

3. A liquid ejection head according to claim 2, wherein the first liquid flow path and the second liquid flow path are supplied with liquids which are different from each other, and the liquid supplied to the first liquid flow path has a viscosity of 1–1000 cP; and the liquid supplied to the second liquid flow path has a viscosity of 1–100 cP.

4. A liquid ejection head according to claim 2 wherein the height of said first liquid flow path is 30–60 $\mu$m.

5. A liquid ejection head according to claim 2, wherein the height of said second liquid flow path is 3–25 $\mu$m.

6. A liquid ejection head according to claim 2, wherein the viscosity of the liquid is 1–10 cP.

7. A liquid ejection head according to claim 2, wherein the viscosity of the liquid supplied to the second liquid flow path is 1–10 cP.

8. A liquid ejection head according to claim 1, wherein the heat generating element has an area of 64–20000 $\mu m^2$; a projected area of the movable member to the second liquid flow path is 64–40000 $\mu m^2$; the movable member has a longitudinal elasticity of $1\times10^3$–$1\times10^6$ N/mm$^2$; said first liquid flow path has a height of 10–150 $\mu$m; said second liquid flow path has a height of 0.1–40 $\mu$m; and the liquid has a viscosity of 1–100 cP.

9. A liquid ejection head according to claim 1, wherein the area of the heat generating element is 500–5000 $\mu m^2$.

10. A liquid ejection head according to claim 1, wherein the projected area of the movable member to the second liquid flow path is 1000–15000 $\mu m^2$.

11. A liquid ejection head according to claim 1, wherein the longitudinal elasticity of the movable member is $1\times10^4$–$5\times10^5$ N/mm$^2$.

12. A liquid ejection head according to claim 1, wherein the free end of the movable member is disposed downstream of an area center of the heat generating element.

13. A liquid ejection head according to claim 1, further comprising a supply passage for supplying the liquid onto the heat generating element from upstream thereof.

14. A liquid ejection head according to claim 13, wherein the supply passage has a substantially flat or smooth inner wall upstream of the heat generating element, and the liquid is supplied onto said heat generating element along the inner wall.

15. A liquid ejection head according to claim 1, wherein the bubble is generated by film boiling caused by the heat generated by the heat generating element.

16. A liquid ejection head according to claim 15, wherein all of the effective bubble generation region of the heat generating element is faced to the movable member.

17. A liquid ejection head according to claim 1, wherein the movable member is in the form of a plate.

18. A liquid ejection head according to claim 1, wherein an entire surface of the heat generating element is faced to said movable member.

19. A liquid ejection head according to claim 1, wherein the total area of the movable member is larger than a total area of the heat generating element.

20. A liquid ejection head according to claim 1, wherein the fulcrum of said movable member is outside a region right above the heat generating element.

21. A liquid ejection head according to claim 1, wherein the free end of the movable member is extended substantially perpendicularly to the liquid flow path having the heat generating element.

22. A liquid ejection head according to claim 1, wherein the free end of the movable member is disposed closer to the ejection outlet than the heat generating element.

23. A liquid ejection head according to claim 22, wherein the movable member is a part of a separation wall between the first liquid flow path and the second liquid flow path.

24. A liquid ejection head according to claim 23, wherein the separation wall is of a metal material.

25. A liquid ejection head according to claim 23, wherein the separation wall is of a resin material.

26. A liquid ejection head according to claim 23, wherein the separation wall is of a ceramic material.

27. A liquid ejection apparatus comprising a liquid ejection head for ejecting liquid with generation of a bubble, said liquid ejection head comprising:

a heat generating element for generating heat to form the bubble in a liquid flow path communicating with an ejecting outlet for ejecting liquid, said heat generating element including a resistance layer and a pair of electrodes connected to said resistance layer; and a movable member having a fulcrum and a free end located downstream of said fulcrum relative to a direction of flow of liquid in said liquid flow path, said movable member being disposed faced to said heat generating element with a space and displaceable between a first position and a second position further from said heat generating element than said first position, said moveable member being movable from said first position to said second position by pressure produced by generation of the bubble, wherein a period is provided in which a displacing speed of said free end of said movable member is higher than a growing speed of the bubble growing toward said movable member, before the bubble reaches said movable member.

* * * * *